US009631841B2

(12) United States Patent
Ishizaka et al.

(10) Patent No.: US 9,631,841 B2
(45) Date of Patent: Apr. 25, 2017

(54) REFRIGERANT EVAPORATOR

(71) Applicant: DENSO CORPORATION, Kariya, Aichi-pref. (JP)

(72) Inventors: Naohisa Ishizaka, Okazaki (JP); Norimasa Baba, Toyoake (JP); Ichio Kamei, Toyota (JP); Kengo Kazari, Anjo (JP); Shota Chatani, Chita-gun (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 238 days.

(21) Appl. No.: 14/383,034

(22) PCT Filed: Mar. 4, 2013

(86) PCT No.: PCT/JP2013/001333
§ 371 (c)(1),
(2) Date: Sep. 4, 2014

(87) PCT Pub. No.: WO2013/132826
PCT Pub. Date: Sep. 12, 2013

(65) Prior Publication Data

US 2015/0027163 A1 Jan. 29, 2015

(30) Foreign Application Priority Data

Mar. 6, 2012 (JP) ..... 2012-049573

(51) Int. Cl.
*F25B 39/02* (2006.01)
*F25B 5/00* (2006.01)
*F28D 1/053* (2006.01)

(52) U.S. Cl.
CPC ..... *F25B 5/00* (2013.01); *F25B 39/02* (2013.01); *F28D 1/05308* (2013.01); *F28D 1/05391* (2013.01)

(58) Field of Classification Search
CPC ..... F25B 5/00; F25B 39/02; F28D 1/05308; F28D 1/05391
(Continued)

(56) References Cited

U.S. PATENT DOCUMENTS 3,750,418 A * 8/1973 Maudlin ..... F25B 39/02 165/181
4,040,268 A * 8/1977 Howard ..... F25B 5/00 62/335
(Continued)

FOREIGN PATENT DOCUMENTS

JP 3391339 B2 3/2003
JP 2005299981 A 10/2005
(Continued)

OTHER PUBLICATIONS

International Search Report and Written Opinion (in Japanese with English Translation) for PCT/JP2013/001333, mailed May 21, 2013; ISA/JP.

*Primary Examiner* — Len Tran
*Assistant Examiner* — Kirstin Oswald
(74) *Attorney, Agent, or Firm* — Harness, Dickey & Pierce, P.L.C.

(57) ABSTRACT

A refrigerant evaporator includes four core portions. A part of the refrigerant passes through a first core portion and a fourth core portion. The other part of the refrigerant passes through a second core portion and a third core portion. An exchanging unit exchanges the positions where the refrigerant flows. A passage through which the second core portion communicates with the third core portion includes a throttle passage in the intermediate tank unit. The throttle passage and the end portion of the intermediate tank unit reverse the refrigerant flow toward a partitioning member. Since the distribution of a liquid-phase refrigerant is adjusted by the throttle passage, a concentration of the
(Continued)

liquid-phase refrigerant on a position in the vicinity of an outlet of the third core portion is suppressed. Accordingly, the concentration of the liquid-phase refrigerant in the core portions located downstream of the refrigerant flow is suppressed.

19 Claims, 28 Drawing Sheets

(58) Field of Classification Search
USPC ..... 62/518–528
See application file for complete search history.

(56) References Cited

U.S. PATENT DOCUMENTS 4,041,727 A * 8/1977 Maudlin ..... F24F 13/22 165/181
4,365,487 A * 12/1982 Dobney ..... F25B 1/00 165/179
4,546,820 A * 10/1985 Whipple ..... B23P 15/26 165/77
6,449,979 B1 * 9/2002 Nagasawa ..... F28D 1/0391 62/503
7,448,436 B2 * 11/2008 Katoh ..... F25B 39/02 165/110
8,051,906 B2 * 11/2011 Wolfe, IV ..... B60H 1/00321 165/101
2001/0040027 A1 * 11/2001 Tooyama ..... F28D 1/0333 165/153
2004/0159121 A1 * 8/2004 Horiuchi ..... F25B 39/02 62/526
2004/0206490 A1 10/2004 Katoh et al.
2004/0261983 A1 * 12/2004 Hu ..... F28D 1/0443 165/148
2005/0006070 A1 * 1/2005 Kamiyama ..... F28D 1/0443 165/140
2005/0172664 A1 * 8/2005 Cho ..... F28D 1/05391 62/515
2005/0235691 A1 * 10/2005 Katoh ..... F25B 39/02 62/515
2005/0284621 A1 12/2005 Katoh et al.
2006/0054310 A1 * 3/2006 Kim ..... F25B 39/02 165/110
2006/0054312 A1 * 3/2006 Kim ..... F28D 1/05391 165/146
2006/0185386 A1 8/2006 Katoh et al.
2007/0074861 A1 4/2007 Higashiyama
2007/0215331 A1 * 9/2007 Higashiyama ..... F25B 39/022 165/167
2007/0251681 A1 * 11/2007 Higashiyama ..... F25B 39/022 165/153
2008/0011463 A1 * 1/2008 Timbs ..... F28D 1/0477 165/151
2009/0025419 A1 * 1/2009 Kerler ..... F25B 39/022 62/524
2009/0107171 A1 * 4/2009 Brodie ..... F25B 39/02 62/500
2010/0031698 A1 * 2/2010 Higashiyama ..... F25B 39/028 62/525
2011/0139428 A1 * 6/2011 Kim ..... F28F 1/128 165/181
2011/0203308 A1 * 8/2011 Chiang ..... F28F 9/0273 62/498
2014/0224462 A1 * 8/2014 Kamada ..... F82F 1/022 165/181

FOREIGN PATENT DOCUMENTS

JP 2006010263 A 1/2006
JP 2006029697 A 2/2006
JP 2006183962 A 7/2006
JP 4024095 B2 12/2007
JP 4124136 B2 7/2008
JP 4207855 B2 1/2009
JP 4281634 B2 6/2009
JP 4625687 B2 2/2011

* cited by examiner

COMPARATIVE EXAMPLE

COMPARATIVE EXAMPLE (a)

(b)

$L/2 \leqq Ld$ (a)

(b)

(a)

(b)

COMPARATIVE EXAMPLE

REFRIGERANT EVAPORATOR

CROSS REFERENCE TO RELATED APPLICATION APPLICATIONS

This application is a U.S. National Phase Application under 35 U.S.C. 371 of International Application No. PCT/JP2013/001333 filed on Mar. 4, 2013 and published in Japanese as WO 2013/132826 A1 on Sep. 12, 2013. This application is based on Japanese Patent Application Nos. 2011-240411 filed on Nov. 1, 2011, and No. 2012-049573 filed on Mar. 6, 2012 and claims the benefit of priority from Japanese Patent Application No. 2012-049573 filed on Mar. 6, 2012. The entire disclosures of all of the above applications are incorporated herein by reference.

TECHNICAL FIELD

The present disclosure relates to a refrigerant evaporator that cools a subject-to-cooling fluid by absorbing heat from the subject-to-cooling fluid and causes refrigerant to evaporate.

BACKGROUND ART

A refrigerant evaporator functions as a cooling heat exchanger configured to cool a subject-to-cooling fluid (for example, air) by absorbing heat from the subject-to-cooling fluid flowing outside to evaporate the refrigerant (liquid-phase refrigerant) flowing inside.

Examples of the known refrigerant evaporator of this type include a configuration in which first and second evaporators each provided with a heat exchanging core unit having multiple stacked tubes and a pair of tank units connected to both end portions of the multiple tubes are arranged in series in a flowing direction of the subject-to-cooling fluid, and one of the tank units of the respective evaporators are coupled via a pair of communicating portions (For example, see Patent Document 1).

In the refrigerant evaporator disclosed in Patent Document 1, when refrigerant flowing in a heat exchanging core unit of the first evaporator is flowed to a heat exchanging core unit of the second evaporator via one of the tank units of the respective evaporators and the pair of communicating portions that couples the tank units, the flow of the refrigerant is switched in the width direction (lateral direction) of the heat exchanging core units. In other words, in the refrigerant evaporator, refrigerant flowing on one side in the width direction of the heat exchanging core unit of the first evaporator via one of the pair of communicating portions flows to the other side in the width direction of the heat exchanging core unit of the second evaporator, and refrigerant flowing on the other side in the width direction of the heat exchanging core unit of the first evaporator by the other communicating portion flow to one side in the width direction of the heat exchanging core unit of the second evaporator.

Patent Documents 1 to 3 disclose refrigerant evaporators. The disclosed refrigerant evaporators each absorb heat from a subject-to-cooling fluid flowing outside, for example, air, and evaporate the refrigerant flowing inside. As a result, the refrigerant evaporator functions as a cooling heat exchanger configured to cool the subject-to-cooling fluid. The disclosed refrigerant evaporator further includes a first evaporator and a second evaporator arranged in series on an upstream side and a downstream side in a flowing direction of the subject-to-cooling fluid. Each evaporator includes a core portion having multiple stacked tubes and a pair of the tank units connected to both end portions of the multiple tubes. The core portion of the first evaporator is zoned in the width direction, that is, the lateral direction. The core portion of the second evaporator is also zoned in the width direction, that is, the lateral direction.

The refrigerant evaporators disclosed in Patent Documents 1 to 3 are each provided with an exchanging unit configured to exchange the refrigerant in the lateral direction at a communicating portion in which the refrigerant flows from the first evaporator on the downstream side to the second evaporator on the upstream. The exchanging unit is provided by the two communicating portions. One of the communicating portions is configured to lead refrigerant flowing out from one portion of the first evaporator, for example, from the right side portion to the other portion of the second evaporator, for example, to the left side portion. The other communicating portion is configured to lead the refrigerant flowing out, for example, from the other portion, that is, the left side portion of the first evaporator to one portion of the second evaporator, for example, to the right side portion. The exchanging unit may also be referred to as an intersecting flow channel.

Patent Document 4 discloses a refrigerant evaporator. The disclosed refrigerant evaporator is provided with a throttle member in the tank in order to adjust distributing properties of the refrigerant to multiple heat exchanging tubes.

PRIOR ART DOCUMENT

Patent Document

Patent Document 1: Japanese Patent No. 4124136
Patent Document 2: Japanese Patent No. 4024095
Patent Document 3: Japanese Patent No. 4625687
Patent Document 4: Japanese Patent No. 3391339

SUMMARY OF THE INVENTION

According to the study of the inventor of the present application, in the refrigerant evaporators disclosed in Patent Document 1 to 3, an undesirable bias of the liquid-phase refrigerant may occur inside the core portion of the second evaporator caused by the exchanging unit. The undesirable bias of the liquid-phase refrigerant has a probability of generation of an undesirable temperature distribution in the core portion. The undesirable bias of the liquid-phase refrigerant may cause a liquid backflow phenomenon that the liquid-phase refrigerant flows out from the refrigerant evaporator.

For example, the liquid-phase refrigerant tends to flow to the heat exchanging tubes located near a connecting portion between the exchanging unit and the tank unit of the second evaporator. In contrast, the liquid-phase refrigerant may not flow easily to the tube located away from the connecting portion.

In the refrigerant evaporator having the exchanging unit, the flow channel is divided into at least two inside the refrigerant evaporator. Therefore, the flow velocity of the refrigerant tends to be low in the exchanging unit and the tank. In the refrigerant evaporator having the exchanging unit, the distance of flow of the refrigerant is long due to the existence of an exchanging flow channel. Consequently, the refrigerant evaporator having the exchanging unit, gas-phase refrigerant and the liquid-phase refrigerant tend to be separated. The separated liquid-phase refrigerant flows in contact with wall surfaces of the exchanging unit and the tank. Therefore, the liquid-phase refrigerant may concentrate a certain part of the tube.

In order to improve the undesirable bias of the liquid-phase refrigerant, employment of a throttle member in the tank disclosed in Patent Document 4 is conceivable. The throttle member in the tank has an effect in the tank configured in such a manner that the refrigerant flows from one end of the tank to the other end of the tank. However, in the refrigerant evaporator having the exchanging unit, the flow of the refrigerant in the tank is complicated. Therefore, the expected effect may be difficult to obtain with the throttle member in the tank.

In the case where the flowing direction of the refrigerant is exchanged in the pair of the communicating portions that couple the tank units on one side of the respective evaporators as in the refrigerant evaporator disclosed in Patent Document 1, the liquid-phase refrigerant may be biased to one portion of the heat exchanging core unit of the second evaporator at the time of distribution when the refrigerant from the heat exchanging core unit of the first evaporator flows to the heat exchanging core unit of the second evaporator.

In this manner, when the liquid-phase refrigerant distributing properties in the refrigerant evaporator is deteriorated, the heat exchange between the subject-to-cooling fluid and the refrigerant may not be effectively performed in a certain area, so that cooling properties of the refrigerant evaporator may be deteriorated.

It is an objective of the present disclosure is to provide a refrigerant evaporator having a capability of suppressing deterioration of refrigerant distributing properties.

It is an objective of the present disclosure is to provide the refrigerant evaporator in which distribution of the refrigerant in a core unit is improved.

It is another objective of the present disclosure is to provide a refrigerant evaporator having a capability of suppressing an undesirable concentration of the liquid-phase refrigerant in the core unit located on the downstream position of the exchanging unit.

It is another objective of the present disclosure is to provide a refrigerant evaporator having a capability of suppressing a concentration of liquid-phase refrigerant to a portion closer to an exit of the core unit located downstream of the exchanging unit.

According to a first aspect of the present disclosure, heat exchange is performed between a subject-to-cooling fluid and a refrigerant in a refrigerant evaporator. The refrigerant evaporator includes a first core portion, a second core portion, a third core portion, a fourth core portion, a first collecting portion, a second collecting portion, a first distributing portion, a second distributing portion and an intermediate tank unit. The first core portion has a plurality of tubes in which the refrigerant flows, and a heat exchange is performed between a part of the subject-to-cooling fluid and a part of the refrigerant in the first core portion. The second core portion has a plurality of tubes in which the refrigerant flows, and a heat exchange is performed between another part of the subject-to-cooling fluid and another part of the refrigerant in the second core portion. The third core portion has a plurality of tubes in which the refrigerant flows, and is disposed to overlap at least partly with the first core portion in a flow direction of the subject-to-cooling fluid. A heat exchange is performed between another part of the subject-to-cooling fluid and another part of the refrigerant in the third core portion. The fourth core portion has a plurality of tubes in which the refrigerant flows, and is disposed to overlap at least partly with the second core portion in the flow direction of the subject-to-cooling fluid. A heat exchange is performed between a part of the subject-to-cooling fluid and a part of the refrigerant in the fourth core portion. The first collecting portion is provided at refrigerant-downstream ends of the plurality of tubes of the first core portion, and the refrigerant is collected in the first collecting portion after passing through the first core portion. The second collecting portion is provided at refrigerant-downstream ends of the plurality of tubes of the second core portion, and the refrigerant is collected in the second collecting portion after passing through the second core portion. The first distributing portion is provided at a refrigerant-upstream end of the third core portion, and the refrigerant is distributed from the first distributing portion to the plurality of tubes of the third core portion. The second distributing portion is provided at a refrigerant-upstream end of the fourth core portion, and the refrigerant is distributed from the second distributing portion to the plurality of tubes of the fourth core portion. The intermediate tank unit has a first passage through which the first collecting portion and the second distributing portion communicate with each other, and a second passage through which the second collecting portion and the first distributing portion communicate with each other. The intermediate tank unit extends along the first distributing portion. The second passage includes a throttle passage through which the refrigerant flows toward an end portion of the intermediate tank unit in an extending direction of the intermediate tank unit, and an end passage provided downstream of the throttle passage. The end passage has a cross-sectional area larger than that of the throttle passage with respect to a refrigerant flow in the throttle passage, and communicates with the first distributing portion. The first distributing portion is longer than the end passage in a flow direction of the refrigerant flowing in the throttle passage and extends adjacently to both the end passage and the throttle passage. The throttle passage is directed toward a wall surface of the end portion in the end passage in the extending direction.

Accordingly, the first distributing portion is longer than the end passage, and the first distributing portion extends so as to be adjacent to both of the end passage and the throttle passage. The first distributing portion and the end passage communicate with each other only at a portion of the first distributing portion, and the first distributing portion has a back portion separated from the communication portion. The refrigerant flowing in the throttle passage is decelerated in the end passage, reversed at a wall surface, and flows toward the back portion of the first distributing portion. Therefore, the liquid-phase refrigerant is flowed toward the back in the first distributing portion. Consequently, the distribution of the liquid-phase refrigerant in the third core unit is improved.

According to a second aspect of the present disclosure, the refrigerant evaporator further may include an enlarged portion provided between the throttle passage and the end passage, and abruptly enlarged in cross-sectional area with respect to the refrigerant flow in the throttle passage. The end passage and the first distributing portion may communicate with each other through at least one communicating portion provided in a vicinity of the enlarged portion.

According to a third aspect of the present disclosure, the communicating portion may be disposed across a region between the vicinity of the end wall surface and a vicinity of the enlarged portion. According to a fourth aspect of the present disclosure, the number of the communicating portion may be one, and the communicating portion may include an opening extending from the vicinity of the end wall surface to the vicinity of the enlarged portion. According to a fifth aspect of the present disclosure, the number of the communicating portions may be plural, and the plurality of communicating portions may be disposed across the region between the vicinity of the end wall surface and the vicinity of the enlarged portion. According to a sixth aspect of the present disclosure, the refrigerant evaporator may further include an outlet collecting portion provided at a downstream end of the plurality of tubes of the third core portion in the refrigerant flow direction, and the refrigerant may be collected in the outlet collecting portion after passing through the third core portion. The outlet collecting portion may include an outlet for the refrigerant at an end portion in the flow direction of the refrigerant flowing in the throttle passage. According to a seventh aspect of the present disclosure, a cross-sectional area of the end passage with respect to the refrigerant flow in the throttle passage may be larger than a cross sectional area of the first distributing portion with respect to the refrigerant flow in the throttle passage.

According to an eighth aspect of the present disclosure, the intermediate tank unit may include a cylindrical member and a partitioning member partitioning an internal space of the cylindrical member. The partitioning member may extend in the cylindrical member in a longitudinal direction of the cylindrical member. The end passage may be provided in the cylindrical member and located between the partitioning member and the end portion of the intermediate tank unit in the longitudinal direction. The partitioning member may extend in a radial direction of the cylindrical member to partition the inside of the cylindrical member into the first passage and a throttle passage of the second passage.

According to a ninth aspect of the present disclosure, the partitioning member may be provided inside the cylindrical member, and the partitioning member may include a partitioning wall partitioning between the first passage and the second passage. The partitioning wall may be arranged substantially parallel to a wall of the cylindrical member in the longitudinal direction of the cylindrical member.

According to a tenth aspect of the present disclosure, the refrigerant evaporator may further include a series of collecting tank units including the first collecting portion and the second collecting portion, and a series of distributing tank units including the first distributing portion and the second distributing portion. The intermediate tank unit may be arranged between the series of collecting tank units and the series of distributing tank units. The intermediate tank unit may be located to be overlapped with the series of collecting tank units and with the series of distributing tank units in the flow direction of the subject-to-cooling fluid.

According to an eleventh aspect of the present disclosure, the refrigerant evaporator may further include a first evaporator, and a second evaporator disposed upstream of the first evaporator in the flow direction of the subject-to-cooling fluid. The first evaporator may include a downstream core unit having the first core portion and the second core portion, and a pair of downstream tank units connected to both end portions of the downstream core unit to collect or distribute the refrigerant flowing in the downstream core portion. The second evaporator may include an upstream core unit having the third core portion and the fourth core portion, and a pair of upstream side tank units connected to both end portions of the upstream core unit to collect or distribute the refrigerant flowing in the upstream core unit, One of the pair of downstream tank units may include the first collecting portion and the second collecting portion, and one of the pair of upstream side tank units may include the first distributing portion and the second distributing portion.

According to a twelfth aspect of the present disclosure, heat exchange is performed between a subject-to-cooling fluid flowing outside and a refrigerant in a refrigerant evaporator. The refrigerant evaporator includes a first evaporator and a second evaporator that are arranged in a flow direction of the subject-to-cooling fluid, and a refrigerant exchanging portion coupling the first evaporator and the second evaporator. The first evaporator includes a heat exchanging core unit including a plurality of first tubes stacked and configured to allow the refrigerant to flow therein, and a pair of tank units connected to both end portions of the plurality of first tubes in a longitudinal direction of the plurality of first tubes to collect or distribute the refrigerant flowing in the plurality of first tubes. The heat exchanging core unit of the first evaporator includes a first core portion having a tube group of the plurality of first tubes, and a second core portion having the other tube group of the plurality of first tubes. The second evaporator includes a heat exchanging core unit including a plurality of second tubes stacked and configured to allow the refrigerant to flow therein, and a pair of tank units extending in a stacking direction of the plurality of second tubes, and connected to both end portions of the plurality of second tubes in a longitudinal direction to collect or distribute the refrigerant flowing in the plurality of second tubes. The heat exchanging core unit of the second evaporator includes a third core portion having a tube group of the plurality of the second tubes, and a fourth core portion having a tube group of the plurality of the second tubes. The tube group of the third core portion is opposed to at least a part of the first core portion in the flow direction of the subject-to-cooling fluid, and the tube group of the fourth core portion is opposed to at least a part of the second core portion in the flow direction of the subject-to-cooling fluid. One of the pair of the tank units of the first evaporator includes a first collecting portion in which the refrigerant is collected from the first core portion, and a second collecting portion in which the refrigerant is collected from the second core portion. One of the pair of tank units of the second evaporator includes a first distributing portion from which the refrigerant is distributed to the third core portion, a second distributing portion from which the refrigerant is distributed to the fourth core portion, and a partitioning member partitioning an inner space into the first distributing portion and the second distributing portion in the stacking direction of the second tube. The other of the pair of the tank units of the second evaporator includes a refrigerant outflow port, through which the refrigerant flows out, at one end portion in the stacking direction of the second tube. The refrigerant exchanging portion includes a first communicating portion that leads the refrigerant from the first collecting portion to the second distributing portion, and a second communicating portion that leads the refrigerant from the second collecting portion to the first distributing portion. The first communicating portion includes a first outlet port through which the refrigerant flows out to the second distributing portion. The second communicating portion includes a second outlet port through which the refrigerant flows out to the first distributing portion. The first outlet port is located at a position farther than the second outlet port from the refrigerant outflow port in the stacking direction of the second tubes. The first outlet port extends in the stacking direction of the second tube from a position in the vicinity of the partitioning member.

Accordingly, the bias of the distribution of the refrigerant in the second evaporator may be suppressed.

According to a thirteenth aspect of the present disclosure, the first communicating portion may further include a first inlet port into which the refrigerant flows from the first collecting portion. The second communicating portion may further include a second inlet port into which the refrigerant flows from the second collecting portion. The outlet port may be larger than the inlet port in opening width in the stacking direction of the plurality of tubes in at least one of the first communicating portion and the second communicating portion.

In this manner, by enlarging the opening width of the outlet port of the refrigerant at least at one of the first communicating portion and the second communicating portion that leads the refrigerant from the first evaporator to the second evaporator, an arrangement in which the respective tubes of the heat exchanging core unit of the second evaporator and an outlet port of the refrigerant at the communicating portion are close to each other may be achieved. Accordingly, the biases of the distributions of the liquid-phase refrigerant from the respective distributing portions to the heat exchanging core unit is suppressed in the second evaporator.

Therefore even when the refrigerant flow direction is exchanged in the communicating portion that couples one of the tank units of each evaporator, deterioration of the refrigerant distributing properties may be suppressed, and lowering of the cooling performance of the subject-to-cooling fluid in the refrigerant evaporator may also be suppressed.

According to a fourteenth aspect of the present disclosure, the opening width of the outlet port of at least one of the first communicating portion and the second communicating portion may be not smaller in the stacking direction than half the width of a core portion, which is the third core portion or the fourth core portion, communicating with the outlet port.

According to a fifteenth aspect of the present disclosure, an opening area of the inlet port of at least one of the first communicating portion and the second communicating portion may be smaller than the opening area of the outlet port.

In this configuration, by setting the opening area of the refrigerant inlet port of the communicating portion to be smaller than the opening area of the refrigerant outlet port of the same, the flow velocity of the refrigerant passing through the refrigerant inlet port of the communicating portion may be increased. In this configuration, a staying of the liquid-phase refrigerant or the like on the refrigerant inlet port side of the communicating portion may be suppressed, and hence the liquid-phase refrigerant passing through the first evaporator may be adequately distributed to the second evaporator.

In each of the third core portion and the fourth core portion, the refrigerant may hardly flow to part of the plurality of tubes located on the end portion side of the core portion in the stacking direction and hence the refrigerant distributing properties may be deteriorated.

According to a sixteenth aspect of the present disclosure, the first outlet port of the first communicating portion may be provided at least at a position opposed to tubes, located on one end side in the stacking direction, of the tube group of the fourth core portion. The second outlet port of the second communicating portion may be provided at least at a position opposed to tubes, located on one end side in the stacking direction, of the tube group of the third core portion.

In this configuration, the outlet ports of the refrigerant of the respective communicating portions open so as to face at least part of the plurality of tubes of the third and fourth core portions located on at least one end side in the stacking direction. Therefore, the refrigerant may flow easily to the tubes located the end portions of the third and fourth core portions in the stacking direction. Consequently, deterioration of the distributing properties of the refrigerant is effectively suppressed.

According to a seventeenth aspect of the present disclosure, the refrigerant exchanging portion may include an intermediate tank unit that communicates with the first and second collecting portions via an inlet communicating hole and communicates with the first and second distributing portions via an outlet side communicating hole. The intermediate tank unit may include therein a first refrigerant passage leading the refrigerant from the first collecting portion to the second distributing portion, and a second refrigerant passage leading the refrigerant from the second collecting portion to the first distributing portion. The first communicating portion may include the first refrigerant passage, and the second communicating portion may include the second refrigerant passage.

In this manner, if the communicating portion of the refrigerant exchanging portion has the intermediate tank portion, a configuration of exchanging the refrigerant flowing direction at the communicating portion that couples the tank units of one of the respective evaporating units is achieved in detail and easily.

According to an eighteenth aspect of the present disclosure, the refrigerant exchanging portion may include a first coupling member communicating with the first collecting portion, a second coupling member communicating with the second collecting portion, a third coupling member communicating with the first distributing portion, a fourth coupling member communicating with the second distributing portion, and an intermediate tank unit coupled to the first and second coupling members and to the third and fourth coupling members. The intermediate tank unit may include a first refrigerant passage leading the refrigerant from the first coupling member to the fourth coupling member, and a second refrigerant passage leading the refrigerant from the second coupling member to the third coupling member. The first communicating portion may include the first coupling member, the fourth coupling member and the first refrigerant passage. The second communicating portion may include the second coupling member, the third coupling member and the second refrigerant passage.

In this manner, if the communicating portion of the refrigerant exchanging portion has a pair of collecting portion coupling members, a pair of distributing portion coupling members, and the intermediate tank unit, a configuration of exchanging the refrigerant flowing direction at the communicating portion that couples the tank units of one of the respective evaporating units is achieved in detail and easily.

Since an excessively heated area in which the refrigerant (gas-phase refrigerant) gasified when passing through the first evaporator is generated in the second evaporator, the subject-to-cooling fluid cooling performance in the second evaporator tends to be lower than the subject-to-cooling fluid cooling performance in the first evaporator. In the excessively heated area, the refrigerant only absorbs sensible heat from the subject-to-cooling fluid, and hence the fluid may not be cooled sufficiently.

According to a nineteenth aspect of the present disclosure, the second evaporator may be disposed upstream of the first evaporator in the flow direction of the subject-to-cooling fluid.

In this configuration, the temperature difference between the refrigerant evaporating temperature at the respective evaporator and the temperature of the subject-to-cooling fluid may be secured to cool the subject-to-cooling fluid efficiently.

According to a twelfth aspect of the present disclosure, the width of the first outlet port is not smaller in the stacking direction of the second tube than half the width of the fourth core portion communicating with the first outlet port.

BRIEF DESCRIPTION OF THE DRAWINGS

FIG. 5(*b*) is an exploded perspective view of the intermediate tank unit of the first embodiment.

FIG. 7(*b*) is a schematic diagram illustrating a distribution of the liquid-phase refrigerant flowing in a leeward heat exchanging core unit of the refrigerant evaporator of the comparative example. FIG. 7(*c*) is a schematic diagram illustrating the distribution illustrated in FIG. 7(*a*) and the distribution illustrated in FIG. 7(*b*) combined with each other.

FIG. 8(*b*) is a schematic diagram illustrating a distribution of the liquid-phase refrigerant flowing in a leeward heat exchanging core unit of the refrigerant evaporator of the first embodiment. FIG. 8(*c*) is a schematic diagram illustrating the distribution in FIG. 8(*a*) and the distribution illustrated in FIG. 8(*b*) combined with each other.

FIG. 9(*b*) is a schematic cross-sectional view illustrating a second windward tank unit, a second leeward tank unit, and an intermediate tank unit of the refrigerant evaporator of the comparative example.

FIG. 10(*b*) is a schematic cross-sectional view illustrating a second windward tank unit, a second leeward tank unit, and an intermediate tank unit of the refrigerant evaporator of the first embodiment.

FIG. 11(*b*) is a schematic diagram of third and fourth coupling members of the refrigerant evaporator of the second embodiment when viewing in the direction indicated by an arrow Y of FIG. 1.

FIG. 13(*b*) is a cross-sectional view illustrating respective tank units according to a fourth embodiment.

FIG. 14(*b*) is an exploded view illustrating the respective tank units of the refrigerant evaporator of the fourth embodiment.

EMBODIMENTS FOR EXPLOITATION OF THE INVENTION

Figure 1:
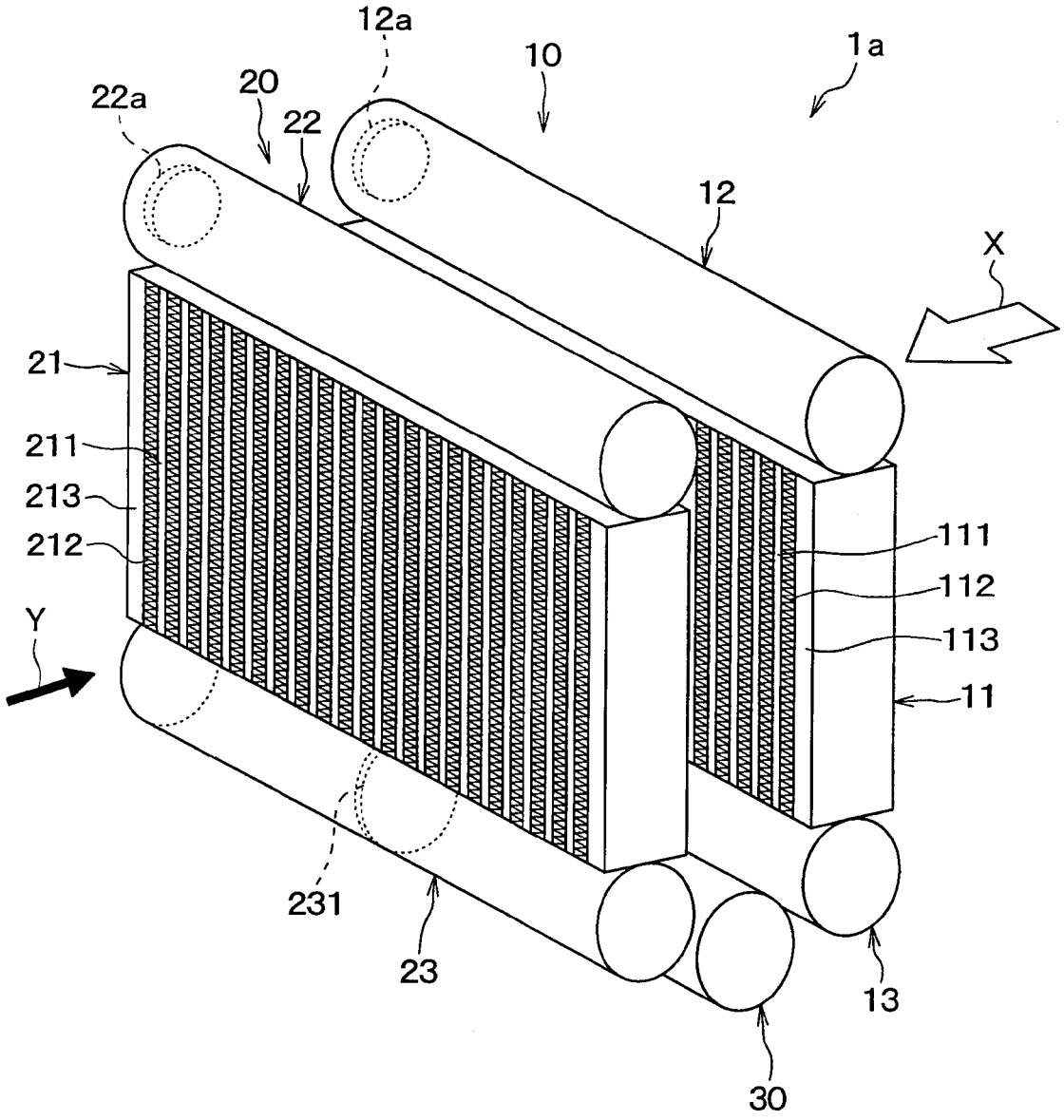
FIG. 1 is a schematic perspective view of a refrigerant evaporator according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Referring now to FIG. 1 to FIG. 10, a first embodiment of the present disclosure will be described. A refrigerant evaporator 1*a* of the present embodiment is applied to a vapor compression refrigerating cycle of a vehicle air-conditioning apparatus configured to adjust the temperature in a cabin, and is a cooling heat exchanger configured to cool blast air by absorbing heat from the blast air supplied into the cabin and evaporating refrigerant (liquid-phase refrigerant). In the present embodiment, the blast air corresponds to "a subject-to-cooling fluid flowing outside".

A refrigerating cycle includes a compressor, a heat radiator (condenser), and an expansion valve, which are not illustrated, in addition to the refrigerant evaporator 1*a*, which are well known and, in the present embodiment, is used as a receiver cycle which includes a liquid receiver arranged between the heat radiator and the expansion valve.

Figure 2:
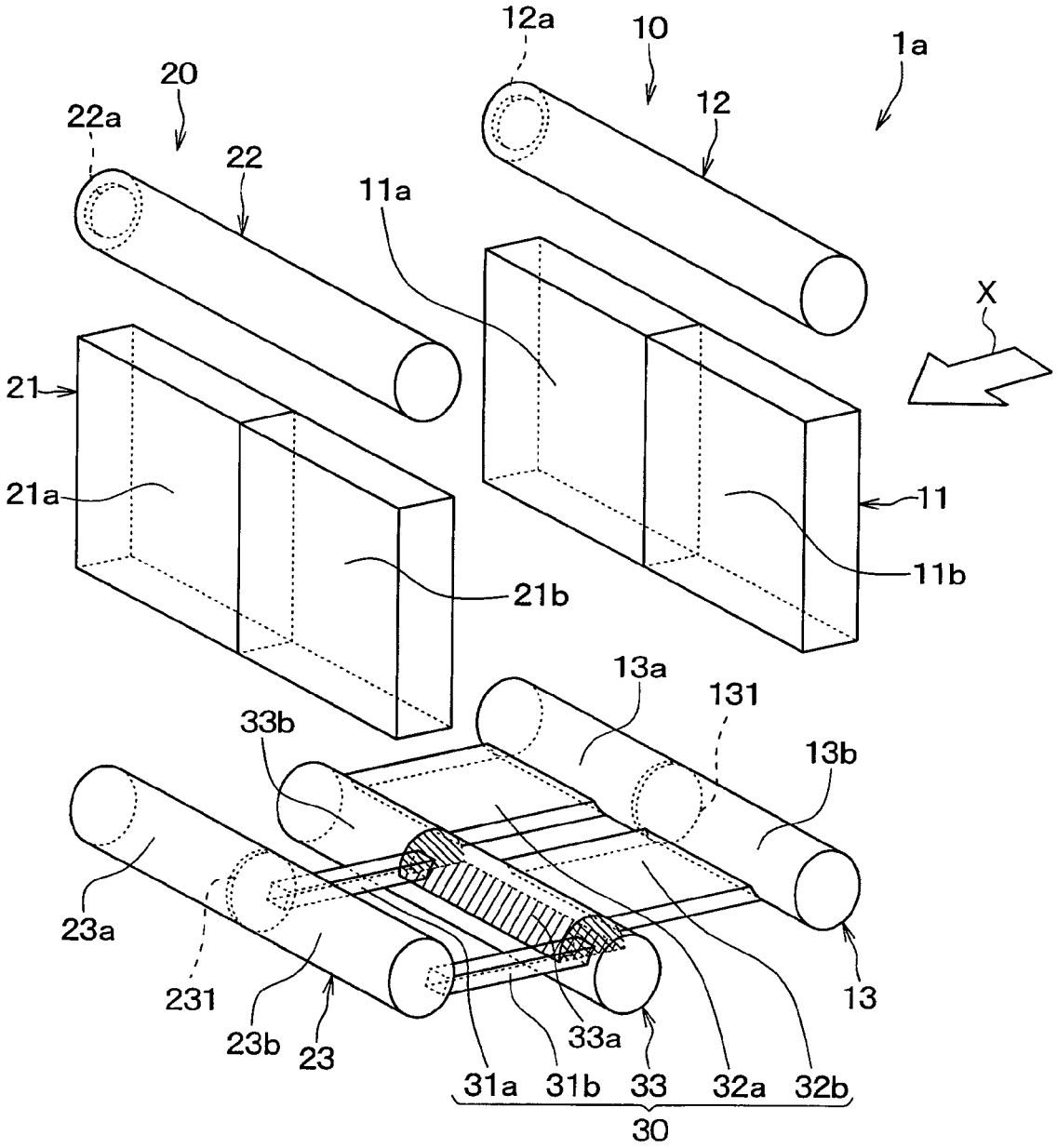
FIG. 2 is an exploded view of the refrigerant evaporator according to the first embodiment.

FIG. 1 is a schematic perspective view of the refrigerant evaporator 1*a* according to the present embodiment, and FIG. 2 is an exploded perspective view of the refrigerant evaporator 1*a* illustrating in FIG. 1. In FIG. 2, illustration of tubes 111, 211 and fins 112, 212 in respective heat exchanging core units 11, 21, described later, are omitted.

As illustrated in FIG. 1 and FIG. 2, the refrigerant evaporator 1*a* of the present embodiment includes two evaporators 10, 20 arranged in series with respect to a flowing direction of the blast air (flowing direction of a subject-to-cooling fluid) X. Here, in the present embodiment, an evaporator arranged on a windward side (upstream side) of the air flowing direction of the blast air from between the two evaporators 10, 20 is referred to as a windward evaporator 10 (second evaporator), and an evaporator arranged on a leeward side (downstream side) in the blast air flowing direction is referred to as a leeward side evaporator 20 (first evaporator).

The windward evaporator 10 and the leeward side evaporator 20 have basically the same configuration, and each includes heat exchanging core units 11, 21, and pairs of tank units 12, 13, 22, 23 arranged on both upper and lower sides of the heat exchanging core units 11, 21.

In the present embodiment, a heat exchanging core unit in the windward evaporator 10 is referred to as a windward heat exchanging core unit 11, and a heat exchanging core unit in the leeward side evaporator 20 is referred to as a leeward heat exchanging core unit 21. The tank unit arranged on the upper side from the pair of the tank units 12, 13 in the windward evaporator 10 is referred to as a first windward tank unit 12, and the tank unit arranged on the lower side is referred to as a second windward tank unit 13. In the same manner, the tank unit arranged on the upper side from the pair of the tank units 22, 23 in the leeward side evaporator 20 is referred to as a first leeward tank unit 22, and the tank unit arranged on the lower side is referred to as a second leeward tank unit 23.

The windward heat exchanging core unit 11 and the leeward heat exchanging core unit 21 of the present embodiment are each formed of a stacked body including multiple tubes 111, 211 extending in the vertical direction, and fins 112, 212 joined between the adjacent tubes 111, 211 arranged alternately. A stacking direction of the multiple tubes 111, 211 and multiple fins 112, 212 in the stacked body is referred to as a tube stacking direction.

Here, the windward heat exchanging core unit 11 includes a first windward core portion 11*a* (third core portion) having a partial tube group and a second windward core portion 11*b* (fourth core portion) having a remaining tube group from the multiple tubes 111 (second tubes).

In the present embodiment, the windward heat exchanging core unit 11 includes the first windward core portion 11*a*, which is a tube group existing on the right side in the tube stacking direction and the second windward core portion 11*b*, which is a tube group existing on the left side in the tube stacking direction when viewing the windward heat exchanging core unit 11 from a blast air flowing direction.

The leeward heat exchanging core unit 21 includes a first leeward core portion 21*a* (first core portion) having a partial tube group and a second leeward core portion 21*b* (second core portion) having a remaining tube group from the multiple tubes 211 (first tubes).

In the present embodiment, the leeward heat exchanging core unit 21 includes the first leeward core portion 21*a* in the tube group existing on the right side in the tube stacking direction and the second leeward core portion 21*b* in the tube group existing on the left side in the tube stacking direction when viewing the leeward heat exchanging core unit 21 from the blast air flowing direction. In the present embodiment, the first windward core portion 11*a* and the first leeward core portion 21*a* are arranged so as to be superimposed (oppose) each other, and the second windward core portion 11*b* and the second leeward core portion 21*b* are arranged so as to be superimposed (oppose) with each other.

A flat tube having a refrigerant flow channel for allowing the refrigerant to flow therein in the interior thereof and configured to become flat shape extending along the blast air flowing direction in cross section are used as each of the tubes 111, 211.

The tube 111 of the windward heat exchanging core unit 11 is connected at one end side (upper end side) in the longitudinal direction thereof to the first windward tank unit 12, and is connected at the other end side (lower end side) in the longitudinal direction to the second windward tank unit 13. The tube 211 of the leeward heat exchanging core unit 21 is connected at one end side (upper end side) in the longitudinal direction to the first leeward tank unit 22, and is connected at the other end side (lower end side) in the longitudinal direction to the second leeward tank unit 23.

The fins 112, 212 are corrugate fins formed by bending a thin plate material into a corrugated shape, are joined to flat outer surface sides of the tubes 111, 211, and are used as thermal exchange accelerating means for enlarging a heat transfer surface area between the blast air and the refrigerant.

The stacked bodies of the tubes 111, 211 and the fins 112, 212 is provided with side plates 113, 213 configured to reinforce the respective heat exchanging core units 11, 21 arranged on both end portions in the tube stacking direction. The side plates 113, 213 are joined to the fins 112, 212 arranged on the outermost side in the tube stacking direction.

The first windward tank unit 12 includes a cylindrical member which is closed on one end side (the left side end portion when viewing in the blast air flowing direction) and having a refrigerant outflow port 12*a* for outflowing of the refrigerant from inside the tank on the other end side (the right side end portion when viewing in the blast air flowing direction) to an inlet side of a compressor (illustration is omitted). The first windward tank unit 12 is provided with through holes (illustration is omitted) which allow insertion and joint of one end side (upper end side) of the respective tubes 111 thereto on a bottom portion thereof. In other words, the internal space of the first windward tank unit 12 communicates with the respective tubes 111 of the windward heat exchanging core unit 11, so that the first windward tank unit 12 functions as a refrigerant collecting portion for collecting the refrigerant from the respective core portions 11*a*, 11*b* of the windward heat exchanging core unit 11.

The first leeward tank unit 22 includes a cylindrical member closed on one end side thereof, and is provided with a refrigerant introducing port 22*a* for introducing a low-pressure refrigerant decompressed by an expansion valve (illustration is omitted) into the tank on the other end side thereof. The first leeward tank unit 22 is provided with through holes (illustration is omitted) which allow insertion and joint of one end side (upper end side) of the respective tubes 211 on a bottom portion thereof. In other words, the internal space of the first leeward tank unit 22 communicates with the respective tubes 211 of the leeward heat exchanging core unit 21, and the first leeward tank unit 22 functions as a distributing portion that distributes the refrigerant to the respective core portions 21*a*, 21*b* of the leeward heat exchanging core unit 21.

The second windward tank unit 13 includes a cylindrical member closed on both end sides. The second windward tank unit 13 is provided with through holes (illustration is omitted) that allow insertion and joint of the other end side (lower end side) of the respective tubes 111 on a ceiling portion thereof. In other words, the internal space of the second windward tank unit 13 communicates with the respective tubes 111.

A partitioning member 131 is arranged in the second windward tank unit 13 at a center position in the longitudinal direction. The internal space of the tank is partitioned by the partitioning member 131 into a space with which the respective tubes 111 of the first windward core portion 11*a* communicate and a space with which the respective tubes 111 of the second windward core portion 11*b* communicate.

Here, part of a space inside the second windward tank unit 13 which communicates with the respective tubes 111 of the first windward core portion 11*a* is used as a first distributing portion 13*a* that distributes the refrigerant to the first windward core portion 11*a*, and part of the space therein which communicates with the tubes 111 of the second windward core portion 11*b* is used as a second distributing portion 13*b* that distributes the refrigerant to the second windward core portion 11*b*.

A second leeward tank unit 23 includes a cylindrical member closed at both ends. The second leeward tank unit 23 is provided with through holes (illustration is omitted) which allow insertion and joint of the other end side (lower end side) of the respective tubes 211 on a ceiling portion thereof. In other words, the internal space of the second leeward tank unit 23 communicates with the respective tubes 211.

A partitioning member 231 is arranged inside the second leeward tank unit 23 at a center position in the longitudinal direction, and the internal space of the tank is partitioned by the partitioning member 231 into a space with which the respective tubes 211 of the first leeward core portion 21*a* communicate and a space with which the respective tubes 211 of the second leeward core portion 21*b* communicate.

Here, part of the space inside the second leeward tank unit 23 with which the respective tubes 211 of the first leeward core portion 21*a* communicate is used as a first collecting portion 23*a* that collects the refrigerant from the first leeward core portion 21*a*, and part of the space therein with which the respective tubes 211 of the second leeward core portion 21*b* communicate is used as a second collecting portion 23*b* that collects the refrigerant from the second leeward core portion 21*b*.

The second windward tank unit 13 and the second leeward tank unit 23 are coupled respectively via a refrigerant exchanging portion 30. The refrigerant exchanging portion 30 is configured to lead the refrigerant in the first collecting portion 23*a* of the second leeward tank unit 23 to the second distributing portion 13*b* of the second windward tank unit 13, and also lead the refrigerant in the second collecting portion 23*b* of the second leeward tank unit 23 to the first distributing portion 13*a* of the second windward tank unit 13. In other words, the refrigerant exchanging portion 30 is configured to switch the flow of the refrigerant in the direction of the width of the core in the windward heat exchanging core units 11, 21.

Specifically, the refrigerant exchanging portion 30 includes a pair of collecting portion coupling members 31*a*, 31*b* coupled to the first and second collecting portions 23*a*, 23*b* in the second leeward tank unit 23, a pair of distributing portion coupling members 32*a*, 32*b* coupled to the respective distributing portions 13*a*, 13*b* in the second windward tank unit 13, and an intermediate tank unit 33 coupled respectively to the pair of the collecting portion coupling members 31*a*, 31*b* and the pair of the distributing portion coupling members 32*a*, 32*b*.

The pair of collecting portion coupling members 31*a*, 31*b* each includes a cylindrical member having a refrigerant passage which allows the refrigerant to flow therein, and one end side thereof is connected to the second leeward tank unit 23 and the other end side is connected to the intermediate tank unit 33.

One of the pair of the collecting portion coupling members 31*a*, 31*b* corresponds to a first coupling member 31*a* (first collecting portion coupling member). The first coupling member 31*a* is connected to the second leeward tank unit 23 so as to communicate at one end thereof with the first collecting portion 23*a*, and at the other end thereof with the intermediate tank unit 33 so as to communicate with a first refrigerant passage 33*a* in the intermediate tank unit 33, described later.

The other one of the pair of the collecting portion coupling members 31*a*, 31*b* corresponds to the second coupling member 31*b* (second collecting portion coupling member). The second coupling member 31*b* is connected at one end thereof with the second leeward tank unit 23 so as to communicate with the second collecting portion 23*b*, and at the other end thereof with the intermediate tank unit 33 so as to communicate with a second refrigerant passage 33*b* in the intermediate tank unit 33, described later.

In the present embodiment, one end side of the first coupling member 31*a* is connected to the first collecting portion 23*a* at a position close to the partitioning member 231, and one end side of the second coupling member 31*b* is connected to the second collecting portion 23*b* at a position close to a closed end of the second leeward tank unit 23.

The pair of the distributing portion coupling members 32*a*, 32*b* each includes a cylindrical member provided with the refrigerant flow channel in which the refrigerant flows, and is connected at one end thereof to the second windward tank unit 13 and at the other end thereof to the intermediate tank unit 33.

One of the pair of the distributing portion coupling members 32*a*, 32*b* corresponds to a third coupling portion 32*a* (first distributing portion coupling member). The third coupling member 32*a* is connected at one end thereof to the second windward tank unit 13 so as to communicate with the first distributing portion 13*a*, and at the other end thereof to the intermediate tank unit 33 so as to communicate with the second refrigerant passage 33*b* in the intermediate tank unit 33, described later. In other words, the third coupling member 32*a* communicates with the second coupling member 31*b* described above via the second refrigerant passage 33*b* of the intermediate tank unit 33.

The other one of the pair of the distributing portion coupling members 32*a*, 32*b* corresponds to a fourth coupling member 32*b* (second distributing portion coupling member). The fourth coupling member 32*b* is connected at one end thereof to the second windward tank unit 13 so as to communicate with the second distributing portion 13*b* and at the other end thereof to the intermediate tank unit 33 so as to communicate with the first refrigerant passage 33*a* in the intermediate tank unit 33, described later. In other words, the fourth coupling member 32*b* communicates with the first coupling member 31*a* described above via the first refrigerant passage 33*a* of the intermediate tank unit 33.

In the present embodiment, one end side of the third coupling member 32*a* is connected to the first distributing portion 13*a* at a position close to the closed end of the second windward tank unit 13, and one end side of the fourth coupling member 32*b* is connected to the second distributing portion 13*b* at a position close to the partitioning member 131.

The pair of the collecting portion coupling members 31*a*, 31*b* are each used as an example of an inlet port of the refrigerant at the refrigerant exchanging portion 30, and the pair of the distributing portion coupling members 32*a*, 32*b* are each used as an example of an outlet port of the refrigerant at the refrigerant exchanging portion 30.

Figure 3A:
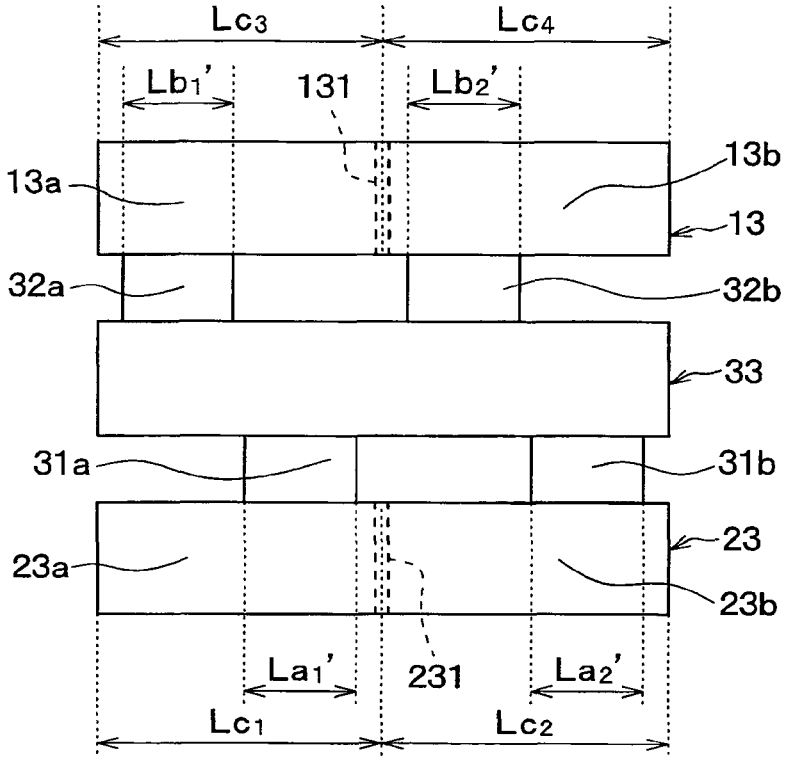
FIG. 3A is a schematic diagram of a refrigerant exchanging portion of the refrigerant evaporator viewed from a lower side, according to a comparative example.

First of all, as illustrated in FIG. 3A, in the third and fourth coupling members 32*a*, 32*b* of the refrigerant evaporator 1*a* of the comparative example, opening widths $Lb_1'$, $Lb_2'$ in a tube stacking direction have the same dimension as opening widths $La_1'$, $La_2'$ of the first and second coupling members 31*a*, 31*b* respectively in the tube stacking direction ($La_1'=La_2'=Lb_1'=Lb_2'$).

Figure 3B:
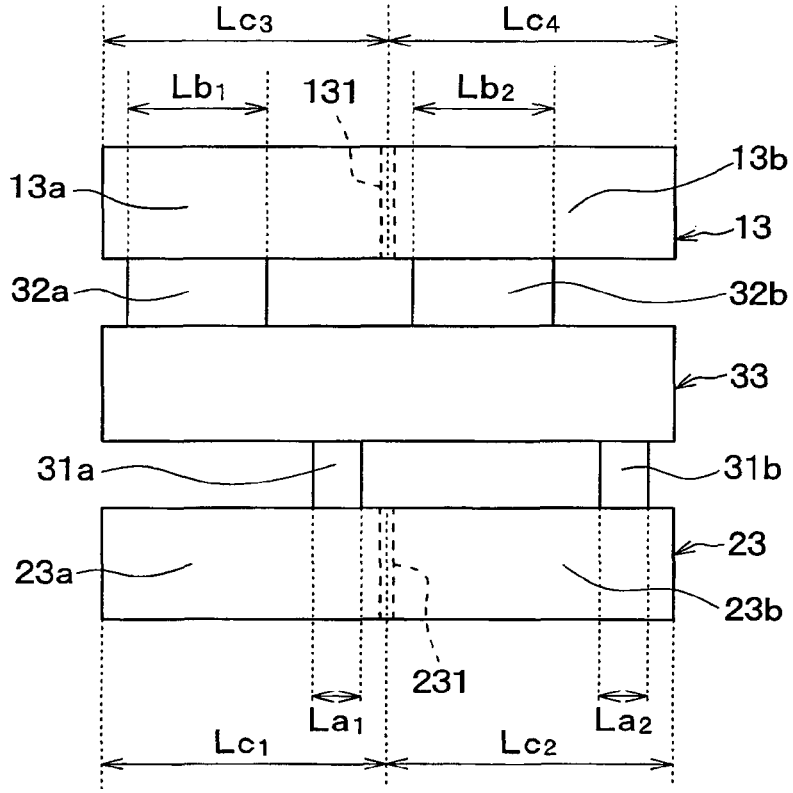
FIG. 3B is a schematic diagram of a refrigerant exchanging portion of the refrigerant evaporator viewed from the lower side according to the first embodiment.

In contrast, as illustrated in FIG. 3B, in the third and fourth coupling members 32*a*, 32*b* of the present embodiment, opening widths $Lb_1$, $Lb_2$ in a tube stacking direction are larger than opening widths $La_1$, $La_2$ of the first and second coupling members 31*a*, 31*b* respectively in the tube stacking direction. In other words, the opening width $Lb_1$ of the third coupling member 32*a* in the tube stacking direction is larger than the opening width $La_1$ of the first coupling member 31*a* in the tube stacking direction ($Lb_1>La_1$), and the opening width $Lb_2$ of the fourth coupling member 32*b* in the tube stacking direction is larger than the opening width $La_2$ of the second coupling member 31*b* in the tube stacking direction ($Lb_2>La_2$). In the present embodiment, $La_1=La_2<La_1'=La_2'$, $Lb_1=Lb_2>Lb_1'=Lb_2'$ is satisfied.

Specifically, the opening widths $Lb_1$, $Lb_2$ of the third and fourth coupling members 32*a*, 32*b* in the tube stacking direction of the present embodiment are not smaller than half the core widths (the width in the tube stacking direction) $Lc_3$, $Lc_4$ of the respective core portions 11*a* and 11*b* of the windward heat exchanging core unit 11 on the coupled side. In other words, the opening width $Lb_1$ of the third coupling member 32*a* in the tube stacking direction is not smaller than half the core width $Lc_3$ of the first windward core portion 11*a* ($Lb_1 \geq Lc_3/2$). The opening width $Lb_2$ of the fourth coupling member 32*b* in the tube stacking direction is not smaller than half the core width $Lc_4$ of the second windward core portion 11*b* ($Lb_2 \geq Lc_4/2$).

In contrast, the opening widths $La_1$, $La_2$ of the first and second coupling members 31*a*, 31*b* in the tube stacking direction is smaller than half the core widths (the width in the tube stacking direction) $Lc_1$, $Lc_2$ of the respective core portions 21*a* and 21*b* of the leeward heat exchanging core unit 21 on the coupled side. In other words, the opening width $La_1$ of the first coupling member 31*a* in the tube stacking direction is smaller than half the core width $Lc_1$ of the first leeward core portion 21*a* ($La_1<Lc_1/2$), and the opening width $La_2$ of the second coupling member 31*b* in the tube stacking direction is smaller than half the core width $Lc_2$ of the second leeward core portion 21*b* ($La_2<Lc_2/2$). In the present embodiment, $Lc_1=Lc_2=Lc_3=Lc_4$ is satisfied.

In addition, the cross-sectional areas of the first and second coupling members 31*a*, 31*b* of the present embodiment (the cross sectional area of the inlet port of the refrigerant at the refrigerant exchanging portion 30) are smaller than the cross-sectional areas of the third and fourth coupling members 32*a*, 32*b* (the outlet port of the refrigerant at the refrigerant exchanging portion 30).

Here, in the core portions 11*a*, 11*b* of the windward heat exchanging core unit 11, the refrigerant hardly flows to tubes located at the end portion side in the stacking direction from among the multiple tubes 111 of the core portions 11*a*, 11*b*, and hence the core portions 11*a*, 11*b* have a tendency of poor refrigerant distributing properties.

Specifically, in the first windward core portion 11*a*, the refrigerant has a tendency to hardly flow to the tubes 111 located near the closed end portion of the first distributing portion 13*a* of the second windward tank unit 13 and the tubes 111 located near the partitioning member 131. In the second windward core portion 11*b*, the refrigerant has a tendency to hardly flow to the tubes 111 located near the closed end portion of the second distributing portion 13*b* of the second windward tank unit 13 and the tubes 111 located near the partitioning member 131.

In the present embodiment, the third and fourth coupling members 32*a*, 32*b* open so as to oppose the tubes located on one end side in the stacking direction from among the multiple tubes 111 of the first windward core portion 11*a*.

Figure 4:
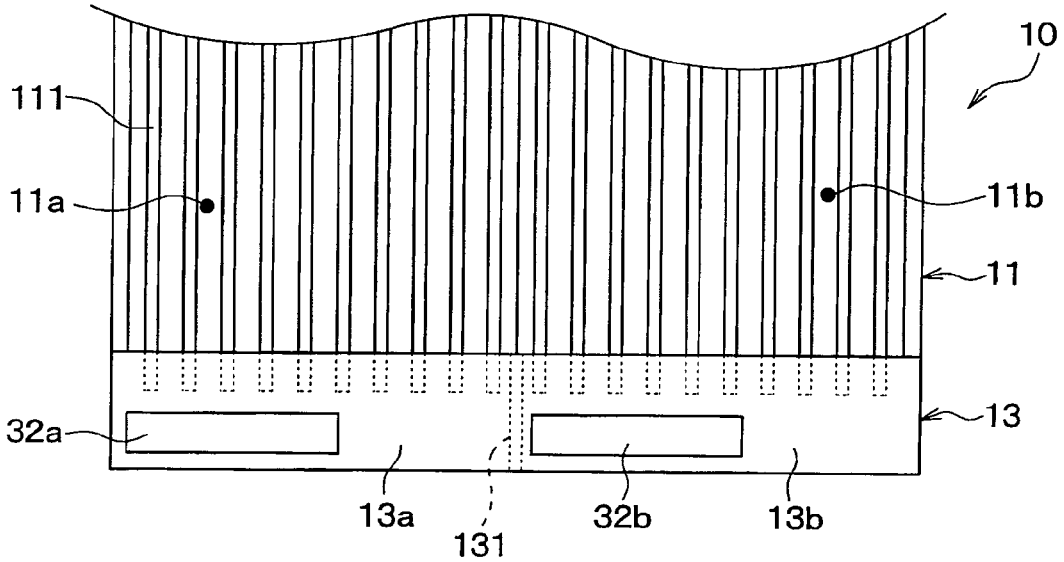
FIG. 4 is a schematic diagram illustrating a positional relationship between third and fourth coupling members and multiple tubes of respective core portions of a windward heat exchanging core unit according to the first embodiment.

Specifically, as illustrated in FIG. 4, the third coupling member 32*a* is connected to the first distributing portion 13*a* at a position close to the closed end of the second windward tank unit 13 so that the opening thereof opens to oppose the tubes located on one end side in the stacking direction from among the multiple tubes 111 of the first windward core portion 11*a*. In contrast, the fourth coupling member 32*b* is connected to the second distributing portion 13*b* at a position close to the partitioning member 131 so that the opening thereof opens to oppose the tubes located on one end side in the stacking direction from among the multiple tubes 111 of the second windward core portion 11*b*. FIG. 4 is an explanatory drawing for explaining a positional relationship between the multiple tubes 111 of the core portions 11*a* and 11*b* of the windward heat exchanging core unit 11 and the third and fourth coupling members 32*a*, 32*b* according to the present embodiment.

The intermediate tank unit 33 includes a cylindrical member closed at both end sides thereof. The intermediate tank unit 33 is arranged between the second windward tank unit 13 and the second leeward tank unit 23. Specifically, the intermediate tank unit 33 of the present embodiment is arranged so that one part (the upper portion) thereof is overlapped with the second windward tank unit 13 and the second leeward tank unit 23, and the other part (the lower portion) is not overlapped with the second windward tank unit 13 and the second leeward tank unit 23 when viewing in a blast air flowing direction X.

In this manner, a proximity arrangement of the windward evaporator 10 and the leeward side evaporator 20 is achieved in the blast air flowing direction X by arranging the intermediate tank unit 33 so that one part is not overlapped with the second windward tank unit 13 and the second leeward tank unit 23, so that an increase in physical size of the refrigerant evaporator 1*a* caused by the provision of the intermediate tank unit 33 is suppressed.

Figure 5:
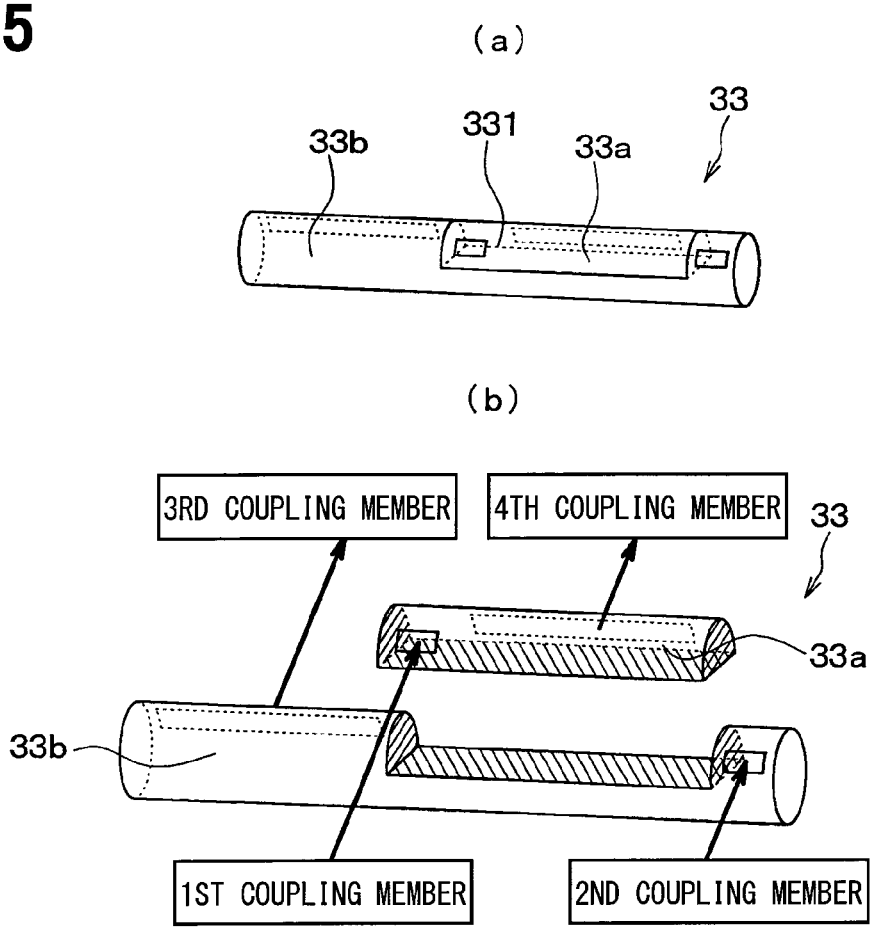
FIG. 5(*a*) is a schematic perspective view of an intermediate tank unit according to the first embodiment.

As illustrated in FIG. 5, a partitioning member 331 is arranged inside the intermediate tank unit 33 at a portion located on the upper side, and the partitioning member 331 partitions the space in the tank into the first refrigerant passage 33*a* and the second refrigerant passage 33*b*.

The first refrigerant passage 33*a* is used as a refrigerant flow channel for leading the refrigerant from the first coupling member 31*a* to the fourth coupling member 32*b*. In contrast, the second refrigerant passage 33*b* is used as a refrigerant flow channel for leading the refrigerant from the second coupling member 31*b* to the third coupling member 32*a*.

In the present embodiment, the first coupling member 31*a*, the fourth coupling member 32*b*, and the first refrigerant passage 33*a* of the intermediate tank unit 33 may be used as an example of the first communicating portion that leads the refrigerant in the first collecting portion 23*a* to the second distributing portion 13*b*. The first coupling member 31*a* may be used as an inlet port of the first communicating portion, and the fourth coupling member 32*b* may be used as the first outlet port of the first communicating portion.

The second coupling member 31*b*, the third coupling member 32*a*, and the second refrigerant passage 33*b* of the intermediate tank unit 33 may be used as an example of the second communicating portion that leads the refrigerant in the second collecting portion 23*b* to the first distributing portion 13*a*. The second coupling member 31*b* may be used as an inlet port of the second communicating portion, and the third coupling member 32*a* may be used as the second outlet port of the second communicating portion.

Figure 6:
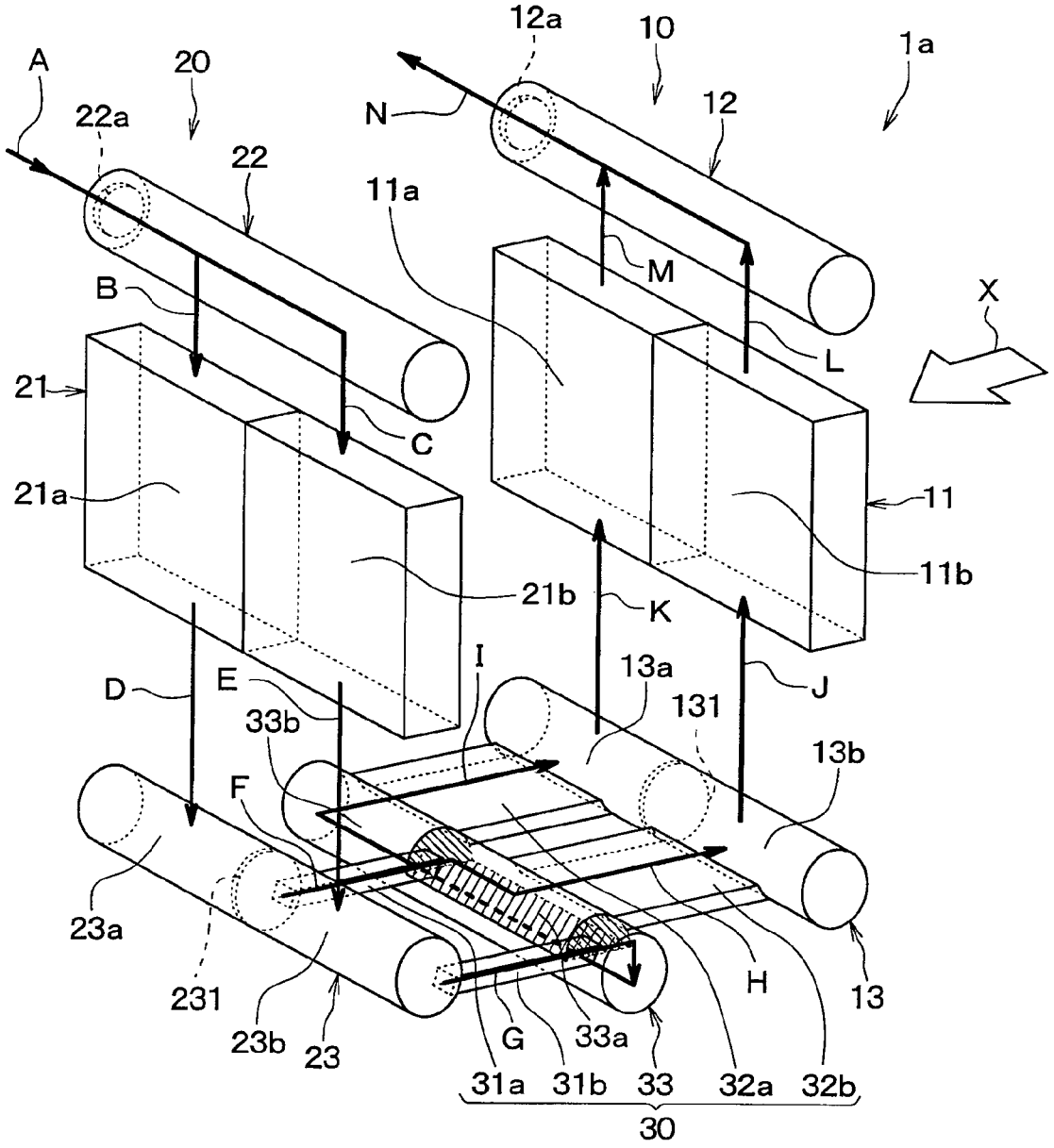
FIG. 6 is a schematic diagram illustrating a flow of refrigerant in the refrigerant evaporator according to the first embodiment.

Subsequently, a flow of the refrigerant in the refrigerant evaporator 1*a* of the present embodiment will be described with reference to FIG. 6. FIG. 6 is an explanatory drawing for explaining the flow of the refrigerant in the refrigerant evaporator 1*a* of the present embodiment.

As illustrated in FIG. 6, the low-pressure refrigerant decompressed by the expansion valve (illustration is omitted) is introduced from the refrigerant introducing port 22*a* provided on one end side of the first leeward tank unit 22 into the tank as indicated by an arrow A. The refrigerant introduced into the first leeward tank unit 22 flow downward in the first leeward core portion 21*a* of the leeward heat exchanging core unit 21 as indicated by an arrow B and flow downward in the second leeward core portion 21*b* of the leeward heat exchanging core unit 21 as indicated by an arrow C.

The refrigerant flowed downward through the first leeward core portion 21*a* flows into the first collecting portion 23*a* of the second leeward tank unit 23 as indicated by an arrow D. In contrast, the refrigerant flowed downward through the second leeward core portion 21*b* flows into the second collecting portion 23*b* of the second leeward tank unit 23 as indicated by an arrow E.

The refrigerant flowing into the first collecting portion 23*a* flows into the first refrigerant passage 33*a* of the intermediate tank unit 33 via the first coupling member 31*a* as indicated by an arrow F. The refrigerant flowing into the second collecting portion 23*b* flows into the second refrigerant passage 33*b* of the intermediate tank unit 33 via the second coupling member 31*b* as indicated by an arrow G.

The refrigerant flowing into the first refrigerant passage 33*a* flows into the second distributing portion 13*b* of the second windward tank unit 13 via the fourth coupling member 32*b* as indicated by an arrow H. The refrigerant flowing into the second refrigerant passage 33*b* flows into the first distributing portion 13*a* of the second windward tank unit 13 via the third coupling member 32*a* as indicated by an arrow I.

The refrigerant flowing into the second distributing portion 13*b* of the second windward tank unit 13 flows upward in the second windward core portion 11*b* of the windward heat exchanging core unit 11 as indicated by an arrow J. In contrast, the refrigerant flowing into the first distributing portion 13*a* flows upward in the first windward core portion 11*a* of the windward heat exchanging core unit 11 as indicated by an arrow K.

The refrigerant flowed upward in the second windward core portion 11*b* and the refrigerant flowed upward in the first windward core portion 11*a* respectively flows into the tank of the first windward tank unit 12 as indicated by arrows L, M, and is delivered out from the refrigerant outflow port 12*a* provided on one end side of the first windward tank unit 12 to an air inlet side of the compressor (illustration is omitted) as indicated by an arrow N.

In the refrigerant evaporator 1*a* according to the present invention described thus far, the opening widths of the third and fourth coupling members 32*a*, 32*b* extending in the tube stacking direction, which are used as examples of the outlet ports of the refrigerant in the respective communicating portions of the refrigerant exchanging portion 30, are larger than the opening widths of the first and second coupling members 31*a*, 31*b* extending in the tube stacking direction, which are used as an example of the inlet ports of the refrigerant in the respective communicating portions in the refrigerant exchanging portion 30 (see FIG. 3B).

Therefore, in the distributing portions 13*a*, 13*b* of the second windward tank unit 13, connecting portions between the tubes 111 of the core portions 11*a*, 11*b* of the windward heat exchanging core unit 11 and the second windward tank unit 13 at the third and fourth coupling members 32*a*, 32*b* may be arranged close to each other in the tube stacking direction, respectively.

Accordingly, the biases of the distributions of the liquid-phase refrigerant from the distributing portions 13*a*, 13*b* of the second windward tank unit 13 respectively to the core portions 11*a*, 11*b* of the windward heat exchanging core unit 11 in the windward evaporator 10 may be suppressed. Consequently, lowing of the cooling performance of the blast air in the refrigerant evaporator 1*a* may be suppressed.

Figure 7:
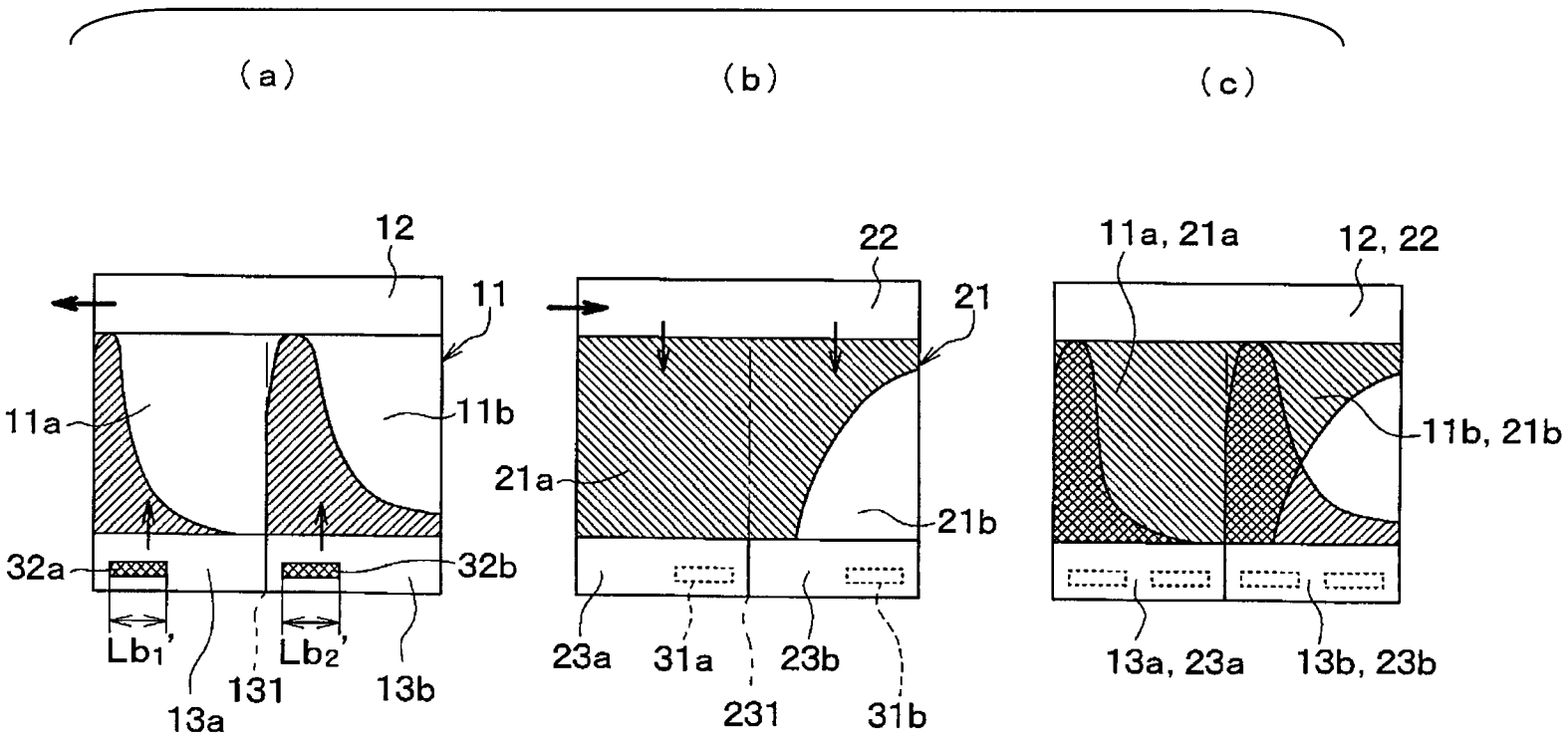
FIG. 7(*a*) is a schematic diagram illustrating a distribution of liquid-phase refrigerant flowing in a windward heat exchanging core unit of the refrigerant evaporator of the comparative example.
Figure 8:
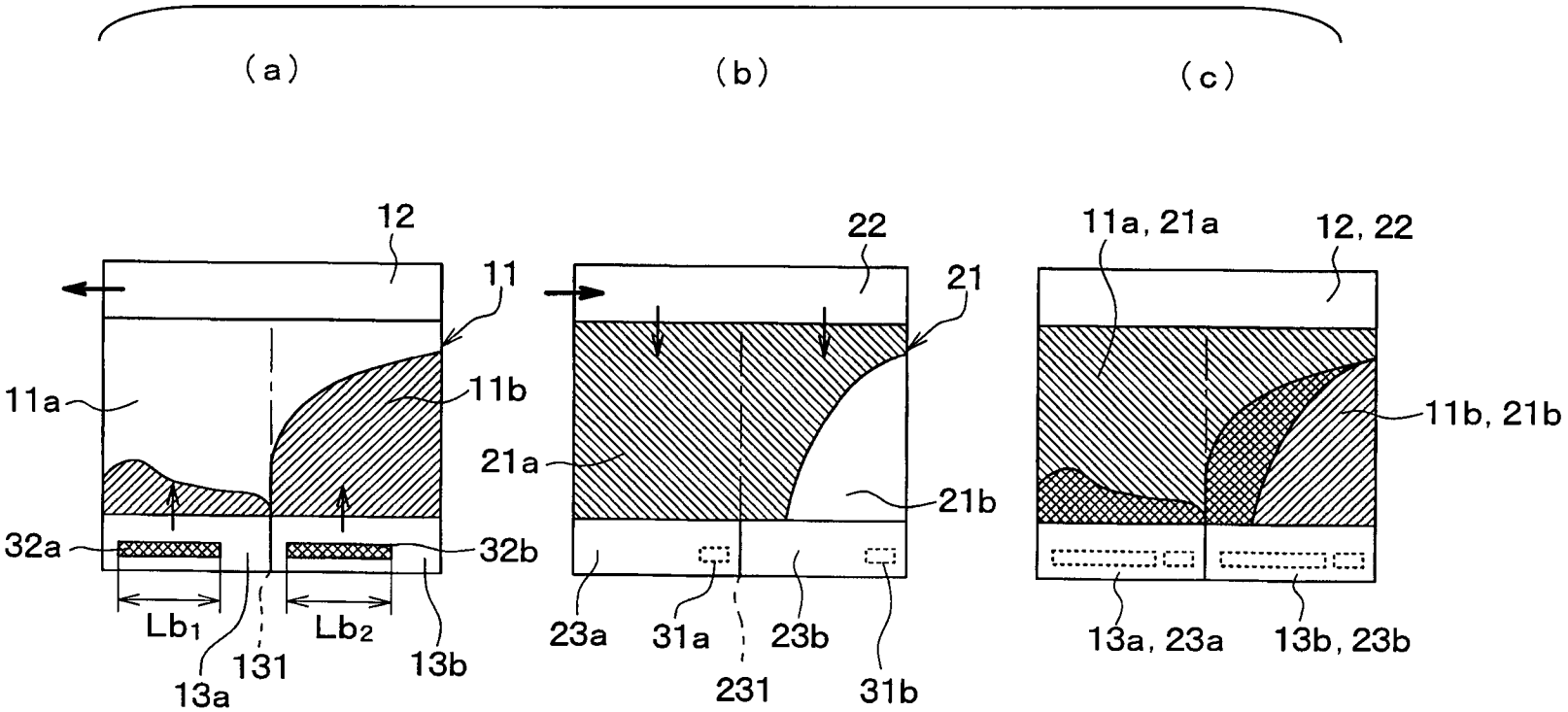
FIG. 8(*a*) is a schematic diagram illustrating a distribution of the liquid-phase refrigerant flowing in a windward heat exchanging core unit of the refrigerant evaporator according to the first embodiment.

FIGS. 7(*a*) to 7(*c*) are explanatory drawings for explaining a distribution of the liquid-phase refrigerant flowing in the respective heat exchanging core units 11 and 21 of the refrigerant evaporator 1*a* (the refrigerant evaporator provided with the refrigerant exchanging portion 30 illustrated in FIG. 3A) according to the comparative example, FIGS. 8(*a*) to 8(*c*) are explanatory drawings for explaining the distribution of the liquid-phase refrigerant flowing in the respective heat exchanging core units 11, 21 of the refrigerant evaporator 1*a* according to the present embodiment. FIG. 7 and FIG. 8 illustrate the distribution of the liquid-phase refrigerant when viewing the refrigerant evaporator 1*a* in the direction indicated by an arrow Y in FIG. 1 (a direction opposite to the blast air flowing direction X), and hatched portions in the drawings represent portions where the liquid-phase refrigerant exists.

The distribution of the liquid-phase refrigerant flowing in the leeward heat exchanging core unit 21 in the refrigerant evaporator 1*a* as illustrated in FIG. 7(*b*) and FIG. 8(*b*) according to the comparative example is the same as that in the refrigerant evaporator 1*a* of the present embodiment, and portions where the liquid-phase refrigerant can hardly flow are generated in part of the second leeward core portion 21*b* (hollow portion on the lower right side in the drawing).

In contrast, as illustrated in FIG. 7(*a*), the distribution of the liquid-phase refrigerant flowing in the windward heat exchanging core unit 11 of the refrigerant evaporator 1*a* according to the comparative example is such that the liquid-phase refrigerant can easily flow toward the side where the third and fourth coupling members 32*a*, 32*b* are provided and the liquid-phase refrigerant can hardly flow toward the side where the third and fourth coupling members 32*a*, 32*b* are not provided in the tube stacking direction in the respective windward core portions 11*a*, 11*b* of the windward heat exchanging core unit 11.

As illustrated in FIG. 7(*c*), when viewing the refrigerant evaporator 1*a* according to the comparative example from the blast air flowing direction X, a portion (hollow portion in the right side of the drawing) where the liquid-phase refrigerant can hardly flow is generated in part of the overlapped portions of the second windward core portion 11*b* and the second leeward core portion 21*b*.

In this manner, in the refrigerant evaporator 1*a* according to the comparative example in which the liquid-phase refrigerant is distributed, the refrigerant only absorbs sensible heat from the blast air at the position where the liquid-phase refrigerant can hardly flow, and the blast air cannot be cooled sufficiently. Consequently, a temperature distribution is generated in the blast air passing through the refrigerant evaporator 1*a*.

In contrast, as regards the distribution of the liquid-phase refrigerant flowing in the windward heat exchanging core unit 11 in the refrigerant evaporator 1*a* according to the present embodiment, since the opening widths of the third and fourth coupling members 32*a*, 32*b* in the tube stacking direction are enlarged, as illustrated in FIG. 8(*a*) the liquid-phase refrigerant can easily flow evenly in the tube stacking direction in the respective windward core portions 11*a*, 11*b* of the windward heat exchanging core unit 11. In other words, in the refrigerant evaporator 1*a* according to the present embodiment, the biases of the distributions of the liquid-phase refrigerant to the core portions 11*a*, 11*b* of the windward heat exchanging core unit 11 may be suppressed.

As illustrated in FIG. 8(*c*), when viewing the refrigerant evaporator 1*a* according to the present embodiment in the blast air flowing direction X, the liquid-phase refrigerant flows over the entire overlapped portions of the second windward core portion 11*b* and the second leeward core portion 21*b*.

In this manner, in the refrigerant evaporator 1*a* according to the present embodiment in which the liquid-phase refrigerant is distributed, the refrigerant absorbs sensible heat and latent heat from the blast air by either one of the windward heat exchanging core units 11, 21, sufficient cooling of the blast air is enabled. Consequently, generation of the temperature distribution in the blast air passing through the refrigerant evaporator 1*a* is suppressed.

In particular, in the present embodiment, the opening widths of the third and fourth coupling members 32*a*, 32*b* in the tube stacking direction are not smaller than half the core widths (the width in the tube stacking direction) of the respective core portions 11*a*, 11*b* of the windward heat exchanging core unit 11 on the coupled side.

Accordingly, the biases of the distributions of the refrigerant from the distributing portions 13*a*, 13*b* of the second windward tank unit 13 to the core portions 11*a*, 11*b* of the windward heat exchanging core unit 11 in the windward evaporator 10 may be sufficiently suppressed.

Figure 9:
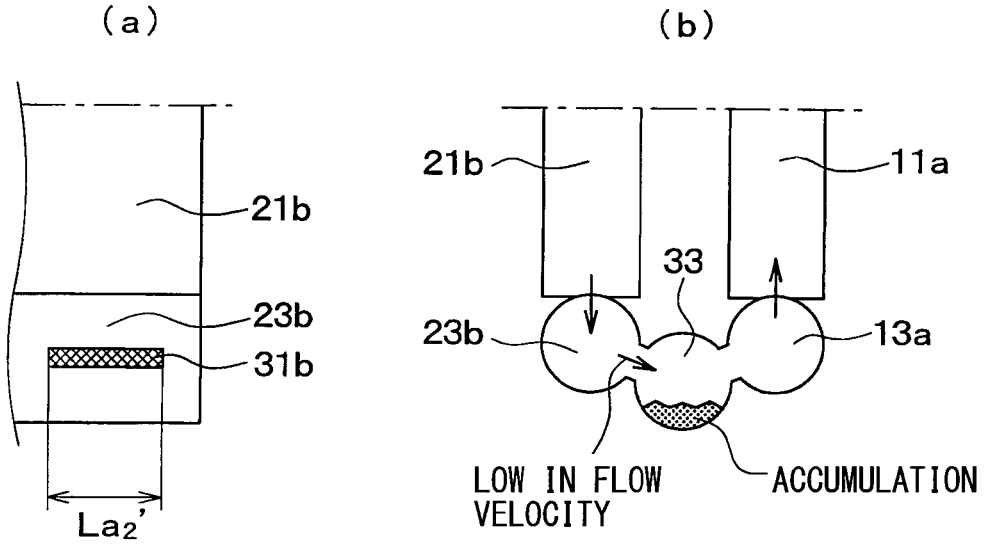
FIG. 9(*a*) is a schematic partial front view illustrating part of the leeward heat exchanging core unit of the refrigerant evaporator according to a comparative example.
Figure 10:
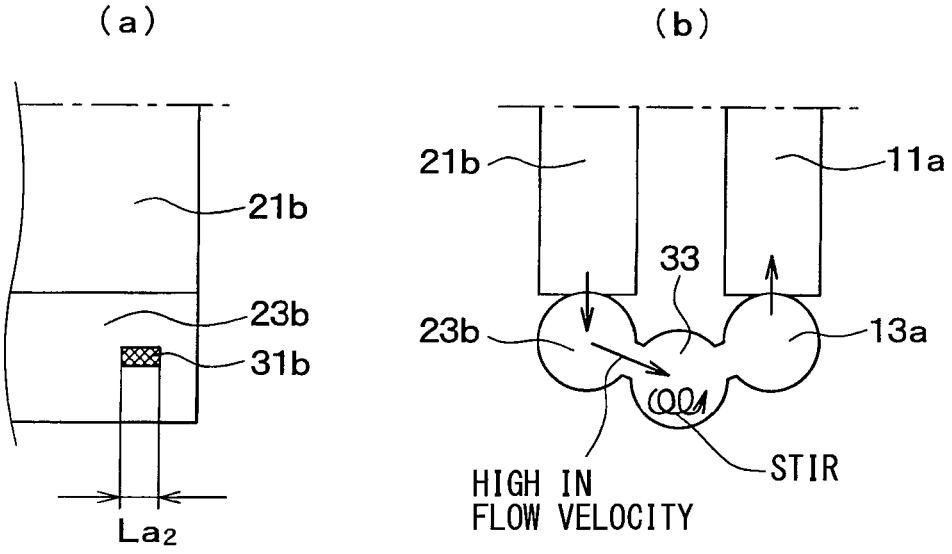
FIG. 10(*a*) is a schematic partial front view illustrating part of the leeward heat exchanging core unit of the refrigerant evaporator according to the first embodiment.

FIG. 9 is an explanatory drawing for explaining the refrigerant flowing in the intermediate tank unit 33 of the refrigerant evaporator 1*a* (the refrigerant evaporator provided with the refrigerant exchanging portion 30 illustrated in FIG. 3A) according to the comparative example, and FIG. 10 is an explanatory drawing for explaining the refrigerant flowing in the intermediate tank unit 33 according to the present embodiment.

In the refrigerant evaporator 1*a* according to the present embodiment, the cross-sectional areas of the first and second coupling members 31*a*, 31*b* (the cross sectional area of the inlet port of the refrigerant at the refrigerant exchanging portion 30) are respectively smaller than the cross-sectional areas of the third and fourth coupling members 32*a*, 32*b* (the outlet port of the refrigerant at the refrigerant exchanging portion 30). As illustrated in FIG. 9(*a*) and FIG. 10(*a*), the opening areas (opening widths $La_1$, $La_2$) of the first and second coupling members 31*a*, 31*b* are smaller than the opening areas (opening widths $La_1'$, $La_2'$) of the first and second coupling members of the refrigerant evaporator 1*a* according to the comparative example.

In the refrigerant evaporator 1*a* according to the comparative example, since the opening areas (opening widths $La_1'$, $La_2'$) of the first and second coupling members 31*a*, 31*b* are large, the flow velocity of the refrigerant flowing from the first and second coupling members 31*a*, 31*b* into the intermediate tank unit 33 is low, and hence the liquid-phase refrigerant, oil, and the like tends to stay in the intermediate tank unit 33.

In contrast, in the refrigerant evaporator 1*a* according to the present embodiment, since the opening areas (opening widths $La_1'$, $La_2'$) of the first and second coupling members 31*a*, 31*b* are small, the flow velocity of the refrigerant flowing from the first and second coupling members 31*a*, 31*b* into the intermediate tank unit 33 is high, and hence the liquid-phase refrigerant, oil, and the like flowing into the intermediate tank unit 33 are stirred with the high velocity, the liquid-phase refrigerant, oil, and the like are suppressed from staying in the intermediate tank unit 33.

Since an excessively heated area (superheated area) in which the refrigerant (gas-phase refrigerant) gasified when passing through the leeward side evaporator 20 flows is generated in the windward evaporator 10, the cooling performance of the blast air in the windward evaporator 10 tends to be lower than the cooling performance of the blast air in the leeward side evaporator 20. In the excessively heated area, the refrigerant only absorb sensible heat from the blast air, and hence the blast air is not sufficiently cooled.

In the refrigerant evaporator 1*a* of the present embodiment, since the windward evaporator 10 is arranged on the upstream side with respect to the leeward side evaporator 20 in the blast air flowing direction X, the temperature difference between the refrigerant evaporating temperature at the respective evaporators 10, 20 and the blast air is secured, so that the blast air can be cooled efficiently.

In the present embodiment, since the third and fourth coupling members 32*a*, 32*b* open so as to oppose the tubes located on one end side in the stacking direction from among the multiple tubes 111 of the respective core portions 11*a*, 11*b* of the windward heat exchanging core unit 11, the refrigerant can easily flow to the tubes positioned on the end portions of the respective core portions 11*a*, 11*b* of the windward heat exchanging core unit 11, respectively in the stacking direction. Consequently, deterioration of the refrigerant distributing properties is effectively suppressed.

Second Embodiment

Subsequently, a second embodiment of the present disclosure will be described. In the present embodiment, the configurations of the third and fourth coupling members 32*a*, 32*b* are different from those in the first embodiment. In the present embodiment, description of parts which are the same as or equivalent to those of the first embodiment is omitted, or is given briefly.

Figure 11:
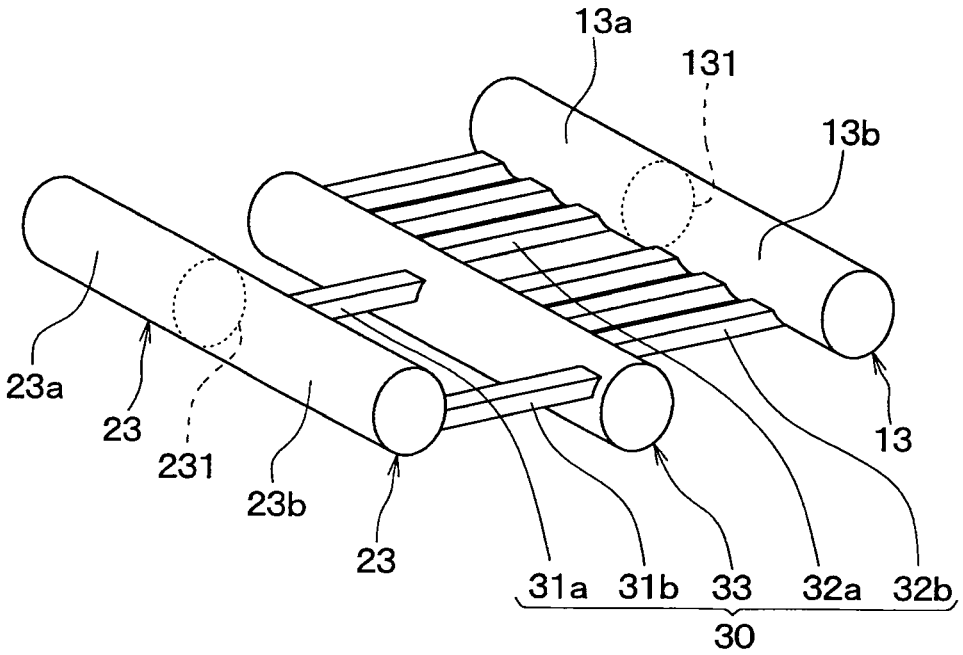
FIG. 11(*a*) is a perspective view illustrating a refrigerant exchanging portion of a refrigerant evaporator according to a second embodiment.
Figure 11:
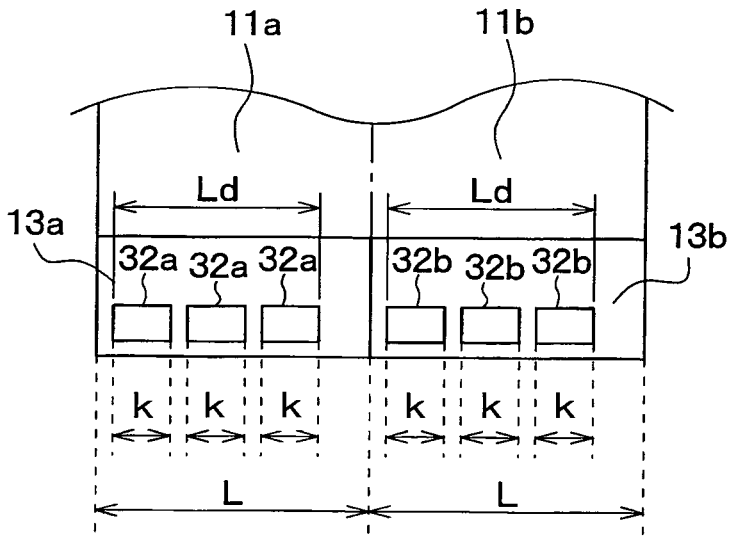

FIG. 11 is an explanatory drawing for explaining the third and fourth coupling members 32*a*, 32*b* according to the present embodiment.

As illustrated in FIG. 11(*a*), in the present embodiment, the third and fourth coupling members 32*a*, 32*b* each include multiple coupling members (three coupling members in the present embodiment). The multiple coupling members each includes a cylindrical member having a refrigerant passage in which the refrigerant flows inside thereof, and is connected at one end side to the second windward tank unit 13 and at the other end side to the intermediate tank unit 33.

As illustrated in FIG. 11(*b*), in the third and fourth coupling members 32*a*, 32*b* of the present embodiment, the total width (=Ld) of the opening width (=k) in the tube stacking direction at the multiple coupling portion is not smaller than half the core width L of each of the windward core portions 11*a*, 11*b* ($L/2 \leq Ld$).

In the present embodiment described thus far, the total width of the opening width of the multiple coupling portions including the third and fourth coupling members 32*a*, 32*b* in the tube stacking direction is not smaller than half the core width L of the respective windward core portions 11*a* and 11*b*.

Therefore, in the same manner as the first embodiment, the biases of the distributions of the refrigerant from the distributing portions 13*a*, 13*b* of the second windward tank unit 13 to the respective core portions 11*a*, 11*b* of the windward heat exchanging core unit 11 in the windward evaporator 10 may be suppressed, respectively.

Third Embodiment

Subsequently, a third embodiment of the present disclosure will be described. The present embodiment is different from the first embodiment in the opening widths of the third and fourth coupling members 32*a*, 32*b* of the refrigerant exchanging portion 30. In the present embodiment, a description of parts which are the same as or equivalent to those of the first and second embodiments is omitted, or is given briefly.

As described in conjunction with the first embodiment, in the refrigerant evaporator 1*a* according to the comparative example, the distributing properties of the liquid-phase refrigerant to the second windward core portion 11*b* of the windward heat exchanging core unit 11 are not good, and when viewing in the blast air flowing direction X, a portion where the liquid-phase refrigerant can hardly flow is generated in the second windward core portion 11*b* (see FIG. 7(*c*)).

Figure 12:
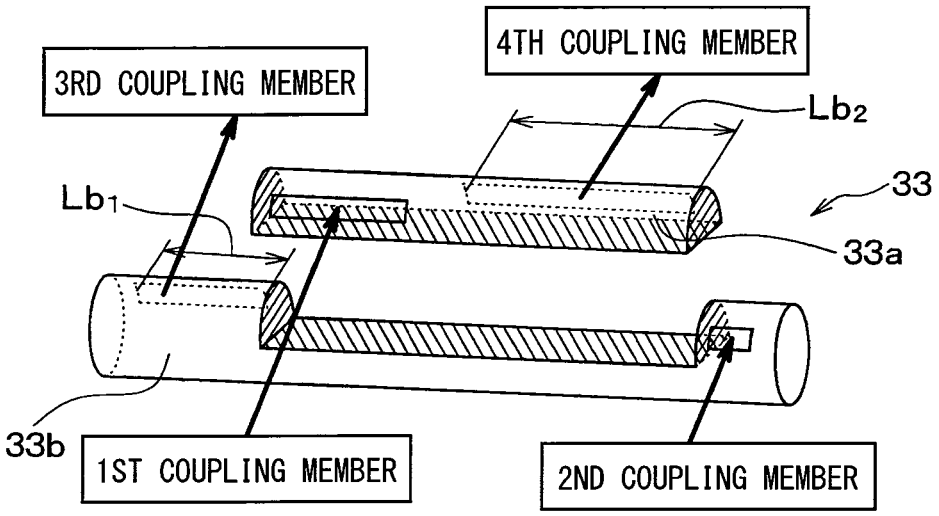
FIG. 12 is an exploded view of an intermediate tank according to a third embodiment.

Accordingly, in the present embodiment, as shown in FIG. 12, the opening width $Lb_2$ of the fourth coupling member 32*b* in the tube stacking direction coupled to the second windward core portion 11*b* is set to be longer than the opening width $Lb_1$ of the third coupling member 32*a*. FIG. 12 is an exploded perspective view of the intermediate tank unit 33 according to the present embodiment.

In this configuration, occurrence of the bias of the distribution of the refrigerant from the second distributing portion 13*b* to the second windward core portion 11*b* is effectively suppressed.

In this manner, by setting the opening widths of the third and fourth coupling members coupled to the heat exchanging core units 11, 21 in which the bias of the distribution of the liquid-phase refrigerant can easily occur from among the respective heat exchanging core units 11 and 21 of the refrigerant evaporator 1*a* to be longer than others, occurrence of the bias of the distribution of the refrigerant is effectively suppressed, and deterioration of the blast air distributing properties in the refrigerant evaporator 1*a* is suppressed.

Fourth Embodiment

Subsequently, a fourth embodiment of the present disclosure will be described. In the present embodiment, the configuration of the refrigerant exchanging portion 30 is different from those in the first to third embodiments. In the present embodiment, description of parts which are the same as or equivalent to those of the first to third embodiments is omitted, or is given briefly.

Figure 13:
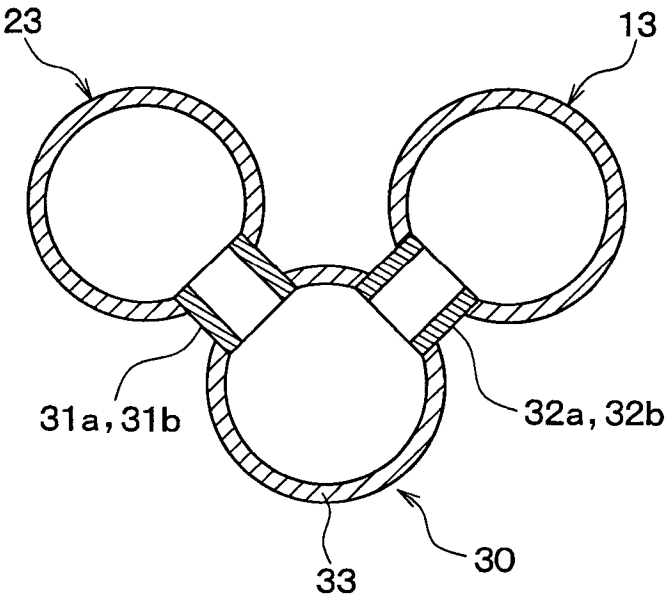
FIG. 13(*a*) is a cross-sectional view illustrating respective tank units according to the respective embodiments described above.
Figure 13:
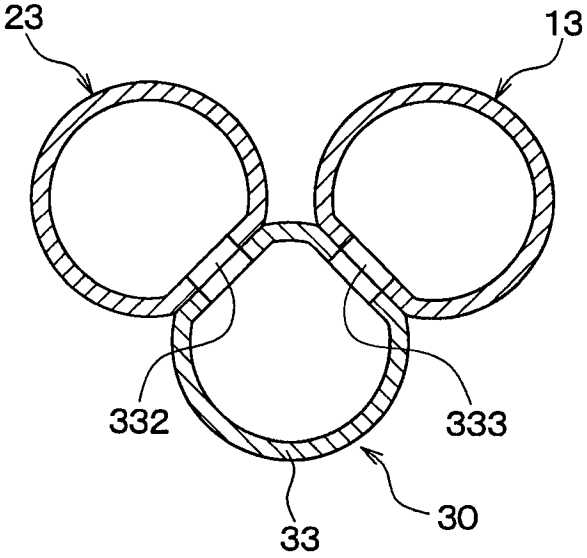

The refrigerant exchanging portion 30 of the present embodiment will be described with reference to FIG. 13, FIG. 14. FIG. 13 is an explanatory drawing (cross-sectional view) for explaining the respective tank units 13, 23, 33 according to the present embodiment.

In the respective embodiments described above, the refrigerant exchanging portion 30 includes a pair of collecting portion coupling members 31*a*, 31*b*, a pair of distributing portion coupling members 32*a*, 32*b*, and the intermediate tank unit 33 as illustrated in FIG. 13(*a*).

In contrast, in the present embodiment, the refrigerant exchanging portion 30 does not include the coupling members 31*a*, 31*b*, 32*a*, 32*b*, and includes the intermediate tank unit 33. Specifically, the intermediate tank unit 33 of the present embodiment is joined directly to the second windward tank unit 13 and the second leeward tank unit 23 respectively, and is provided with an inlet communicating hole 332 and an outlet side communicating hole 333 at joint portion therebetween as illustrated in FIG. 13(*b*). The second leeward tank unit 23 and the intermediate tank unit 33 of the present embodiment are provided with flat surfaces at portions opposed to each other, and the flat surfaces are tightly joined with each other. In the same manner, the second windward tank unit 13 and the intermediate tank unit 33 of the present embodiment are provided with flat surfaces at portions opposed to each other, and the flat surfaces are tightly joined with each other.

Figure 14:
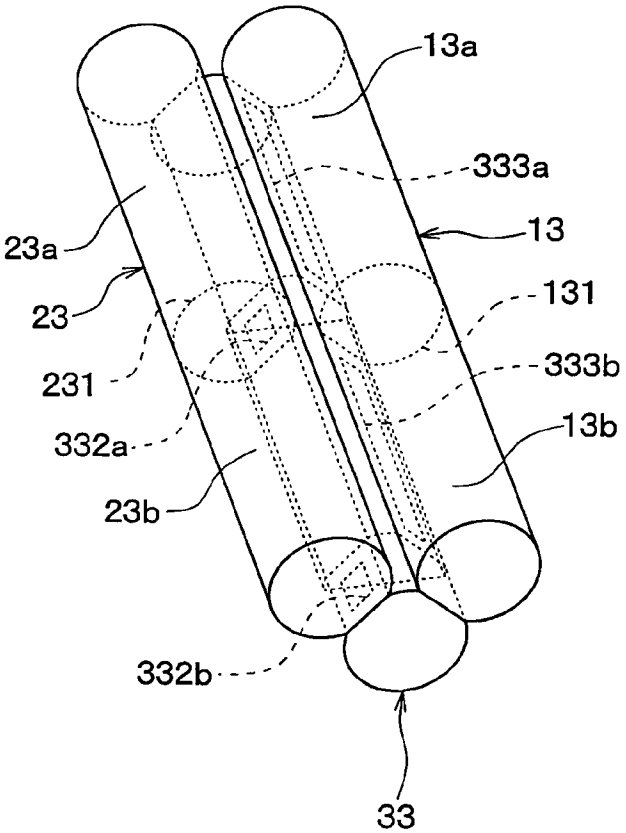
FIG. 14(*a*) is a perspective view illustrating the respective tank units of the refrigerant evaporator according to the fourth embodiment.
Figure 14:
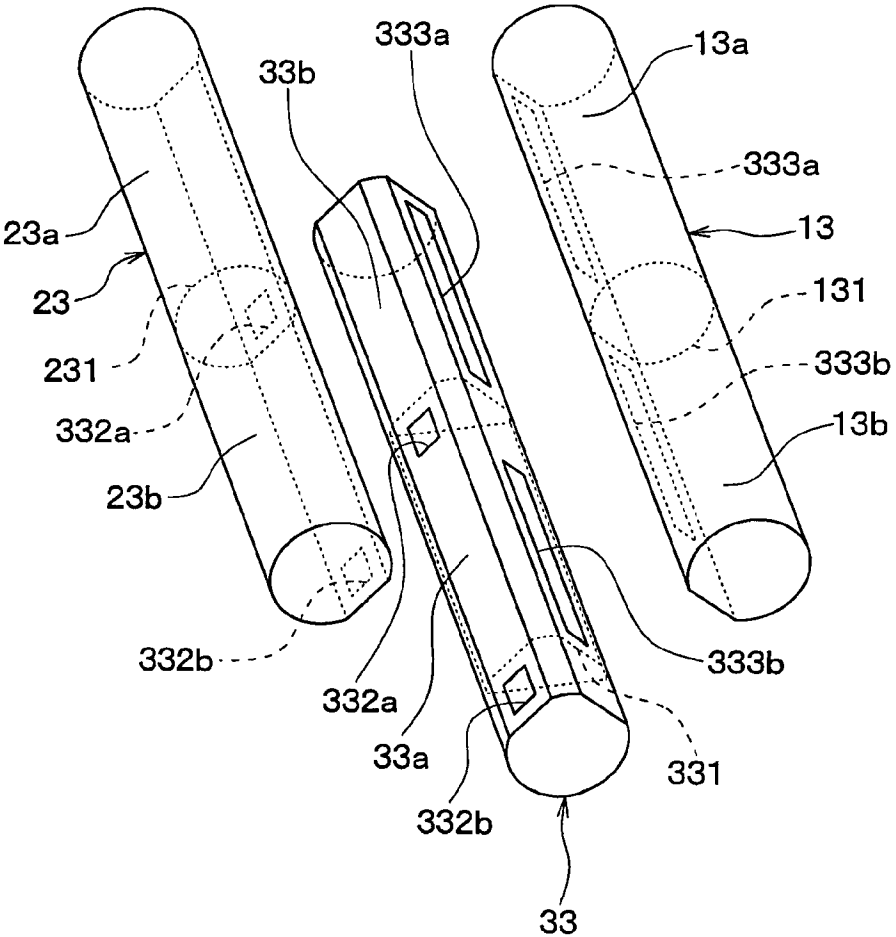

FIG. 14 is an explanatory drawing for explaining the refrigerant exchanging portion 30 according to the present embodiment in detail.

As illustrated in FIG. 14, the inlet communicating hole 332 of the present embodiment includes a first inlet communicating hole portion 332*a* through which the first collecting portion 23*a* of the second leeward tank unit 23 communicates with the first refrigerant passage 33*a* of the intermediate tank unit 33, and a second inlet communicating hole portion 332*b* through which the second collecting portion 23*b* of the second leeward tank unit 23 communicates with the second refrigerant passage 33*b* of the intermediate tank unit 33.

The outlet side communicating hole 333 includes a first outlet side communicating hole portion 333*a* through which the first distributing portion 13*a* of the second windward tank unit 13 communicates with the second refrigerant passage 33*b* of the intermediate tank unit 33, and a second outlet side communicating hole portion 333*b* through which the second distributing portion 13*b* of the second windward tank unit 13 communicates with the first refrigerant passage 33*a* of the intermediate tank unit 33.

Therefore, the intermediate tank unit 33 of the present embodiment communicates with the first collecting portion 23*a* via the first inlet communicating hole portion 332*a* of the inlet communicating hole 332, and communicates with the second distributing portion 13*b* via the second outlet side communicating hole portion 333*b* of the outlet side communicating hole 333.

The intermediate tank unit 33 of the present embodiment also communicates with the second collecting portion 23*b* via the second inlet communicating hole portion 332*b* of the inlet communicating hole 332, and communicates with the first distributing portion 13*a* via the first outlet side communicating hole portion 333*a* of the outlet side communicating hole 333.

The opening widths of the outlet side communicating hole portions 333*a*, 333*b* of the outlet side communicating hole 333 are larger than those of the inlet communicating hole portions 332*a*, 332*b* of the inlet communicating hole 332, respectively in the tube stacking direction. More specifically, the outlet side communicating hole portions 333*a*, 333*b* of the outlet side communicating hole 333 have a width not smaller than half the core width (width in the tube stacking direction) of the core portions of the core portions 11*a*, 11*b* of the windward heat exchanging core unit 11 on the coupled side.

Furthermore, the outlet side communicating hole portions 333*a*, 333*b* of the present embodiment open so as to oppose part of the tubes from located on the one end side in the stacking direction among the multiple tubes 111 in the core portions 11*a*, 11*b* of the windward heat exchanging core unit 11.

In the present embodiment, the first refrigerant passage 33*a* of the intermediate tank unit 33 may be used as the first coupled portion for example and the second refrigerant passage 33*b* of the intermediate tank unit 33 may be used as the second coupling portion for example. The first inlet communicating hole portion 332*a* of the intermediate tank unit 33 may be used as the inlet port of the first communicating portion for example, and the second outlet side communicating hole portion 333*b* of the intermediate tank unit 33 may be used as the first outlet port of the first communicating portion for example. The second inlet communicating hole portion 332*b* of the intermediate tank unit 33 may be used as the refrigerant inlet port of the second communicating portion for example, and the first outlet side communicating hole portion 333*a* may be used as the second outlet port of the second communicating portion for example.

According to the present embodiment described thus far, since the respective refrigerant passages 33*a*, 33*b* provided in the intermediate tank unit 33 may be used as the communicating portion of the refrigerant exchanging portion 30, a configuration of exchanging the refrigerant flowing direction at the communicating portion that couples the tank units of one of the respective evaporators 10, 20 is achieved concretely and easily.

Although the first to fourth embodiments of the present disclosure have been described, the present disclosure is not limited thereto, and improvements within a range that those skilled in the art can easily be replaced and on the basis of the knowledge that those skilled in the art normally have may be added as appropriate. For example various modifications as given below are applicable.

In the first to fourth embodiments described above, the opening widths of the third and fourth coupling members 32*a*, 32*b* in the refrigerant exchanging portion 30 extending in the tube stacking direction are larger than the opening widths of the first and second coupling members 31*a*, 31*b* extending in the tube stacking direction, the present disclosure is not limited thereto. For example, the opening widths, extending in the tube stacking direction, of one of the coupling members of the third and fourth coupling members 32*a*, 32*b* of the refrigerant exchanging portion 30 may be set to be larger than the opening width of a corresponding one of the first and second coupling members 31*a*, 31*b* extending in the tube stacking direction.

As described in conjunction with the first to fourth embodiments, the opening widths of the third and fourth coupling members 32*a*, 32*b* in the tube stacking direction are preferably set to be not smaller than half the core widths of the respective windward core portions 11*a*, 11*b* to be coupled. However, the present disclosure is not limited thereto as long as the opening widths of the third and fourth coupling members 32*a*, 32*b*, respectively extending in the tube stacking direction are larger than the opening widths of the first and second coupling members 31*a*, 31*b* extending in the tube stacking direction.

In the same manner, the cross-sectional areas of the first and second coupling members 31*a*, 31*b* do not have to be larger than the cross-sectional areas of the third and fourth coupling members 32*a*, 32*b* as long as the opening widths of the third and fourth coupling members 32*a*, 32*b* extending in the tube stacking direction are larger than the opening widths of the first and second coupling members 31*a*, 31*b* extending in the tube stacking direction.

In the first to third embodiments described above, the example in which the refrigerant exchanging portion 30 includes the pair of collecting portion coupling members 31*a*, 31*b*, the pair of distributing portion coupling members 32*a*, 32*b*, and the intermediate tank unit 33 has been described. However, the present disclosure is not limited thereto and, for example, a configuration in which the intermediate tank unit 33 of the refrigerant exchanging portion 30 is eliminated and the coupling members 31*a*, 31*b*, 32*a*, 32*b* are directly connected with each other is also applicable.

In the first to fourth embodiments described above, the example in which the refrigerant evaporator 1*a* is arranged so that the first windward core portion 11*a* and the first leeward core portion 21*a* overlap with each other and the second windward core portion 11*b* and the second leeward core portion 21*b* overlap with each other when viewing from the blast air flowing direction. However, the present disclosure is not limited thereto. The refrigerant evaporator 1*a* may be arranged so that at least part of the first windward core portion 11*a* and the first leeward core portion 21*a* overlap with each other or at least part of the second windward core portion 11*b* and the second leeward core portion 21*b* overlap with each other when viewing from the blast air flowing direction.

As in the first to fourth embodiments described above, the windward evaporator 10 of the refrigerant evaporator 1*a* is preferably arranged on the upstream side of the leeward side evaporator 20 in the blast air flowing direction X. However, the present disclosure is not limited thereto, and the windward evaporator 10 may be arranged on the downstream side of the leeward side evaporator 20 in the blast air flowing direction X.

Although the description of the example in which the respective heat exchanging core units 11 and 21 include multiple tubes 111, 211, and the fins 112, 212 has been given in the first to fourth embodiments described above, the present disclosure is not limited thereto, and the respective heat exchanging core units 11, 21 may have only the multiple tubes 111, 211. In the case where the respective heat exchanging core units 11, 21 include the multiple tubes 111, 211 and the fins 112, 212, the fins 112, 212 are not limited to the corrugate fins, but may be plate fins.

Although the example in which the refrigerant evaporator 1*a* is applied to a refrigerating cycle of the vehicle air-conditioning apparatus has been described in the first to fourth embodiments, the present disclosure is not limited thereto and, for example, may be applied to the refrigerating cycle which is used for water heaters.

In the first to fourth embodiments described above, one end side of each of the fourth communicating portion 32*b* and the second outlet side communicating hole portion 333*b* used as an example of the first outlet port is located in the vicinity of the partitioning member 131. In other words, the fourth communicating portion 32*b* and the second outlet side communicating hole portion 333*b* extend from the vicinity of the partitioning member 131 in the tube stacking direction. The fourth communicating portion 32*b* or the second outlet side communicating hole portion 333*b* communicates with the fourth core portion 11*b*, which is farther than the third core portion 11*a* from the refrigerant outflow port 12*a*. In the case where the fourth communicating portion 32*b* or the second outlet side communicating hole portion 333*b* is provided at a relatively far position from the partitioning member 131, the bias of the distribution of the refrigerant may occur in the fourth core portion. However, the bias of the distribution of the refrigerant in the fourth core portion 11*b* may be suppressed by positioning one end side of each of the fourth communicating portion 32*b* and the second outlet side communicating hole portion 333*b* in the vicinity of the partitioning member 131 as described in the first to fourth embodiments. The widths of the fourth communicating portion 32*b* and the second outlet side communicating hole portion 333*b* may be not smaller than half the widths of the fourth core portion 11*b* in the tube stacking direction. Alternatively, the one end side of each of the fourth communicating portion 32*b* and the second outlet side communicating hole portion 333*b* may be adjacent to the partitioning member 131 without gap interposed therebetween in the tube stacking direction of the windward heat exchanging core unit 11.

Fifth Embodiment

Referring to FIG. 15 to FIG. 28, a fifth embodiment of the present disclosure will be described. A refrigerant evaporator 1*b* is provided to a vehicle air-conditioning apparatus configured to adjust the temperature in a cabin. The refrigerant evaporator 1*b* is a cooling heat exchanger configured to cool air supplied into the cabin. The refrigerant evaporator 1*b* is a low-pressure side heat exchanger of a vapor compression refrigerating cycle. The refrigerant evaporator 1*b* absorbs heat from the air supplied into the cabin and evaporating refrigerant, that is, liquid-phase refrigerant. The air supplied into the cabin is a subject-to-cooling fluid flowing outside the refrigerant evaporator 1*b*.

The refrigerant evaporator 1*b* is one of components of the refrigerating cycle. The refrigerating cycle may be provided with components such as a compressor, a heat radiator, and an expander, which are not illustrated. For example, the refrigerating cycle is a receiver cycle having a liquid receiver between the heat radiator and the expander.

Figure 15:
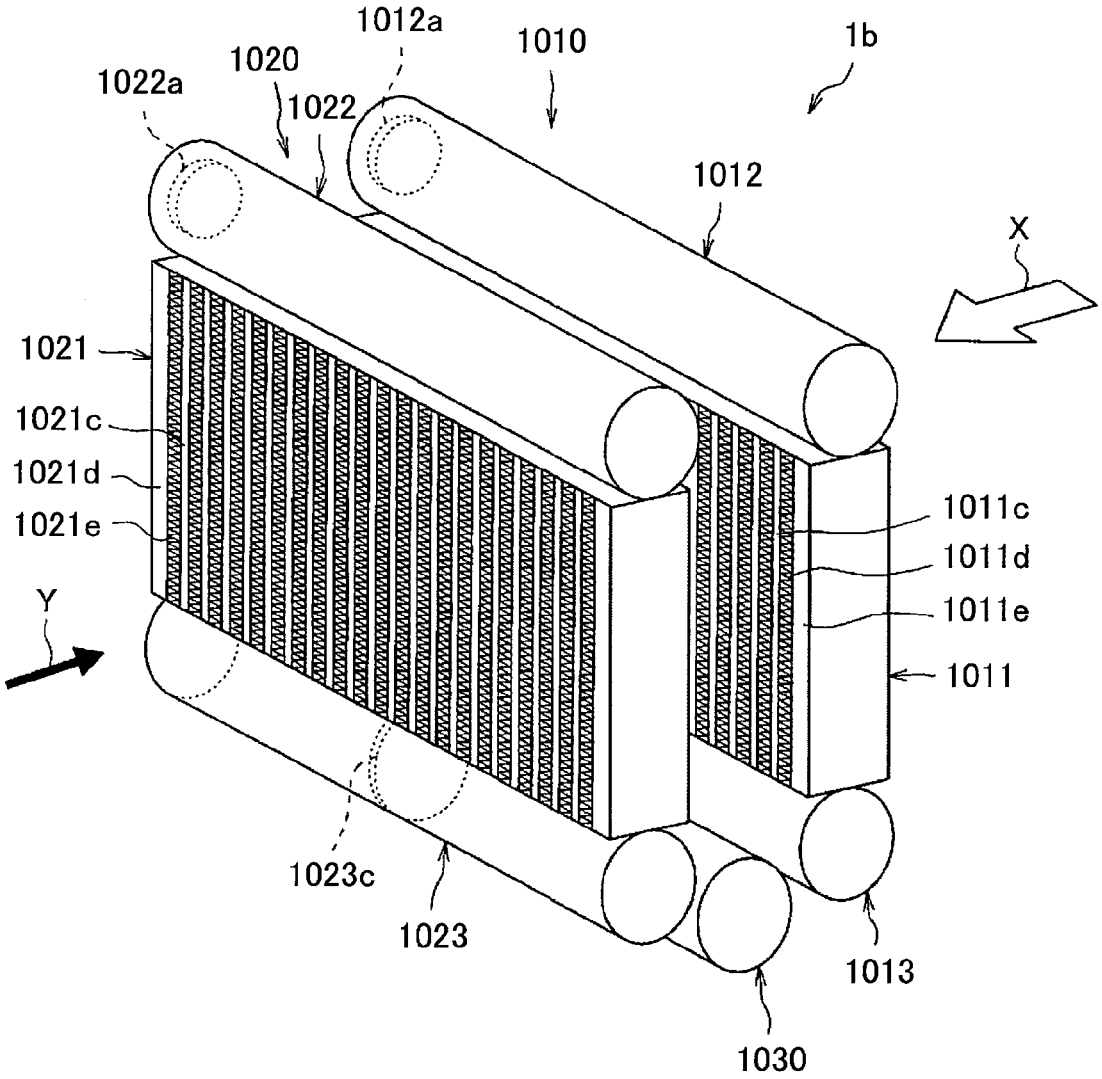
FIG. 15 is a perspective schematic diagram illustrating a refrigerant evaporator according to a fifth embodiment of the present disclosure.
Figure 16:
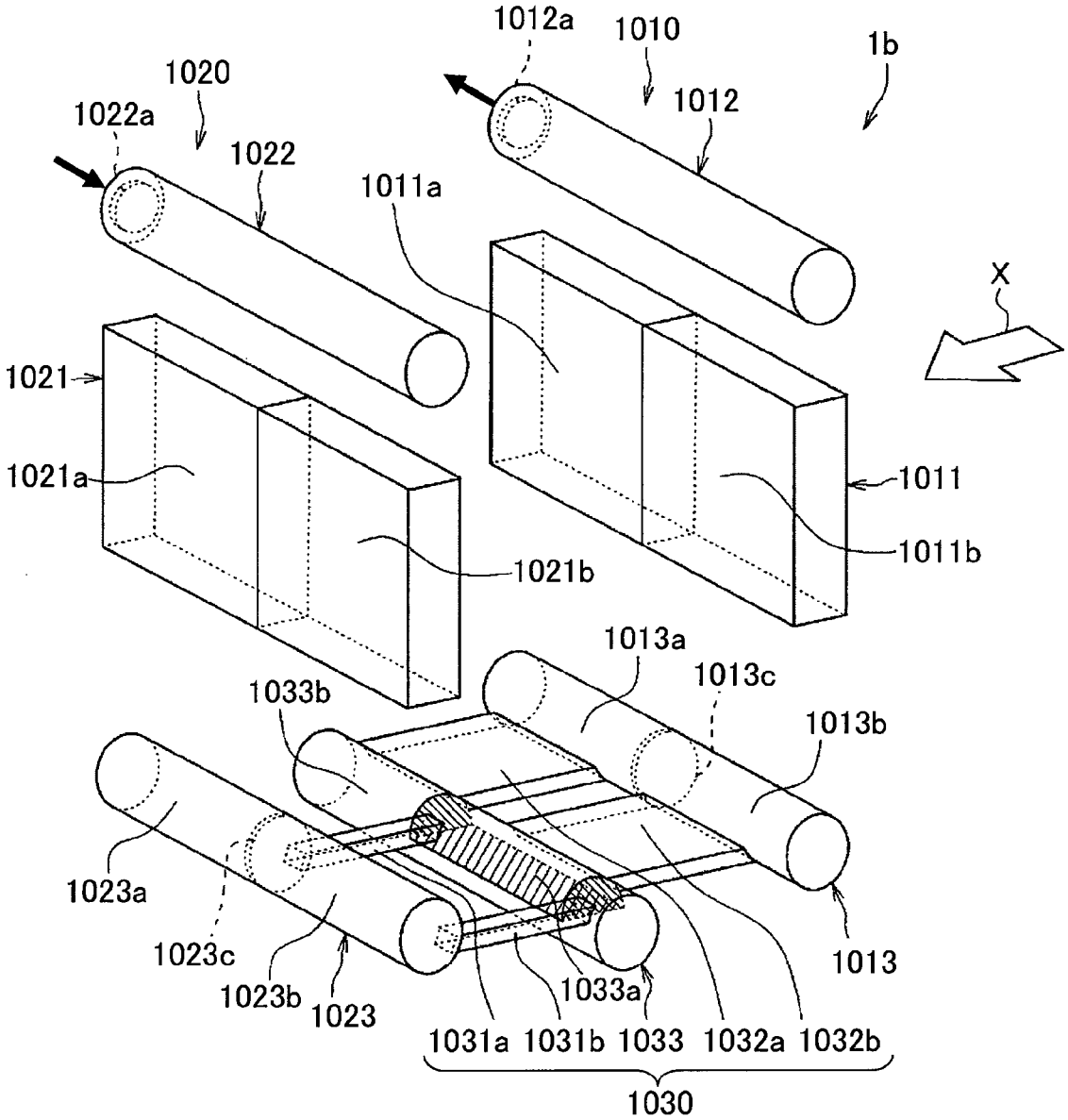
FIG. 16 is an exploded schematic diagram illustrating the refrigerant evaporator of the fifth embodiment.

In FIG. 15, the refrigerant evaporator 1*b* is diagrammatically illustrated. FIG. 16 illustrates multiple components of the refrigerant evaporator 1*b*. In the drawing, illustration of tubes 1011*c*, 1021*c* and fins 1011*d*, 1021*d* of the respective core units 1011, 1021.

As illustrated in the drawing, the refrigerant evaporator 1*b* includes two evaporators 1010, 1020. The two evaporators 1010, 1020 are arranged in series on the upstream side and the downstream side with respect to an air flow direction, that is, the subject-to-cooling fluid flowing direction X. The evaporator 1010 arranged on the upstream side in the air flowing direction X is also referred to as an air upstream evaporator 1010. Hereinafter, the air upstream evaporator 1010 is referred to as an AU evaporator 1010. The evaporator 1020 arranged on the downstream side in the air flowing direction X is also referred to as an air downstream evaporator 1020. Hereinafter, the air downstream evaporator 1020 is referred to as an AD evaporator 1020. The two evaporators 1010, 1020 are arranged on the upstream side and the downstream side also with respect to the refrigerant flowing direction. The refrigerant flows in the AD evaporator 1020, and then in the AU evaporator 1010. When viewing with respect to the refrigerant flowing direction, the AD evaporator 1020 is referred to as a first evaporator, and the AU evaporator 1010 is referred to as a second evaporator. The refrigerant evaporator 1*b* is provided with a counterflow heat exchanger in which the refrigerant flowing direction and the air flowing direction oppose to each other as a whole.

Configurations of the AU evaporator 1010 and the AD evaporator 1020 are basically the same. The AU evaporator 1010 includes a core unit 1011 (upstream core unit) for heat exchange and a pair of tank units 1012, 1013 (a pair of upstream core units) arranged on both ends of the core unit 1011. The AD evaporator 1020 includes a core unit 1021 (downstream core unit) for heat exchange and a pair of tank units 1022, 1023 (a pair of downstream tank units) arranged on both ends of the core unit 1021.

The core unit 1011 of the AU evaporator 1010 is referred to as the AU core unit 1011. The core unit 1021 of the AD evaporator 1020 is referred to as the AD core unit 1021. The pair of tank units 1012, 1013 in the AU evaporator 1010 includes the first AU tank unit 1012 arranged on the upper side and the second AU tank unit 1013 arranged on the lower side. In the same manner, the pair of tank units 1022, 1023 in the AD evaporator 1020 includes the first AD tank unit 1022 arranged on the upper side and the second AD tank unit 1023 arranged on the lower side.

The AU core unit 1011 and the AD core unit 1021 include multiple tubes 1011*c*, 1021*c* and multiple fins 1011*d*, 1021*d*. The AU core unit 1011 and the AD core unit 1021 are configured by a stacked body in which the multiple tubes 1011*c*, 1021*c* and the multiple fins 1011*d*, 1021*d* are stacked alternately. The multiple tubes 1011*c* provide communication between the pair of tank units 1012, 1013. The multiple tubes 1021*c* provide communication between the pair of tank units 1022, 1023. The multiple tubes 1011*c*, 1021*c* extend in the vertical direction in the drawing. The multiple fins 1011*d*, 1021*d* are arranged between the adjacent tubes 1011*c*, 1021*c* and are joined thereto. In the following description, the direction of stacking of the multiple tubes 1011*c*, 1021*c* and the multiple fins 1011*d*, 1021*d* in the stacked body is referred to as a tube stacking direction.

The AU core unit 1011 includes a first AU core portion 1011*a* and a second AU core portion 1011*b*. The first AU core portion 1011*a* includes part of the multiple tubes 1011*c*. The first AU core portion 1011*a* includes the group of the tubes 1011*c* arranged so as to form a row. The second AU core portion 1011*b* includes a remaining part of the multiple tubes 1011*c*. The second AU core portion 1011*b* includes a group of the tubes 1011*c* arranged so as to form a row. The first AU core portion 1011*a* and the second AU core portion 1011*b* are arranged in the tube stacking direction. The first AU core portion 1011*a* includes a tube group arranged on the right side in the tube stacking direction when viewing along the air flowing direction X. The second AU core portion 1011*b* includes a tube group arranged on the left side in the tube stacking direction when viewing along the air flowing direction X. The first AU core portion 1011*a* is arranged at a position closer than the second AU core portion 1011*b* to a refrigerant outlet port 1012*a* of the first AU tank unit 1012. The first AU tank unit 1012 is a last collecting tank located on the downstreammost position of the refrigerant flow in the refrigerant evaporator 1*b*. The first AU tank unit 1012 is a collecting portion provided at a downstream end of the refrigerant in the multiple tubes 1011*c* of the first AU core portion 1011*a*, and configured to collect the refrigerant after having passed through the first AU core portion 1011*a*. The first AU tank unit 1012 may be used as an example of an outlet collecting portion provided with the refrigerant outlet port 1012*a* at an end portion of a throttle passage 1033*k*, which will be described later, in the refrigerant flowing direction.

The AD core unit 1021 includes a first AD core portion 1021*a* and a second AD core portion 1021*b*. The first AD core portion 1021*a* includes part of the multiple tubes 1021*c*. The first AD core portion 1021*a* includes a group of the tubes 1021*c* arranged so as to form a row. The second AD core portion 1021*b* includes a remaining part of the multiple tubes 1021*c*. The second AD core portion 1021*b* includes a group of the tubes 1021*c* arranged so as to form a row. The first AD core portion 1021*a* and the second AD core portion 1021*b* are arranged in the tube stacking direction. The first AD core portion 1021*a* includes a tube group arranged on the right side in the tube stacking direction when viewing along the air flowing direction X. The second AD core portion 1021*b* includes a tube group arranged on the left side in the tube stacking direction when viewing along the air flowing direction X. The first AD core portion 1021*a* is arranged at a position closer than the second AD core portion 1021*b* to a refrigerant inlet port 1022*a* of the tank unit 1022. The tank unit 1022 is a first distributing tank located on the upstreammost position of the refrigerant flow in the refrigerant evaporator 1*b*.

The first AD core portion 1021*a* is referred to as a first core portion. The second AD core portion 1021*b* is referred to as a second core portion. The first AU core portion 1011*a* is referred to as a third core portion. The second AU core portion 1011*b* is referred to as a fourth core portion.

The first AU core portion 1011*a* and the first AD core portion 1021*a* are arranged so as to be overlapped with each other in the air flowing direction X. In other words, the first AU core portion 1011*a* and the first AD core portion 1021*a* are arranged so as to oppose each other in the air flowing direction X. The second AU core portion 1011*b* and the second AD core portion 1021*b* are arranged so as to be overlapped with each other in the air flowing direction X. In other words, the second AU core portion 1011*b* and the second AD core portion 1021*b* are arranged so as to oppose each other in the air flowing direction X.

Each of the multiple tubes 1011*c*, 1021*c* defines a passage to allow the refrigerant to flow inside. Each of the multiple tubes 1011*c*, 1021*c* is a flat tube. Each of the multiple tubes 1011*c*, 1021*c* has a flat cross section extending along the air flowing direction X.

The tubes 1011*c* of the AU core portion 1011 is connected at one end in the longitudinal direction, that is, at an upper end to the first AU tank unit 1012, and is connected at the other end along the longitudinal direction, that is, at a lower end to the second AU tank unit 1013. The tubes 1021*c* of the AD core unit 1021 is connected at one end in the longitudinal direction, that is, at an upper end to the first AD tank unit 1022, and is connected at the other end in the longitudinal direction, that is, at a lower end to the second AD tank unit 1023.

Each of the multiple fins 1011*d*, 1021*d* is a corrugate fin. Each of the multiple fins 1011*d*, 1021*d* is formed by bending a thin plate material into a wavy shape. Each of the multiple fins 1011*d*, 1021*d* is joined to a flat outer surface of each of the tubes 1011*c*, 1021*c*, and is used as heat exchange accelerating means for enlarging a heat-transfer area with respect to the air.

The stacked body including the tubes 1011*c*, 1021*c* and the fins 1011*d*, 1021*d* includes side plates 1011*e*, 1021*e* for reinforcing the respective core units 1011, 1021 arranged at both end portions in the tube stacking direction. The side plates 1011*e*, 1021*e* are joined to the fins 1011*d*, 1021*d* arranged on the outermost side in the tube stacking direction.

The first AU tank unit 1012 has a cylindrical member. The first AU tank unit 1012 is closed at one end, that is, at a left end when viewing along the air flowing direction X. The first AU tank unit 1012 includes the refrigerant outlet port 1012*a* at other end, that is, at a right end when viewing along the air flowing direction X. The refrigerant outlet port 1012*a* draws out the refrigerant from inside the tank to an air inlet side of the compressor, which is not illustrated. Multiple through holes in which ends of the multiple tubes 1011*c* on one side are inserted and joined are provided on a bottom portion of the first AU tank unit 1012 in the drawing. In other words, an internal space of the first AU tank unit 1012 communicates with the multiple tubes 1011*c* of the AU core portion 1011. The first AU tank unit 1012 functions as a collecting portion for collecting the refrigerant from the multiple tubes 1011*c* of the AU core unit 1011.

The first AD tank unit 1022 has a cylindrical member. The first AD tank unit 1022 closes at one end thereof. The first AD tank unit 1022 includes the refrigerant inlet port 1022*a* at the other end thereof. The refrigerant inlet ports 1022*a* introduces low-pressure refrigerant decompressed by an expansion valve, which is not illustrated. Multiple through holes in which ends of the multiple tubes 1021*c* on one side are inserted and joined are provided in a bottom portion of the first AD tank unit 1022 in the drawing. In other words, the internal space of the first AD tank unit 1022 communicates with the multiple tubes 1021*c* of the AD core unit 1021. The first AD tank unit 1022 functions as a distributing portion for distributing the refrigerant to the multiple tubes 1021*c* of the AD core unit 1021.

The second AU tank unit 1013 includes a cylindrical member closed at both ends thereof. Multiple through holes in which ends of the multiple tubes 1011*c* on the other side are inserted and joined are provided in a ceiling portion of the second AU tank unit 1013. In other words, the internal space of the second AU tank unit 1013 communicates with the multiple tubes 1011*c*. The second AU tank unit 1013 functions as a distributing portion for distributing the refrigerant to the multiple tubes 1011*c* of the AU core unit 1011.

The second AU tank unit 1013 includes a partitioning member 1013*c* arranged inside thereof at a center position in the longitudinal direction. The partitioning member 1013*c* partitions the internal space of the second AU tank unit 1013 into a first distributing portion 1013*a* and a second distributing portion 1013*b*. The first distributing portion 1013*a* is a space that communicates with the multiple tubes 1011*c* of the first AU core portion 1011*a*. The first distributing portion 1013*a* supplies the refrigerant to the first AU core portion 1011*a*. The first distributing portion 1013*a* distributes the refrigerant to the multiple tubes 1011*c* of the first AU core portion 1011*a*. The second distributing portion 1013*b* is a space that communicates with the multiple tubes 1011*c* of the second AU core portion 1011*b*. The second distributing portion 1013*b* supplies the refrigerant to the second AU core portion 1011*b*. The second distributing portion 1013*b* distributes the refrigerant to the multiple tubes 1011*c* of the second AU core portion 1011*b*. Therefore, the first distributing portion 1013*a* and the second distributing portion 1013*b* constitute a series of the distributing tank unit 1013.

The second AD tank unit 1023 includes a cylindrical member closed at both ends thereof. Multiple through holes in which ends of the multiple tubes 1021*c* on the other side are inserted and joined are provided in a ceiling portion of the second AD tank unit 1023. In other words, the internal space of the second AD tank unit 1023 communicates with the multiple tubes 1021*c*.

The second AD tank unit 1023 includes a partitioning member 1023*c* arranged inside thereof at a center position in the longitudinal direction. The partitioning member 1023*c* partitions the internal space of the second AD tank unit 1023 into a first collecting portion 1023*a* and a second collecting portion 1023*b*. The first collecting portion 1023*a* is a space that communicates with the multiple tubes 1021*c* of the first AD core portion 1021*a*. The first collecting portion 1023*a* collects the refrigerant from the multiple tubes 1021*c* of the first AD core portion 1021*a*. The second collecting portion 1023*b* is a space that communicates with the multiple tubes 1021*c* of the second AD core portion 1021*b*. The second collecting portion 1023*b* collects the refrigerant from the multiple tubes 1021*c* of the second AD core portion 1021*b*. The second AD tank unit 1023 functions as a collecting portion that collets the refrigerant of the first AD core portion 1021*a* and the refrigerant of the second AD core portion 1021*b* separately. Therefore, the first collecting portion 1023*a* and the second collecting portion 1023*b* constitute a series of the collecting tank unit 1023.

The second AU tank unit 1013 and the second AD tank unit 1023 are coupled via an exchanging unit 1030. The exchanging unit 1030 leads the refrigerant in the first collecting portion 1023*a* of the second AD tank unit 1023 to the second distributing portion 1013*b* of the second AU tank unit 1013. The exchanging unit 1030 leads the refrigerant in the second collecting portion 1023*b* of the second AD tank unit 1023 to the first distributing portion 1013*a* of the second AU tank unit 1013.

In other words, the exchanging unit 1030 exchanges the flow of the refrigerant so that the refrigerant flowed through part of the AD core unit 1021 flows in other part in the AU core unit 1011. The part of the AD core unit 1021 and the other part of the AU core unit 1011 are not overlapped with each other in the air flowing direction X. In other words, the exchanging unit 1030 exchanges the refrigerant flowing from the second AD tank unit 1023 to the second AU tank unit 1013 so as to intersect with respect to the air flowing direction X. In other words, the exchanging unit 1030 exchanges the flow of the refrigerant between the core unit 1011 and the core unit 1021 in a core width direction.

The exchanging unit 1030 provides a first communicating passage that leads the refrigerant flowed through the first AD core portion 1021*a* to the second AU core portion 1011*b* and a second communicating passage that leads the refrigerant flowed through the second AD core portion 1021*b* to the first AU core portion 1011*a*. The first communicating passage and the second communicating passage intersect each other.

Specifically, the exchanging unit 1030 includes a pair of coupling members 1031*a*, 1031*b* and a pair of coupling members 1032*a*, 1032*b*, and an intermediate tank unit 1033.

The first coupling member 1031*a* (first collecting communicating portion) and the second coupling member 1031*b* (second collecting portion communicating portion) communicate with the first collecting portion 1023*a* and the second collecting portion 1023*b* in the second AD tank unit 1023, respectively. The first and second coupling members 1031*a*, 1031*b* are each provided by a cylindrical member having a passage therein for allowing the refrigerant to flow therein. The first and second coupling members 1031*a*, 1031*b* are each connected at one end thereof to the second AD tank unit 1023 and at the other end thereof to the intermediate tank unit 1033.

One end of the first coupling member 1031*a* is coupled to the first collecting portion 1023*a* of the second AD tank unit 1023. The first coupling member 1031*a* communicates at the one end with the first collecting portion 1023*a*. The other end of the first coupling member 1031*a* is connected to the intermediate tank unit 1033. The first coupling member 1031*a* communicates at the other end thereof with a first passage 1033*a* in the intermediate tank unit 1033, which will be described later.

The one end of the second coupling member 1031*b* is coupled to the second collecting portion 1023*b* of the second AD tank unit 1023. The second coupling member 1031*b* communicates at the one end thereof with the second collecting portion 1023*b*. The other end of the second coupling member 1031*b* is connected to the intermediate tank unit 1033. The second coupling member 1031*b* communicates at the other end thereof with a second passage 1033*b* in the intermediate tank unit 1033, which will be described later.

The one end of the first coupling member 1031*a* communicates only with an end portion of the first collecting portion 1023*a* in the longitudinal direction on an outer peripheral wall surface of the first collecting portion 1023*a*. The first coupling member 1031*a* communicates only with a portion in the vicinity of the partitioning member 1023*c*. The one end of the first coupling member 1031*a* is connected to and communicates with the first collecting portion 1023*a* at a position closer than an end portion of the second AD tank unit 1023 to the partitioning member 1023*c*.

The one end of the second coupling member 1031*b* communicates only with an end portion of the second collecting portion 1023*b* in the longitudinal direction on an outer peripheral wall surface of the second collecting portion 1023*b*. The second coupling member 1031*b* communicates only with a portion near the end portion of the second AD tank unit 1023. The one end of the second coupling member 1031*b* is connected to and communicates with the second collecting portion 1023*b* at a position closer than the partitioning member 1023*c* to the end portion of the second AD tank unit 1023.

The third coupling member 1032*a* (first distributing portion communicating portion) and the fourth coupling member 1032*b* (second distributing portion communicating portion) communicate with the first distributing portion 1013*a* and the second distributing portion 1013*b* in the second AU tank unit 1013, respectively. The third and fourth coupling members 1032*a*, 1032*b* are each provided by a cylindrical member having a passage therein for allowing the refrigerant to flow therein. The third and fourth coupling members 1032*a*, 1032*b* are each connected at one end thereof to the second AU tank unit 1013 and at the other end thereof to the intermediate tank unit 1033. The third and fourth coupling members 1032*a*, 1032*b* each include a rectangular slit-shaped opening elongated in the tube stacking direction at both of the communicating portion with respect to the second AU tank unit 1013 and the communicating portion with respect to the intermediate tank unit 1033.

The third coupling member 1032*a* is coupled to the first distributing portion 1013*a* of the second AU tank unit 1013. The fourth coupling member 1032*b* is coupled to the second distributing portion 1013*b* of the second AU tank unit 1013.

The one end of the third coupling member 1032*a* is coupled to the first distributing portion 1013*a* of the second AU tank unit 1013. The third coupling member 1032*a* communicates at the one end thereof with the first distributing portion 1013*a*. The other end of the third coupling member 1032*a* is connected to the intermediate tank unit 1033. The third coupling member 1032*a* communicates at the other end thereof with the second passage 1033*b* in the intermediate tank unit 1033. In other words, the third coupling member 1032*a* communicates with the second coupling member 1031*b* via the second passage 1033*b*.

The one end of the fourth coupling member 1032*b* is coupled to the second distributing portion 1013*b* of the second AU tank unit 1013. The fourth coupling member 1032*b* communicates at the one end thereof with the second distributing portion 1013*b*. The other end of the fourth coupling member 1032*b* is connected to the intermediate tank unit 1033. The fourth coupling member 1032*b* communicates at the other end thereof with the first passage 1033*a* in the intermediate tank unit 1033. In other words, the fourth coupling member 1032*b* communicates with the first coupling member 1031*a* via the first passage 1033*a*.

The one end of the third coupling member 1032*a* communicates only with an end portion of the first distributing portion 1013*a* in the longitudinal direction on an outer peripheral wall surface of the first distributing portion 1013*a*. The third coupling member 1032*a* communicates only with the end portion of the second AU tank unit 1013. The one end of the third coupling member 1032*a* is connected to and communicates with the first distributing portion 1013*a* at a position closer than the partitioning member 1013*c* to the end portion of the second AU tank unit 1013.

The one end of the fourth coupling member 1032*b* communicates only with an end portion of the second distributing portion 1013*b* in the longitudinal direction on an outer peripheral wall surface of the second distributing portion 1013*b*. The fourth coupling member 1032*b* communicates only with a portion in the vicinity of the partitioning member 1013*c*. The one end of the fourth coupling member 1032*b* is connected to and communicates with the second distributing portion 1013*b* at a position closer than the end portion of the second AU tank unit 1013 to the partitioning member 1013*c*.

The intermediate tank unit 1033 is coupled to the first and second coupling members 1031*a*, 1031*b* and the third and fourth coupling members 1032*a*, 1032*b*. The first and second coupling members 1031*a*, 1031*b* each provide an inlet port of the refrigerant at the exchanging unit 1030. The third and fourth coupling members 1032*a*, 1032*b* each provide an outlet port of the refrigerant at the exchanging unit 1030. The exchanging unit 1030 includes passages intersecting each other inside thereof.

Figure 17:
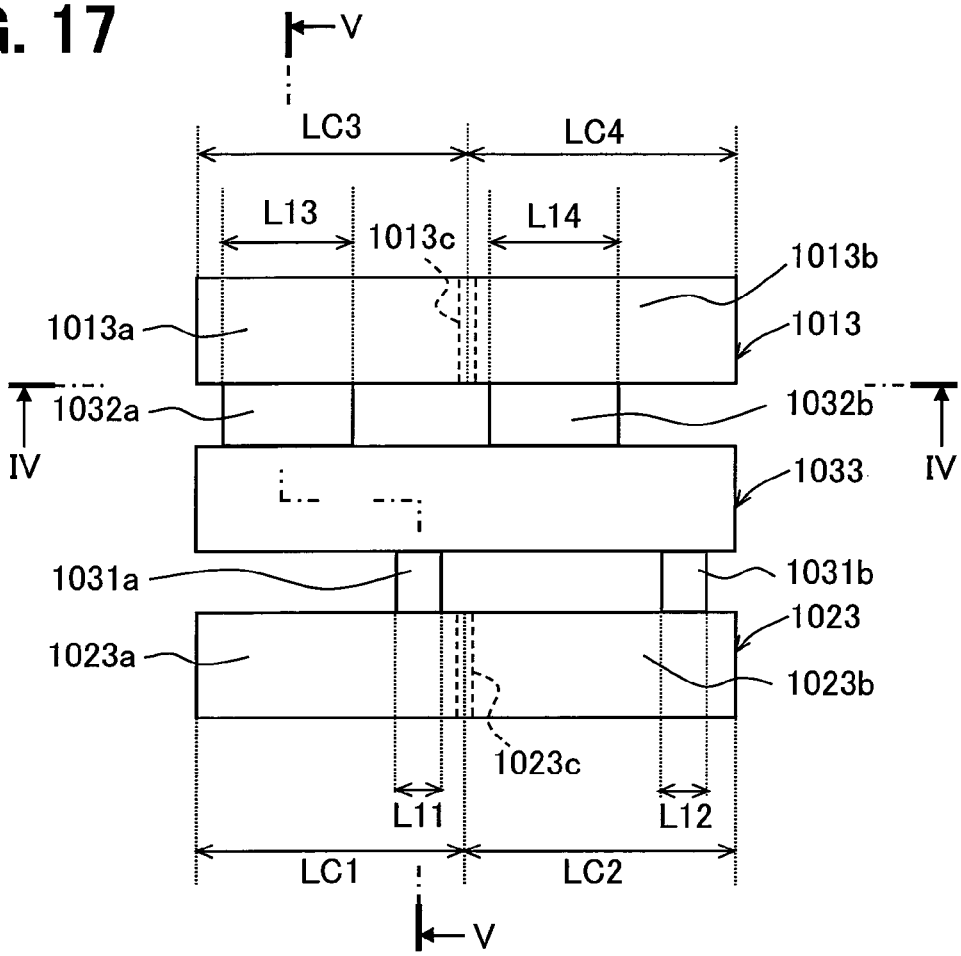
FIG. 17 is a schematic diagram illustrating an arrangement of multiple tank units of the refrigerant evaporator of the fifth embodiment.

FIG. 17 is a plan view illustrating an arrangement of the multiple tanks in a lower portion of the refrigerant evaporator 1*b*. The first coupling member 1031*a* has an opening width L11 in the tube stacking direction. The second coupling member 1031*b* has an opening width L12 in the tube stacking direction. The opening widths L11, L12 are the opening widths of both the second AD tank unit 1023 and the intermediate tank unit 1033. The third coupling member 1032*a* has an opening width L13 in the tube stacking direction. The fourth coupling member 1032*b* has an opening width L14 in the tube stacking direction. The opening widths L13, L14 are the opening widths of both the second AU tank unit 1013 and the intermediate tank unit 1033.

The first AD core portion 1021*a* has a core width LC1 in the tube stacking direction. The second AD core portion 1021*b* has a core width LC2 in the tube stacking direction. The first AU core portion 1011*a* has a core width LC3 in the tube stacking direction. The second AU core portion 1011*b* has a core width LC4 in the tube stacking direction. All the core widths are equal (LC1=LC2=LC3=LC4).

When comparing the first and second coupling members 1031*a*, 1031*b* and the third and fourth coupling members 1032*a*, 1032*b*, the opening widths L13, L14 are larger than the opening widths L11, L12. The opening width L13 is larger than the opening width L11 (L13>L11). The opening width L14 is larger than the opening width L12 (L14>L12). The opening width L11 and the opening width L12 are equal (L11=L12). The opening width L13 and the opening width L14 are equal (L13=L14).

The opening widths L13, L14 of the third and fourth coupling members 1032*a*, 1032*b* are not smaller than half the core widths LC3, LC4 of the corresponding core portions 1011*a*, 1011*b*. The opening widths L13 is not smaller than half the core width LC3 (L13≥LC3/2). The opening widths L14 is not smaller than half the core width LC4 (L14≥LC4/2).

The opening widths L11, L12 of the first and second coupling members 1031*a*, 1031*b* are smaller than half the core widths LC1, LC2 of the corresponding core portions 1021*a*, 1021*b*. The opening width L11 is smaller than half the core width LC1 (L11<LC½). The opening width L12 is smaller than half the core width LC2 (L12<LC2/2).

The cross-sectional area of the passage of the refrigerant that the first and second coupling members 1031*a*, 1031*b* provide may be represented by the cross-sectional area of an inlet port of the refrigerant at the exchanging unit 1030, that is, an inlet cross-sectional area. The cross-sectional area of the passage of the refrigerant that the third and fourth coupling members 1032*a*, 1032*b* provide may be represented by the cross-sectional area of an outlet of the refrigerant from the exchanging unit 1030, that is, an outlet cross-sectional area. When comparing the first and second coupling members 1031*a*, 1031*b* and the third and fourth coupling members 1032*a*, 1032*b*, the inlet cross-sectional area is smaller than the outlet cross-sectional area.

Figure 18:
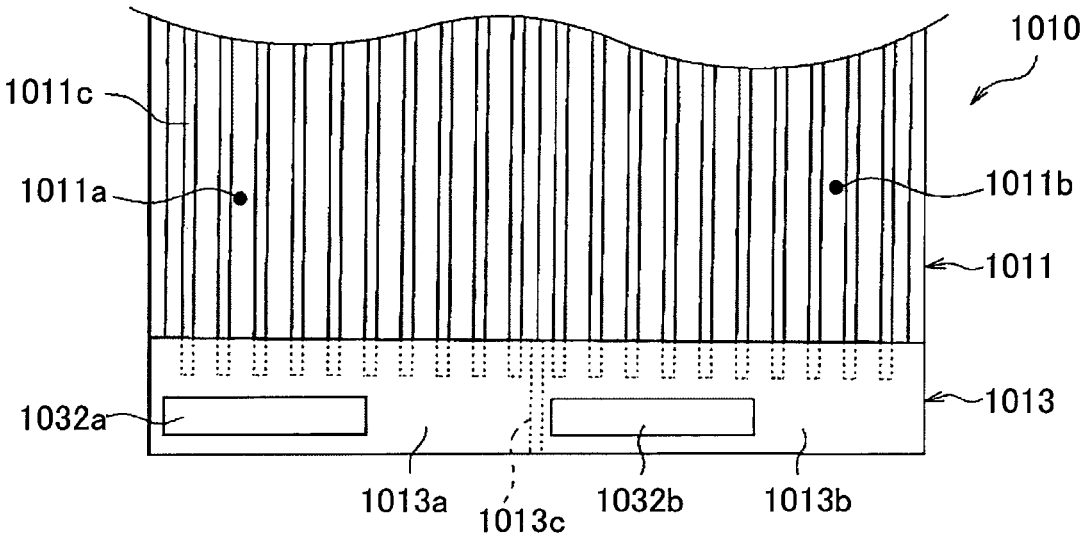
FIG. 18 is a schematic diagram illustrating part of a core unit on the upstream side of air in the refrigerant evaporator of the fifth embodiment.

FIG. 18 is a plan view of the AU core unit 1011 and the second AU tank unit 1013 taken along a line IV-IV in FIG. 17 when viewing from a downstream in the air flowing direction X. The multiple tubes 1011*c* and the second AU tank unit 1013 are illustrated. In addition, opening portions provided by the third and fourth coupling members 1032*a*, 1032*b* are illustrated. The positional relationship between the multiple tubes 1011*c* of the AU core unit 1011 and the third and fourth coupling members 1032*a*, 1032*b* is illustrated.

In the core portions 1011*a*, 1011*b* of the AU core unit 1011, the refrigerant tends to flow hardly to tubes located at the end portion side in the stacking direction from among the multiple tubes 1011*c* of the core portions 1011*a*, 1011*b* and suffer from poor refrigerant distributing properties. Specifically, in the first AU core portion 1011*a*, the refrigerant has a tendency to hardly flow to the tubes 1011*c* located near the closed end portion of the first distributing portion 1013*a* of the second AU tank unit 1013 and the tubes 1011*c* located near the partitioning member 1013*c*. In the second AU core portion 1011*b*, the refrigerant has a tendency to hardly flow to the tubes 1011*c* located near the closed end portion of the second distributing portion 1013*b* of the second AU tank unit 1013 and the tubes 1011*c* located near the partitioning member 1013*c*.

In the present embodiment, the third and fourth coupling members 1032*a*, 1032*b* are arranged so as to improve the distribution of the refrigerant to the tubes at the end portion. The third and fourth coupling members 1032*a*, 1032*b* are arranged so as to open so as to oppose the tubes located on one end side in the stacking direction from among the tubes 1011*c* of the first AU core portion 1011*a*.

Specifically, the third coupling member 1032*a* is connected to the first distributing portion 1013*a* at a position near the closed end of the second AU tank unit 1013 so that the opening portion thereof opens so as to oppose the multiple tubes 1011*c* located on one end side in the tube stacking direction. The fourth coupling member 1032*b* is connected to the second distributing portion 1013*b* at a position near the partitioning member 1013*c* so that the opening portion thereof opens to oppose the multiple tubes 1011*c* located on one end side in the tube stacking direction.

Figure 19:
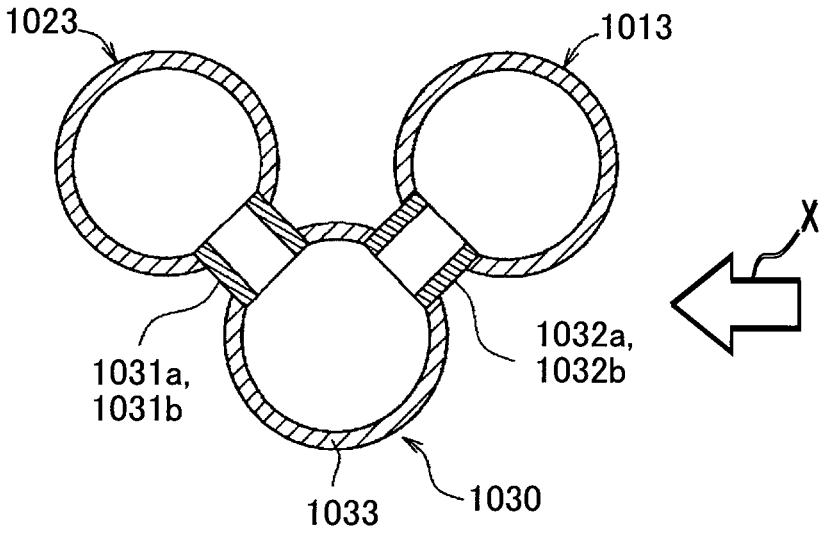
FIG. 19 is a cross-sectional view illustrating an arrangement of the multiple tank units of the fifth embodiment.

FIG. 19 is a cross-sectional view taken along a line V-V in FIG. 17. The intermediate tank unit 1033 includes a cylindrical member closed at both ends thereof. The intermediate tank unit 1033 is arranged between the second AU tank unit 1013 and the second AD tank unit 1023. The intermediate tank unit 1033 is arranged so that part of the intermediate tank unit 1033, that is, an upper portion in the drawing overlaps with the second AU tank unit 1013 and the second AD tank unit 1023 when viewing along the air flowing direction X. The intermediate tank unit 1033 is arranged so that the other part of the intermediate tank unit 1033, that is, a lower portion does not overlap with the second AU tank unit 1013 and the second AD tank unit 1023 when viewing along the air flowing direction X. In other words, the intermediate tank unit 1033 is arranged between the tank unit 1023 for collecting the refrigerant and the tank unit 1013 for distributing the refrigerant, and so as to overlap with the collecting tank unit 1023 and the distributing tank unit 1013 along the air flowing direction X. In this configuration, the collecting tank unit 1023, the distributing tank unit 1013, and the intermediate tank unit 1033 may be reduced in size.

This configuration allows the AU evaporator 1010 and the AD evaporator 1020 to be arranged in the proximity to each other in the air flowing direction X. As a consequent, increase in physical size of the refrigerant evaporator 1*b* by the provision of the intermediate tank unit 1033 may be suppressed.

Figure 20:
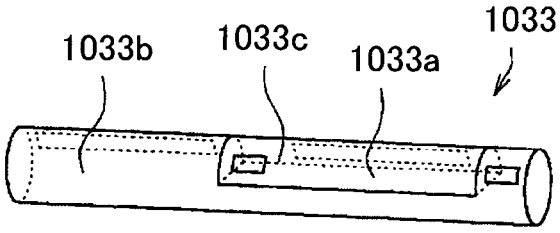
FIG. 20 is a perspective view illustrating an intermediate tank unit of the refrigerant evaporator of the fifth embodiment.
Figure 21:
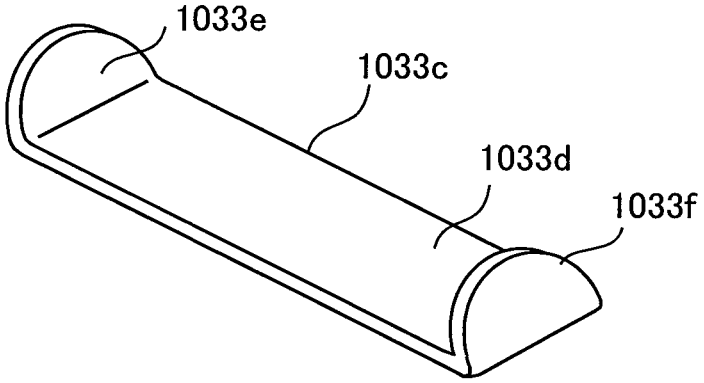
FIG. 21 is a perspective view illustrating a partitioning member of the intermediate tank unit of the fifth embodiment.

On the basis of FIG. 20 through FIG. 23, the intermediate tank unit 1033 will be described. As illustrated in FIG. 20, the partitioning member 1033*c* is arranged inside the intermediate tank unit 1033. As illustrated in FIG. 21, the partitioning member 1033*c* is a plate member having a bracket shape (angular bracket shape, angular C-shape). The partitioning member 1033*c* includes a dividing wall 1033*d* configured to divide the inside of the intermediate tank unit 1033 in the radial direction. The dividing wall 1033*d* extends in the longitudinal direction, that is, in the tube stacking direction inside the intermediate tank unit 1033. The dividing wall 1033*d* has a width corresponding to the diameter of the intermediate tank unit 1033. Semi-circular end walls 1033*e*, 1033*f* are provided at both ends of the dividing wall 1033*d*. The end walls 1033*e*, 1033*f* close the end portions of one of spaces formed by being divided by the dividing wall 1033*d*. In this configuration, the first passage

1033*a* and the second passage 1033*b* may be provided by the bracket-shaped plate member.

Figure 22:
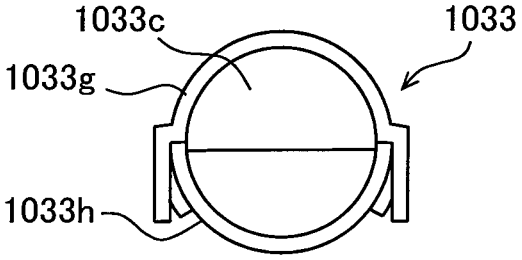
FIG. 22 is a cross-sectional view illustrating a cross section of the intermediate tank unit of the fifth embodiment.

As illustrated in FIG. 22, the intermediate tank unit 1033 includes a cylindrical member and the partitioning member 1033*c*. The cylindrical member may be provided by assembling semi-cylindrical two plate members 1033*g*, 1033*h*. The plate members 1033*g*, 1033*h* are assembled with each other and are joined to each other, whereby the cylindrical intermediate tank unit 1033 is provided. The partitioning member 1033*c* is joined inside the intermediate tank unit 1033. The partitioning member 1033*c* is arranged on the upper side in the drawing.

The partitioning member 1033*c* is provided only on parts of the cylindrical members 1033*g*, 1033*h* in the longitudinal direction so as to leave end passages 1033*m*, 1033*n*, which will be described later, inside the cylindrical members 1033*g*, 1033*h*. The partitioning member 1033*c* provides the first passage 1033*a* and the second passage 1033*b* by partitioning the inside of the cylindrical members 1033*g*, 1033*h* in the radial direction, and provides a throttle passage 1033*k*, which will be described later, inside the second passage 1033*b*. Accordingly, by partitioning the inside of the cylindrical members 1033*g*, 1033*h* by the partitioning member 1033*c*, both of the first passage 1033*a* and the second passage 1033*b* may be provided. Furthermore, by providing the partitioning member 1033*c* only on parts of the cylindrical members 1033*g*, 1033*h*, the end passages 1033*m*, 1033*n*, and the throttle passage 1033*k* may be provided.

Figure 23:
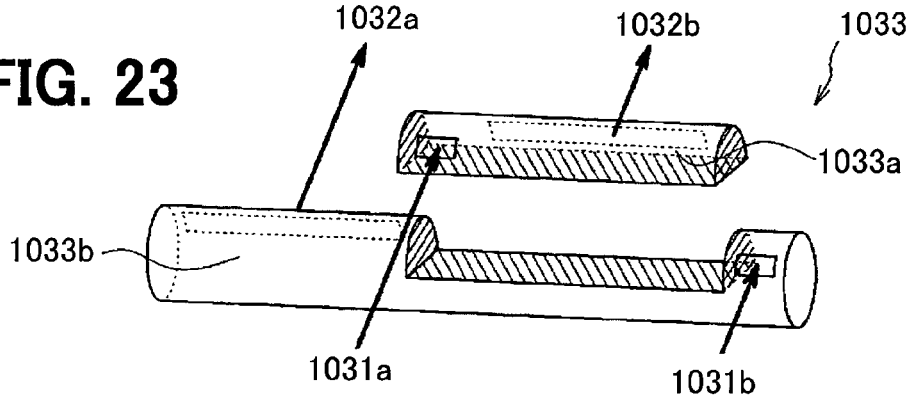
FIG. 23 is a perspective schematic diagram illustrating an exchanging unit provided by the intermediate tank unit of the fifth embodiment.

As illustrated in FIG. 23, the semi-column shaped first chamber 1033*a* is partitioned by the partitioning member 1033*c* inside the intermediate tank unit 1033. The iron dumbbell-shaped second chamber 1033*b* having cylindrical portions at both ends thereof and a semi-cylindrical space connecting the cylindrical portions is defined inside the intermediate tank unit 1033. The first chamber 1033*a* may also be referred to as the first passage 1033*a*. The second chamber 1033*b* may be referred to as the second passage 1033*b*.

The first passage 1033*a* provides a passage for leading the refrigerant from the first coupling member 1031*a* to the fourth coupling member 1032*b*. The second passage 1033*b* provides a passage for leading the refrigerant from the second coupling member 1031*b* to the third coupling member 1032*a*.

The first coupling member 1031*a*, the fourth coupling member 1032*b*, and the first passage 1033*a* of the intermediate tank unit 1033 constitute the first communicating portion. The first coupling member 1031*a* provides an inlet port of the refrigerant at the first communicating portion. The fourth coupling member 1032*b* provides an outlet port of the refrigerant at the first communicating portion.

The second coupling member 1031*b*, the third coupling member 1032*a*, and the second passage 1033*b* of the intermediate tank unit 1033 constitute the second communicating portion. The second coupling member 1031*b* provides an inlet port of the refrigerant at the second communicating portion. The third coupling member 1032*a* provides an outlet port of the refrigerant at the second communicating portion.

Figure 24:
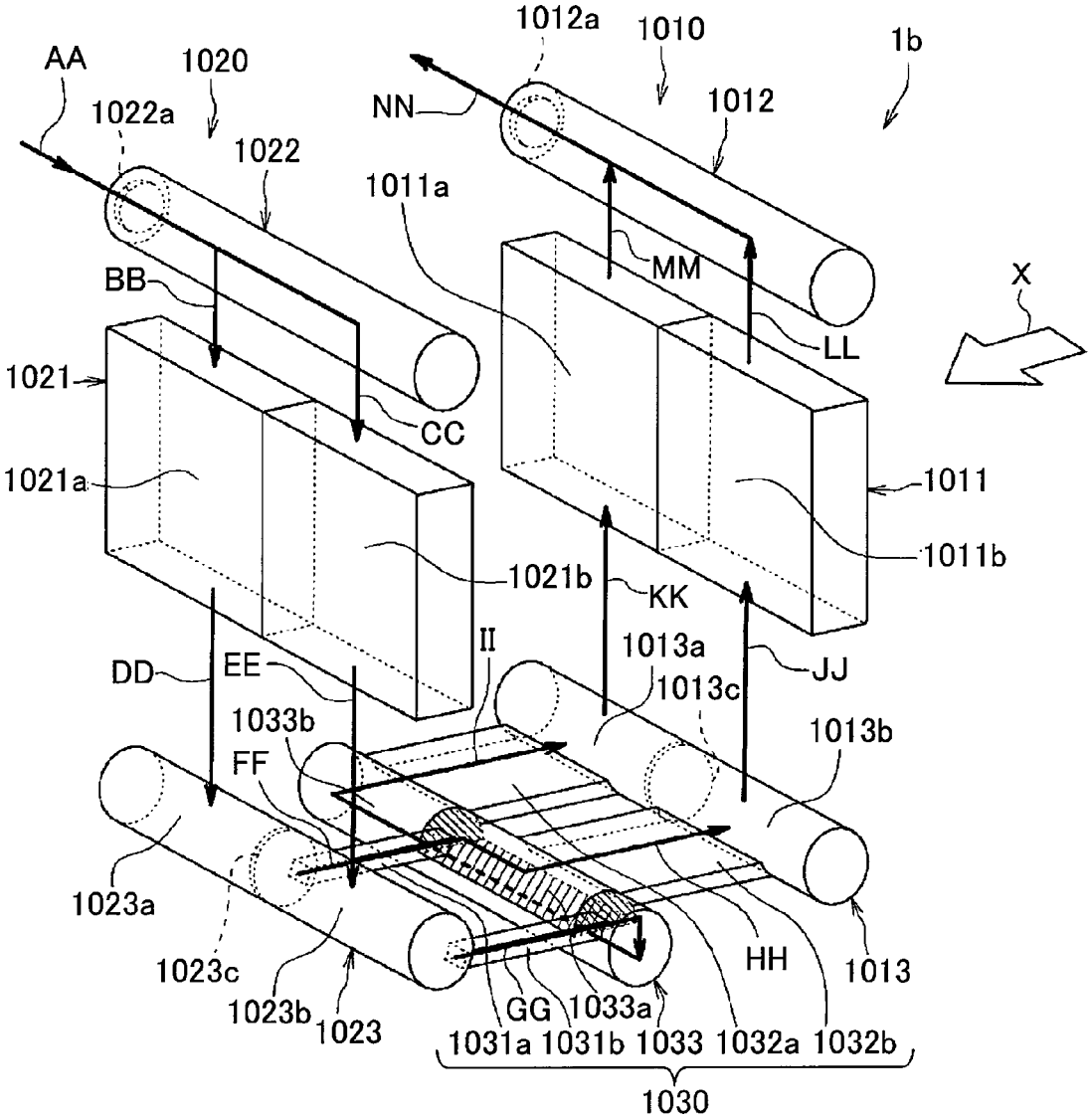
FIG. 24 is a schematic diagram illustrating a flow of the refrigerant in the refrigerant evaporator of the fifth embodiment.

FIG. 24 illustrates a flow of the refrigerant in the refrigerant evaporator 1*b*. The low-pressure refrigerant decompressed by the expansion valve, which is not illustrated, is supplied to the refrigerant evaporator 1*b* as indicated by an arrow AA. The refrigerant is leaded inside the first AD tank unit 1022 from the refrigerant inlet port 1022*a* provided at one end of the first AD tank unit 1022. The refrigerant is divided into two parts in the first AD tank unit 1022, which is a first distribution tank. The refrigerant flows downward in the first AD core portion 1021*a* as indicated by an arrow BB, and flows downward in the second AD core portion 1021*b* as indicated by an arrow CC.

The refrigerant flows downward in the first AD core portion 1021*a*, and then flows into the first collecting portion 1023*a* as indicated by an arrow DD. The refrigerant flows downward in the second AD core portion 1021*b*, and then flows into the second collecting portion 1023*b* as indicated by an arrow EE.

The refrigerant flows from the first collecting portion 1023*a* via the first coupling member 1031*a* into the first passage 1033*a* as indicated by an arrow FF. The refrigerant flows from the second collecting portion 1023*b* via the second coupling member 1031*b* into the second passage 1033*b* as indicated by an arrow GG.

The refrigerant flows from the first passage 1033*a* via the fourth coupling member 1032*b* into the second distributing portion 1013*b* as indicated by an arrow HH. The refrigerant flows from the second passage 1033*b* via the third coupling member 1032*a* into the first distributing portion 1013*a* as indicated by an arrow II.

The refrigerant flows upward from the second distributing portion 1013*b* in the second AU core portion 1011*b* as indicated by an arrow JJ. The refrigerant flows upward from the first distributing portion 1013*a* in the first AU core portion 1011*a* as indicated by an arrow KK.

The refrigerant flows from the second AU core portion 1011*b* into the first AU tank unit 1012 as indicated by an arrow LL. The refrigerant flows from the first AU core portion 1011*a* into the first AU tank unit 1012 as indicated by an arrow MM. Therefore, the refrigerant is joined into a line of flow in the first AU tank unit 1012, which corresponds to the last collecting tank. The refrigerant flows from the refrigerant outlet port 1012*a* provided at an end of the first AU tank unit 1012 out of the refrigerant evaporator 1*b* as indicated by an arrow NN. Subsequently, the refrigerant is supplied to an inlet side of the compressor, which is not illustrated.

The refrigerant evaporator 1*b* according to the present embodiment have the opening widths L13, L14 larger than the opening widths L11, L12 as illustrated in FIG. 17. The opening widths L13, L14 are opening widths of the third and fourth coupling members 1032*a*, 1032*b*, respectively, and are outlet ports of the refrigerant of the communicating portion at the exchanging unit 1030. The opening widths L11, L12 are opening widths of the first and second coupling members 1031*a*, 1031*b*, respectively, and are inlet ports of the refrigerant of the communicating portion at the exchanging unit 1030.

Therefore, in the distributing portions 1013*a*, 1013*b* of the second AU tank unit 1013, connecting portions between the tubes 1011*c* of the core portions 1011*a*, 1011*b* of the AU core unit 1011 and the second AU tank unit 1013 at the third and fourth coupling members 1032*a*, 1032*b* may be arranged close to each other in the tube stacking direction. In other words, half the multiple tubes 1011*c* of the first AU core portion 1011*a* or more is positioned near the opening of the third coupling member 1032*a*. Half the tubes 1011*c* or more is located within a range of the opening widths L13. Also, half the multiple tubes 1011*c* of the second AU core portion 1011*b* or more is located near the opening of the fourth coupling member 1032*b*. Half the tubes 1011*c* or more is positioned within a range of the opening widths L14.

Accordingly, the bias of the distribution of the liquid-phase refrigerant from the distributing portions 1013*a*, 1013*b* of the second AU tank unit 1013 to the core portions

1011*a*, 1011*b* of the AU core unit 1011 may be suppressed. Consequently, lowing of the cooling performance of the air in the refrigerant evaporator 1*b* may be suppressed.

Figure 25:
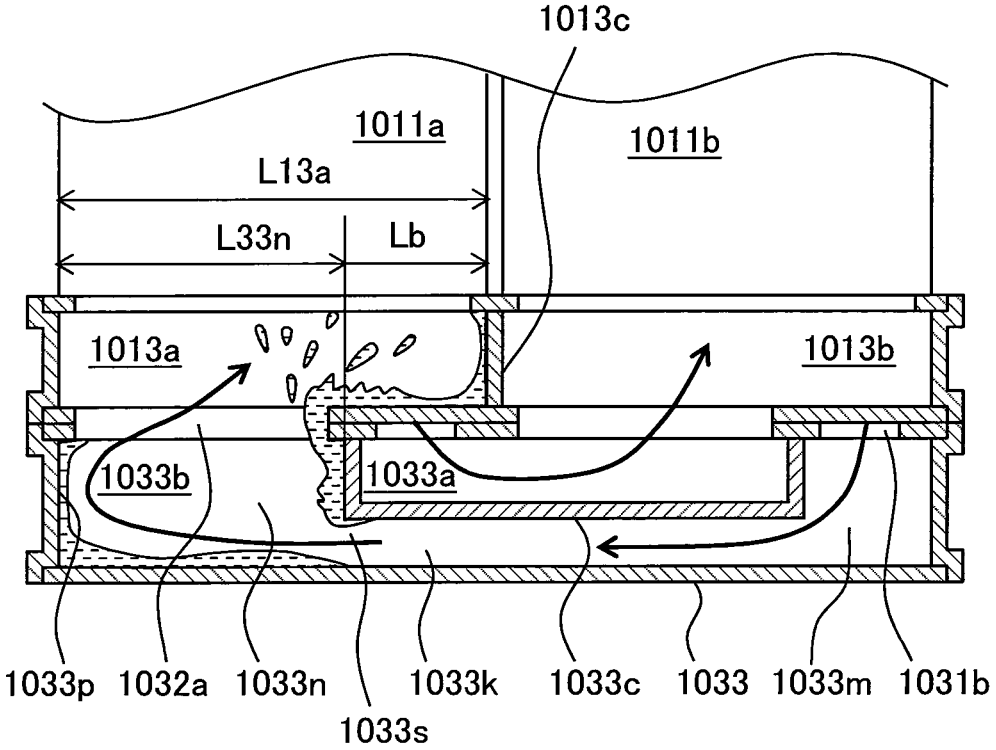
FIG. 25 is a cross-sectional schematic diagram illustrating a refrigerant flow model in the intermediate tank unit of the fifth embodiment.

FIG. 25 is a model which illustrates a behavior of the refrigerant in the second passage 1033*b*. The second passage 1033*b* includes the throttle passage 1033*k*. The throttle passage 1033*k* is provided by a semi-cylindrical passage portion partitioned by the partitioning member 1033*c*. The throttle passage 1033*k* is provided at a position away from the opening position of the third coupling member 1032*a* in the radial direction of the intermediate tank unit 1033. The position of the throttle passage 1033*k* in the radial direction of the intermediate tank unit 1033 and the position of the opening in the third coupling member 1032*a* are located on the opposite side with respect to a center axis of the intermediate tank unit 1033. In the arrangement illustrated in the drawing, the third coupling member 1032*a* is located above the intermediate tank unit 1033 and opens obliquely sideward. The throttle passage 1033*k* is defined below the intermediate tank unit 1033. The throttle passage 1033*k* is directed toward a wall surface at the end portion of the intermediate tank unit 1033 along a longitudinal direction of the intermediate tank unit 1033, and allows the refrigerant to flow toward the end portion of the intermediate tank unit 1033 in the direction of extension thereof. In other words, the outlet of the throttle passage 1033*k* is directed toward the wall surface at the end portion of the intermediate tank unit 1033 along the longitudinal direction of the intermediate tank unit 1033. At this time, the wall surface at the end portion of the intermediate tank unit 1033 may be provided substantially perpendicularly to the refrigerant flowing direction of the throttle passage 1033*k*.

The end passages 1033*m*, 1033*n* having a larger passage cross-sectional area than the throttle passage 1033*k* are provided at both ends of the throttle passage 1033*k*. The second coupling member 1031*b* is coupled to the end passage 1033*m* on the upstream side. The third coupling member 1032*a* is coupled to the end passage 1033*n* on the downstream side. The end passage 1033*n* is provided downstream of the throttle passage 1033*k*. The end passage 1033*n* includes a cross-sectional area larger than the throttle passage 1033*k* in the refrigerant flow direction in the throttle passage 1033*k*. The end passage 1033*n* communicates with the first distributing portion 1013*a*.

The cross-sectional area of the throttle passage 1033*k* in the refrigerant flowing direction in the throttle passage 1033*k* is smaller than the cross-sectional area of the end passages 1033*m*, 1033*n*. The throttle passage 1033*k* is directed toward a wall surface 1033*p* at an end portion of the end passage 1033*n*.

An enlarged portion 1033*s* configured to abruptly enlarge a cross-sectional area in the refrigerant flowing direction in the throttle passage 1033*k* is provided between the throttle passage 1033*k* and the end passage 1033*n* at a downstream end of the throttle passage 1033*k*. The enlarged portion 1033*s* abruptly decelerates the refrigerant flow. In the enlarged portion 1033*s*, the cross-sectional area in the refrigerant flowing direction is discontinuously enlarged. In the enlarged portion 1033*s*, the liquid-phase refrigerant is adhered to the wall surface and stays thereon. In the enlarged portion 1033*s*, mainly the gas-phase refrigerant is ejected straight toward the inside of the end passage 1033*n*.

The enlarged portion 1033*s* is positioned behind the partitioning member 1033*c* in the refrigerant flow direction. The enlarged portion 1033*s*, that is, the downstream side of the partitioning member 1033*c* in the refrigerant flow direction is located behind the refrigerant flow in the intermediate tank unit 1033, and hence a dead flow area, in which the flow of the refrigerant is hindered is generated. In the dead flow area, the liquid-phase refrigerant is easily accumulated.

The partitioning member 1033*c* is provided in an upper part of the intermediate tank unit 1033. The third coupling member 1032*a* also opens on the upper part of the intermediate tank unit 1033. That is, the partitioning member 1033*c* and the third coupling member 1032*a* are positioned on the side surface which is common with the intermediate tank unit 1033. In other words, the third coupling member 1032*a* is positioned on an extension of the dead flow area provided by the partitioning member 1033*c*.

The third coupling member 1032*a* is provided in the vicinity of the enlarged portion 1033*s*. The end passage 1033*n* and the first distributing portion 1013*a* communicate with each other via the third coupling member 1032*a* in the vicinity of the enlarged portion 1033*s*. The third coupling member 1032*a* is arranged between a position in the vicinity of an end wall surface 1033*p* and a position in the vicinity of the enlarged portion 1033*s* as illustrated in FIG. 25. In other words, the third coupling member 1032*a* includes an opening extending from the position in the vicinity of the wall surface 1033*p* to the position in the vicinity of the enlarged portion 1033*s*. In this configuration, the end passage 1033*n* and the first distributing portion 1013*a* communicates with each other over a wide range.

The first distributing portion 1013*a* is longer than the end passage 1033*n* in the refrigerant flowing direction in the throttle passage 1033*k*. In the drawing, a length L13a in the longitudinal direction of the cylindrical first distributing portion 1013*a* and a length L33n of the end passage 1033*n* are illustrated. The first distributing portion 1013*a* extends across both of the end passage 1033*n* and the throttle passage 1033*k*. In other words, the first distributing portion 1013*a* extends adjacently to both of the end passage 1033*n* and the throttle passage 1033*k*.

The first distributing portion 1013*a* and the end passage 1033*n* communicate with each other only partly in the longitudinal direction of the first distributing portion 1013*a* through the third coupling member 1032*a*. In other words, the third coupling member 1032*a* does not open on the outer peripheral surface of the first distributing portion 1013*a* in a range in which the first distributing portion 1013*a* and the throttle passage 1033*k* are located in parallel in an overlapped manner.

The first distributing portion 1013*a* extends to be longer than the end passage 1033*n* as illustrated in FIG. 25. The first distributing portion 1013*a* extends from the side of the end passage 1033*n* additionally by a length Lb beyond the enlarged portion 1033*s*. Within the range of the length Lb, the first distributing portion 1013*a* is positioned bedside to the first passage 1033*a* and the throttle passage 1033*k* in parallel thereto. The first distributing portion 1013*a* has a back portion away from the third coupling member 1032*a*. The back portion corresponds to the range of the length Lb. The back portion of the first distributing portion 1013*a* is a cylindrical chamber closed at an end portion thereof. The back portion of the first distributing portion 1013*a* is arranged in parallel to the throttle passage 1033*k* in an overlapped manner. The back portion of the first distributing portion 1013*a* extends from the enlarged portion 1033*s* in a direction opposite to the refrigerant flowing direction in the throttle passage 1033*k*.

In the throttle passage 1033*k*, the gas-phase refrigerant is accelerated, and the liquid-phase refrigerant is adhered to the wall surface. The liquid-phase refrigerant stays in the enlarged portion 1033*s*, and forms a thick liquid film.

The gas-phase refrigerant hits against the wall surface of the intermediate tank unit 1033 at the end portion thereof after coming out from the throttle passage 1033*k*. The gas-phase refrigerant after hitting the wall surface not only changes the direction in the direction of radius of the intermediate tank unit 1033, but also slightly reverses, and makes an attempt to flow toward the partitioning member 1013*c*. In other words, the gas-phase refrigerant is provided with a component that flows toward the partitioning member 1013*c*. Therefore, the refrigerant flows into the first distributing portion 1013*a* through the third coupling member 1032*a* while reversing slightly. The gas-phase refrigerant flows from the third coupling member 1032*a* into the first distributing portion 1013*a*. At this time, the gas-phase refrigerant flows toward the partitioning member 1013*c* in a slightly slanted manner. Consequently, in the first distributing portion 1013*a*, a flow of the refrigerant directed toward the position in the vicinity of the partitioning member 1013*c* is generated.

Furthermore, the gas-phase refrigerant coming out from the throttle passage 1033*k* flows while involving the liquid-phase refrigerant adhered on the wall surface. Part of the liquid-phase refrigerant flows on the flow of the gas-phase refrigerant in a form of airborne droplet. Part of the liquid-phase refrigerant flows along the wall surface by being pushed by the flow of the gas-phase refrigerant. The gas-phase refrigerant flows toward the partitioning member 1013*c*, and hence the liquid-phase refrigerant is also forced to flow toward the partitioning member 1013*c*. Consequently, the refrigerant flowing through the throttle passage 1033*k* is decelerated by the end passage 1033*n*, and is reversed at the wall surface 1033*p*, and hence flows toward the back portion of the first distributing portion 1013*a*.

The gas-phase refrigerant involves a large amount of the liquid-phase refrigerant in the third coupling member 1032*a*. Since the third coupling member 1032*a* opens toward the dead flow area defined by the partitioning member 1033*c*, the liquid-phase refrigerant staying in the dead flow area easily flows into the third coupling member 1032*a*. Therefore, a large amount of the liquid-phase refrigerant is involved and forced to flow in the third coupling member 1032*a*. Part of the liquid-phase refrigerant flows in the form of airborne droplets and part of the liquid-phase refrigerant flows along the wall surface in the first distribution portion 1013*a* toward the partitioning member 1013*c*. An edge of the third coupling member 1032*a* near the partitioning member 1013*c* is positioned in the vicinity of the partitioning member 1033*c*, that is, near the dead flow area. Therefore, a large amount of liquid-phase refrigerant flows from the edge located near the partitioning member 1013*c* of the third coupling member 1032*a*. Consequently, a large amount of the liquid-phase refrigerant is forced to flow toward the partitioning member 1013*c*.

Since the throttle passage 1033*k* is partitioned in the lower side of the intermediate tank unit 1033, the gas-phase refrigerant flows while raising a plume of the liquid-phase refrigerant accumulated on the bottom. Therefore, a large amount of the liquid-phase refrigerant is forced to flow toward the partitioning member 1013*c*.

In FIG. 25, the end passage 1033*n* has a relatively large cross-sectional area A33n in the refrigerant flowing direction in the throttle passage 1033*k*. In contrast, the first distributing portion 1013*a* has a relatively small cross-sectional area A13a in the refrigerant flow direction in the throttle passage 1033*k*. The cross-sectional area A33n is larger than the cross-sectional area A13a (A33n>A13a). The cross-sectional areas A33n, A13a are cross-sectional areas in a plane perpendicular to a paper plane.

In this configuration, the refrigerant coming out from the throttle passage 1033*k* is decelerated in the end passage 1033*n*, and then flows into the first distributing portion 1013*a*. With the small cross-sectional area A13a of the first distributing portion 1013*a*, a change of the distribution of the refrigerant in the first distributing portion 1013*a* is suppressed. Therefore, a desirable distribution of the liquid-phase refrigerant given in the course that the refrigerant flows from the end passage 1033*n* to the first distributing portion 1013*a* is maintained in the first distributing portion 1013*a*.

Figure 26:
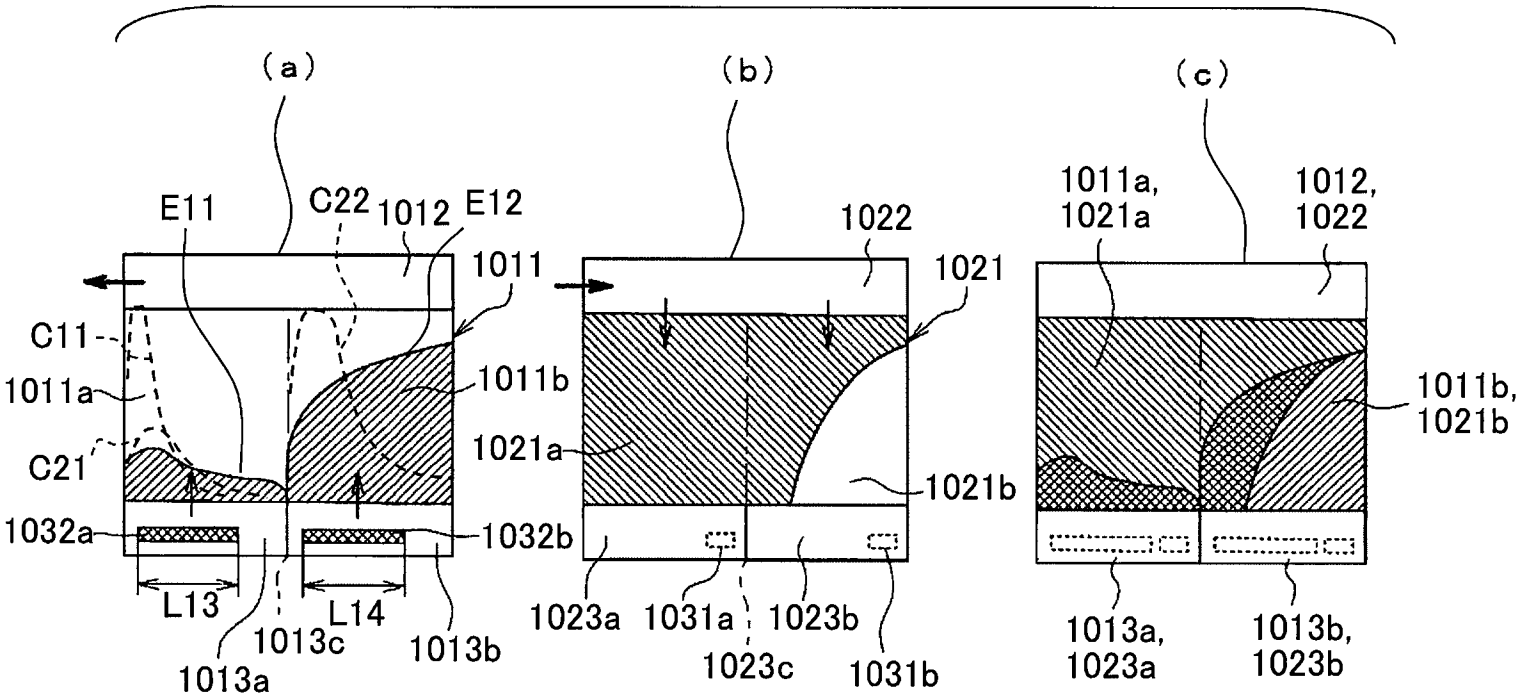
FIG. 26 is a schematic diagram illustrating a distribution of the liquid-phase refrigerant in the refrigerant evaporator of the fifth embodiment.

FIG. 26 illustrates an example of the distribution of the liquid-phase refrigerant flowing in the core units 1011, 1021 of the refrigerant evaporator 1*b* according to the present embodiment. The distribution of the liquid-phase refrigerant is indicated by a temperature distribution. A distribution (a) indicates a distribution of the liquid-phase refrigerant flowing in the AU core unit 1011. A distribution (b) indicates a distribution of the liquid-phase refrigerant flowing in the AD core unit 1021. A distribution (c) indicates a combination of the distributions of the liquid-phase refrigerant flowing in the core units 1011, 1021. In the drawing, the distribution of the liquid-phase refrigerant when viewing the refrigerant evaporator 1*b* in a direction indicated by an arrow Y in FIG. 15, that is, in a direction opposite to the air flowing direction X is illustrated. Hatched portions in the drawing indicate portions where the liquid-phase refrigerant presents.

As illustrated in the distribution (b), the distribution of the liquid-phase refrigerant flowing in the AD core unit 1021 is little affected by the opening widths L11 to L14. As illustrated by hollow portions in the distribution (b), a portion where the liquid-phase refrigerant can hardly flow is generated at a lower right portion, which is farthest from the refrigerant inlet ports 1022*a* in the second AD core portion 1021*b* and corresponds to the downstream of the refrigerant flow.

In the distribution (a), a distribution in the comparative example is illustrated by broken lines. A broken line C11 indicates a distribution in a first comparative example. In the first comparative example, the exchanging unit 1030 is not employed, and the tanks are communicated with each other by the coupling members having the same thickness. In the first comparative example, all of the opening widths L11 to L13 are the same. Furthermore, the throttle passage in the second passage 1033*b* is not provided. As illustrated by the broken line C11, the liquid-phase refrigerant is concentrated on an end of the first AU core portion 1011*a*. In addition, the liquid-phase refrigerant reaches the first AU tank unit 1012 in the vicinity of the refrigerant outlet port 1012*a*. In this situation, backflow of the liquid, which causes the liquid-phase refrigerant to flow out of the refrigerant evaporator 1*b* may occur.

Broken lines C21, C22 indicate distributions in a second comparative example. In the second comparative example, all of the opening widths L11 to L13 are the same. In the second comparative example, the throttle passage is provided in the second passage 1033*b*. In this comparative example, as illustrated by a broken line C21, a concentration of the liquid-phase refrigerant in the first AU core portion 1011*a* is alleviated. This alleviation seems to be achieved by an improvement of the liquid-phase refrigerant flow by the throttle passage provided in the second passage 1033*b*. As indicated by a broken line C22, the liquid-phase refrigerant is concentrated only on the end of the second AU core portion 1011*b* in the second AU core portion 1011*b*.

According to the present embodiment, as indicated by solid lines E11 and E12 in the distribution (a), the distribution of the liquid-phase refrigerant flowing in the AU core unit 1011 spreads widely in the tube stacking direction. As indicated by the solid line E11, the liquid-phase refrigerant in the first AU core portion 1011*a* is distributed substantially evenly over the substantially entire width of the first AU core portion 1011*a*. As indicated by the solid line E12, the liquid-phase refrigerant in the second AU core portion 1011*b* is distributed substantially evenly over the substantially entire width of the second AU core portion 1011*b*. In the present embodiment, the liquid-phase refrigerant easily flows evenly in the tube stacking direction over the entire width of the AU core unit 1011. In other words, in the refrigerant evaporator 1*b*, the bias of the distribution of the liquid-phase refrigerant to the respective core portions 1011*a*, 1011*b* of the AU core unit 1011 is suppressed. In this manner, the distribution of the liquid-phase refrigerant in the AU core unit 1011 may be improved by enlarging the opening widths L13, L14 of the third and fourth coupling members 1032*a*, 1032*b* extending in the tube stacking direction.

As illustrated in the distribution (c), according to the present embodiment, the liquid-phase refrigerant may be present over the entire part of the refrigerant evaporator 1*b*. In particular, in the second AU core portion 1011*b* and the second AD core portion 1021*b*, generation of a portion where the liquid-phase refrigerant is not present may be suppressed. The distribution of the liquid-phase refrigerant as described above suppresses the distribution of the air temperature to be cooled.

In the refrigerant evaporator 1*b*, the refrigerant absorbs sensible heat and latent heat from air by either one of the core units 1011, 1021. Accordingly, all of air passing through the refrigerant evaporator 1*b* may be sufficiently cooled. Consequently, the temperature distribution of the air passing through the refrigerant evaporator 1*b* is suppressed.

The opening width of one of the third and fourth coupling members 1032*a*, 1032*b* is set to be not smaller than half the core width of one of the core portions 1011*a*, 1011*b* to which the one of the third and fourth coupling members 1032*a*, 1032*b* is coupled. Accordingly, the bias of the distribution of the refrigerant from the distributing portions 1013*a*, 1013*b* to the AU core portions 1011*a* and 1011*b* may be sufficiently suppressed.

Figure 27:
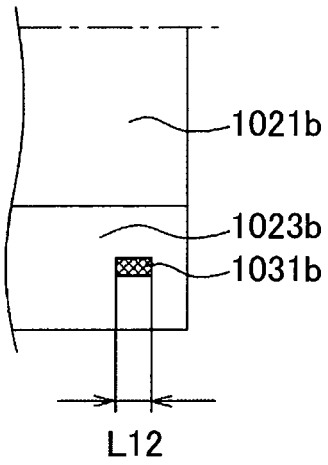
FIG. 27 is a partially enlarged view illustrating part of the intermediate tank unit of the fifth embodiment in an enlarged scale.

FIG. 27 illustrates a positional relationship between the end portion of the second collecting portion 1023*b* and the second coupling member 1031*b*. The second coupling member 1031*b* is positioned in the vicinity of the end portion of the second collecting portion 1023*b*. In the same manner, the second coupling member 1031*b* is located in the vicinity of the end portion of the intermediate tank unit 1033. The opening width L12 of the second coupling member 1031*b* is apparently smaller than the core width of the core portion 1021*b*. The cross-sectional areas of the first and second coupling members 1031*a*, 1031*b*, that is, the cross-sectional area of an inlet of the refrigerant at the exchanging unit 1030 is smaller than the cross-sectional areas of the third and fourth coupling members 1032*a*, 1032*b*, that is, the cross-sectional area of an outlet of the refrigerant at the exchanging unit 1030.

Figure 28:
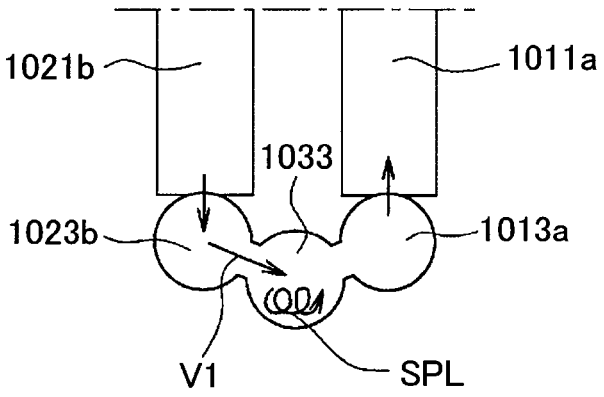
FIG. 28 is a schematic diagram illustrating the refrigerant flow model at the exchanging unit of the fifth embodiment.

FIG. 28 illustrates a refrigerant flow in the intermediate tank unit 1033. As illustrated in the drawing, the refrigerant flowing from the first and second coupling members 1031*a*, 1031*b* into the intermediate tank unit 1033 has a relatively fast flow velocity V1. The refrigerant flowing at the flow velocity V1 generates a strong agitation flow SPL in the intermediate tank unit 1033. The agitation flow SPL agitates the liquid-phase refrigerant, oil and the like flowing into the intermediate tank unit 1033 to make the same flow easily. As a consequence, the liquid-phase refrigerant, the oil and the like in the intermediate tank unit 1033 are prevented from staying therein.

An excessively heated area in which gas-phase refrigerant gasified when passing through the AD evaporator 1020 flows, that is, a superheat area may be generated in the AU evaporator 1010. Therefore, the air cooling performance in the AU evaporator 1010 tends to be lowered in comparison with the air cooling performance in the AD evaporator 1020. In the excessively heated area, the refrigerant only absorbs sensible heat from the air, and hence the air is not sufficiently cooled.

In the refrigerant evaporator 1*b*, since AU evaporator 1010 is arranged on the upstream side with respect to the AD evaporator 1020 in the air flowing direction X, the temperature difference between the refrigerant evaporating temperature at the evaporators 1010, 1020 and the air is secured, so that the blast air can be cooled efficiently.

According to the present embodiment, the distribution of the liquid-phase refrigerant of the AU core unit 1011 may be improved. In the first AU core portion 1011*a*, a concentration of the liquid-phase refrigerant to the tubes 1011*c* located at the end portion of the first distributing portion 1013*a* is alleviated, so that the liquid-phase refrigerant can be flowed also to the tubes 1011*c* located near the partitioning member 1013*c*. The improvement of the distribution of the liquid-phase refrigerant in the first AU core portion 1011*a* may be provided by the throttle passage in the second passage 1033*b* and/or the large opening width L13 of the third coupling member 1032*a*. In the second AU core portion 1011*b*, the concentration of the liquid-phase refrigerant to the tubes 1011*c* located in the vicinity of the partitioning member 1013*c* may be alleviated and the liquid-phase refrigerant may be caused to flow to the tubes 1011*c* located near the end portion of the second distributing portion 1013*b*. The improvement of the distribution of the liquid-phase refrigerant in the second AU core portion 1011*b* is provided by the large opening width L14 of the fourth coupling member 1032*b*.

Sixth Embodiment

In the sixth embodiment, an alternative configuration of the third and fourth coupling members is provided. In the present embodiment, a third and fourth coupling member 1232*a*, 1232*b* provide multiple openings. The present embodiment deforms the fifth embodiment only partly.

Figure 29:
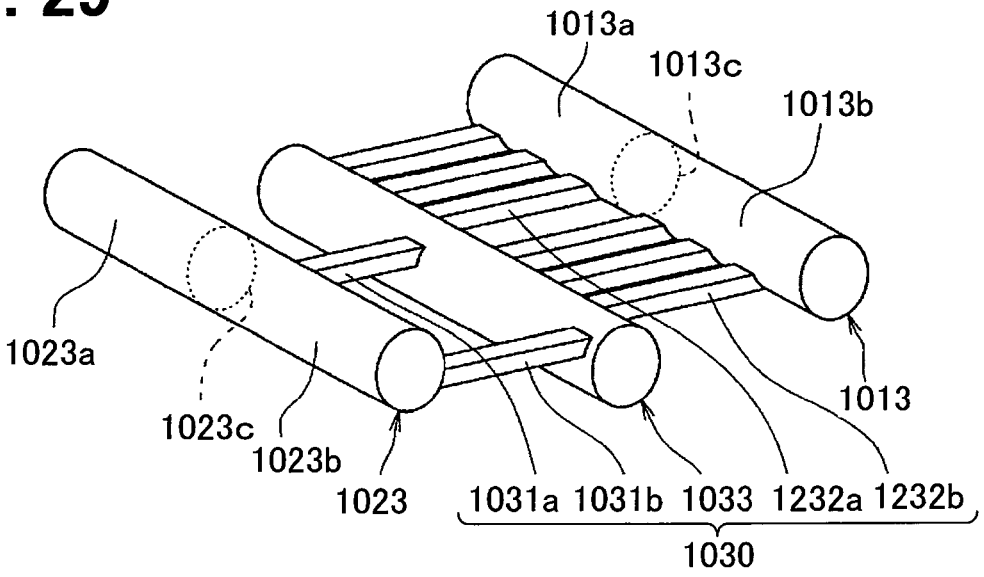
FIG. 29 is a partial perspective view of a refrigerant evaporator according to a sixth embodiment of the present disclosure.
Figure 30:
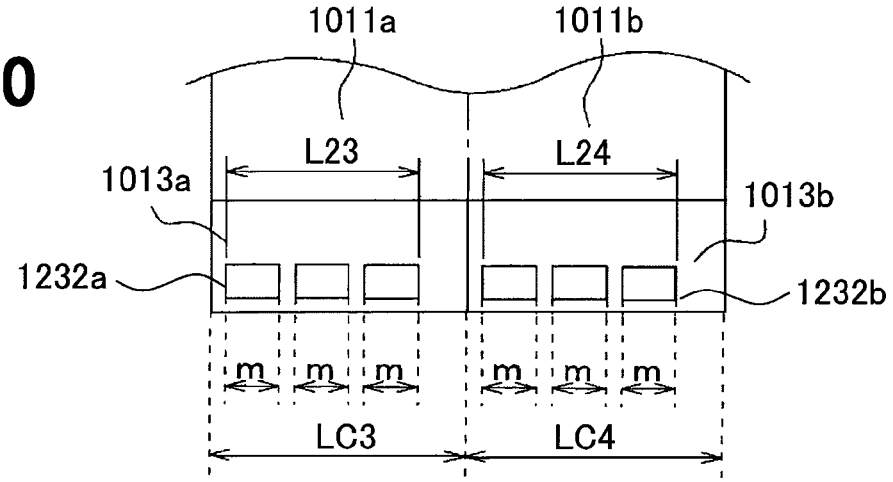
FIG. 30 is a view illustrating part of core portions on an upstream side of the air in the refrigerant evaporator of the sixth embodiment.

FIG. 29 and FIG. 30 illustrate the third and fourth coupling member 1232*a*, 1232*b* of the present embodiment. FIG. 29 is a partial perspective view corresponding only to a lower portion of FIG. 16. FIG. 30 is a plan view corresponding to FIG. 18.

In the present embodiment, multiple third coupling members 1232*a* between an intermediate tank unit 1033 and a first distributing portion 1013*a*. In the illustrated example, three of the third coupling members 1232*a* are provided. The multiple third coupling members 1232*a* are arranged close to each other along the tube stacking direction. The multiple third coupling members 1232*a* are arranged between a position in the vicinity of a wall surface 1033*p* and a position in the vicinity of an enlarged portion 1033*s*. In this case as well, the end passage 1033*n* and the first distributing portion 1013*a* communicates with each other over a wide range.

Multiple fourth coupling members 1232*b* between the intermediate tank unit 1033 and the second distributing portion 1013*b* are provided. In the illustrated example, three of the fourth coupling members 1232*b* are provided. The multiple fourth coupling members 1232*b* are arranged close to each other along the tube stacking direction.

The multiple third and fourth coupling members 1232*a*, 1232*b* each have a cylindrical member having a passage therein for allowing the refrigerant to flow therein. The multiple third and fourth coupling members 1232*a*, 1232*b* are each connected at one end thereof to the second AU tank unit 1013 and are connected at the other end thereof to the intermediate tank unit 1033.

The third and fourth coupling member 1232*a*, 1232*b* have an opening width m in the tube stacking direction. The multiple third coupling members 1232*a* provide an opening width L23 by the multiple openings close to each other. The opening width L23 is a sum of the opening widths m. The opening width L23 is not smaller than half the core width LC3 of the first AU core portion 1011*a* (LC3/2<L23 or LC3=L23). The multiple fourth coupling members 1232*b* provides an opening width L24 by the multiple openings close to each other. The opening width L24 is a sum of the opening widths m. The opening width L24 is not smaller than half the core width LC4 of the second AU core portion 1011*b* (LC4/2<L24 or LC4=L24).

According to the present embodiment, in the same manner as the fifth embodiment, the bias of the distribution of the liquid-phase refrigerant in the AU evaporator 1010 may be suppressed.

Seventh Embodiment

In a seventh embodiment, an alternative configuration of the third and fourth coupling members is provided. In the present embodiment, the third and fourth coupling members 1332*a*, 1332*b* have an opening width different from the fifth embodiment. The present embodiment deforms the fifth embodiment only partly.

Figure 31:
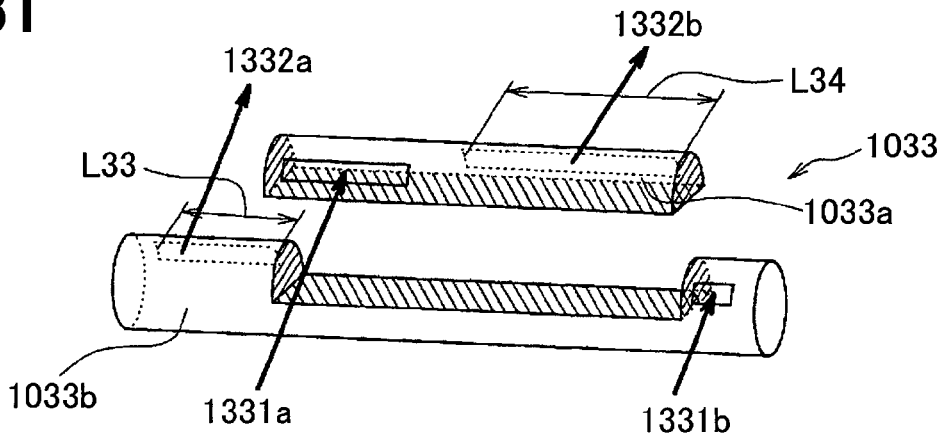
FIG. 31 is a perspective schematic diagram illustrating an exchanging unit provided by an intermediate tank unit of a refrigerant evaporator of a seventh embodiment of the present disclosure.

FIG. 31 is a perspective view illustrating two passages of the exchanging unit 1030 which corresponds to FIG. 23. In the present embodiment, an opening width L34 in the tube stacking direction of the fourth coupling member 1332*b* coupled to the second AU core portion 1011*b* is set to be longer than an opening width L33 of the third coupling member 1332*a*. In the present embodiment, the opening width of the second coupling member 1331*b* is smaller than the opening width of the first coupling member 1331*a*.

As indicated by a broken line C22 in FIG. 26, a portion where the liquid-phase refrigerant can hardly flow is generated easily in the second AU core portion 1011*b*. In order to suppress such an undesirable distribution, the opening width L34 is set to be as large as possible in the present embodiment. Accordingly, most of the tubes 1011*c* of the second AU core portion 1011*b* are positioned within a range of the opening width L34. Therefore, the bias of the distribution of the liquid-phase refrigerant in the second AU core portion 1011*b* may be suppressed.

In this manner, the opening width L34 of the third and fourth coupling members coupled to the second AU core portion 1011*b* where the bias of the distribution of the liquid-phase refrigerant tends to occur is longer than other opening widths. Consequently, the bias of the distribution of the refrigerant is effectively suppressed and lowing of the cooling performance of the air in the refrigerant evaporator 1*b* may be suppressed.

Eighth Embodiment

In the present embodiment, an alternative configuration of the exchanging unit 1030 is provided. In the present embodiment, connection and communication between the intermediate tank unit 1033 and the tank units 1013, 1023 are provided without using the coupling member. The present embodiment deforms the fifth embodiment only partly.

Figure 32:
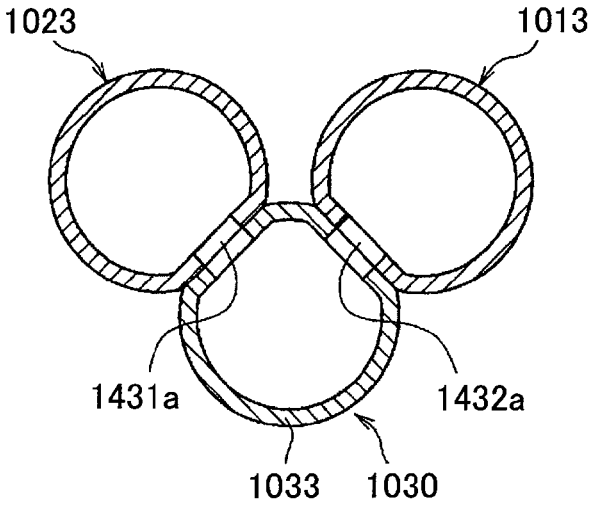
FIG. 32 is a partial cross-sectional view illustrating multiple tank units of a refrigerant evaporator according to an eighth embodiment of the present disclosure.
Figure 33:
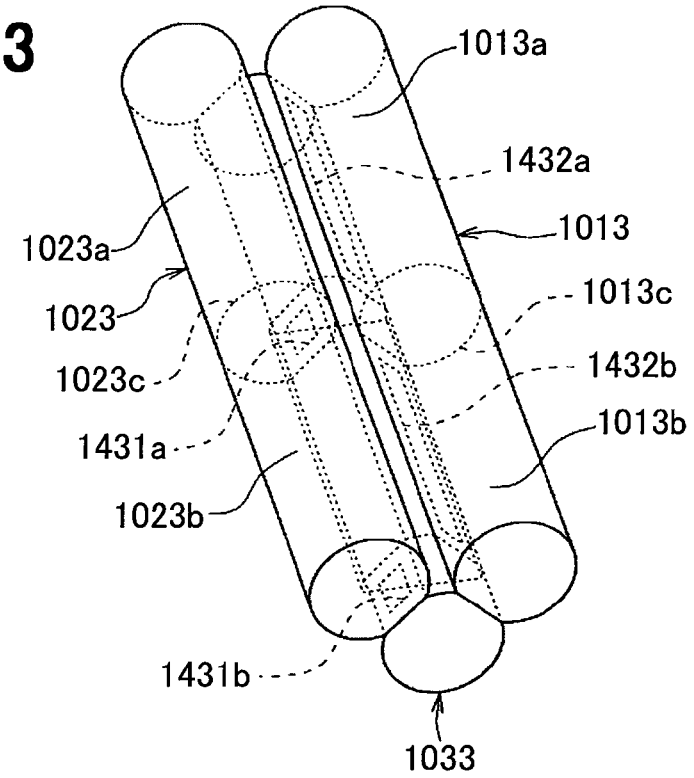
FIG. 33 is a perspective view illustrating an intermediate tank unit of the refrigerant evaporator of the eighth embodiment.
Figure 34:
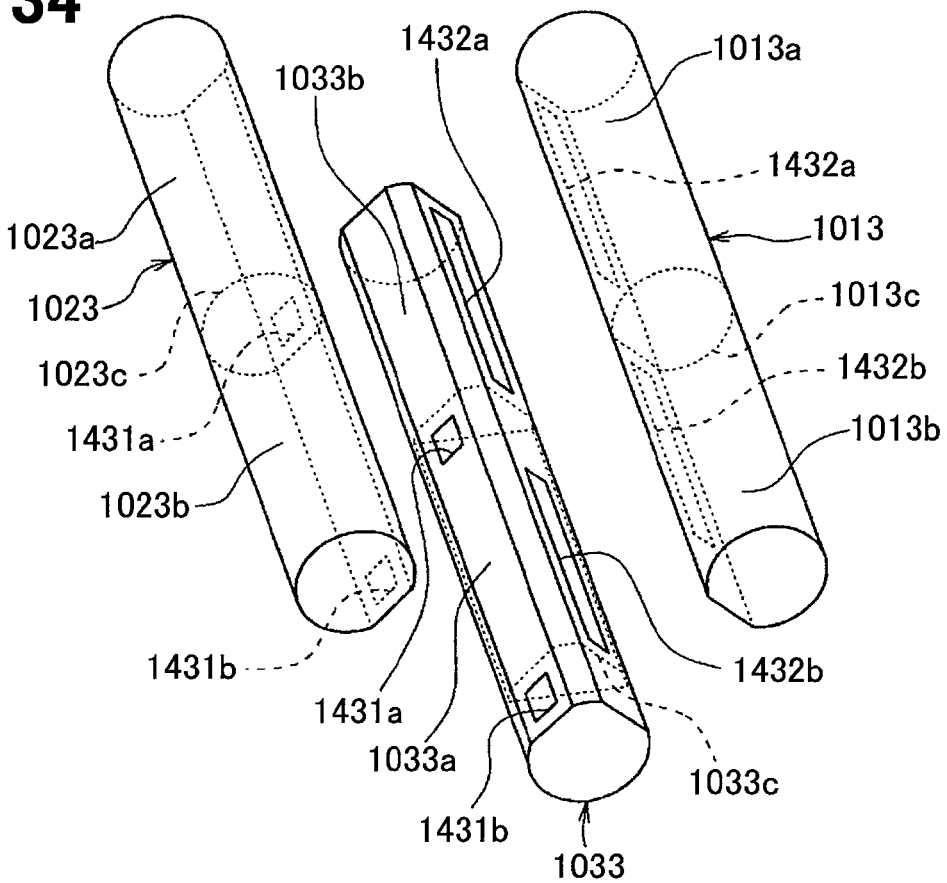
FIG. 34 is an exploded view illustrating the intermediate tank unit of the eighth embodiment.

FIG. 32 illustrates a cross section of the exchanging unit 1030 which corresponds to FIG. 5. FIG. 33 is a perspective view of the exchanging unit 1030. FIG. 34 is an exploded perspective view of the exchanging unit 1030.

In the fifth embodiment, the exchanging unit 1030 includes the first and second coupling members 1031*a*, 1031*b*, the third and fourth coupling members 1032*a*, 1032*b*, and the intermediate tank unit 1033. Instead, the present embodiment provides the exchanging unit 1030 in which the coupling members 1031*a*, 1031*b*, 1032*a*, 1032*b* are not used.

The intermediate tank unit 1033 is directly joined to the second AU tank unit 1013 and the second AD tank unit 1023. The second AD tank unit 1023 and the intermediate tank unit 1033 of the present embodiment are provided with flat surfaces at portions facing each other. The second AD tank unit 1023 and the intermediate tank unit 1033 are joined with the flat surfaces thereof in tight contact with each other. In the same manner, the second AU tank unit 1013 and the intermediate tank unit 1033 of the present embodiment are provided with flat surfaces at portions facing each other. The second AU tank unit 1013 and the intermediate tank unit 1033 are joined with the flat surfaces thereof in tight contact with each other.

Collecting portion communicating holes 1431*a*, 1431*b* on the inlet side are provided at a joint portion between the intermediate tank unit 1033 and the second AD tank unit 1023. The first collecting portion communicating hole 1431*a* provides communication between the first collecting portion 1023*a* and the first passage 1033*a*. The intermediate tank unit 1033 communicates with the first collecting portion 1023*a* via the first collecting portion communicating hole 1431*a*. The second collecting portion communicating hole 1431*b* provides communication between the second collecting portion 1023*b* and the second passage 1033*b*. The intermediate tank unit 1033 communicates with the second collecting portion 1023*b* via the second collecting portion communicating hole 1431*b*.

Distributing portion communicating holes 1432*a*, 1432*b* on the outlet side are provided at a joint portion between the intermediate tank unit 1033 and the second AU tank unit 1013. The first distributing portion communicating hole 1432*a* provides communication between the first distributing portion 1013*a* and the second passage 1033*b*. The intermediate tank unit 1033 communicates with the first distributing portion 1013*a* via the first distributing portion communicating hole 1432*a*. The second distributing portion communicating hole 1432*b* provides communication between the second distributing portion 1013*b* and the first passage 1033*a*. The intermediate tank unit 1033 communicates with the second distributing portion 1013*b* via the second distributing portion communicating hole 1432*b*.

The opening widths of the communicating holes 1432*a*, 1432*b* are larger than the opening widths of the communicating holes 1431*a*, 1431*b*. The opening width of the communicating holes 1432*a*, 1432*b* is not smaller than half the core width of the core portions 1011*a*, 1011*b* communicating therewith.

Furthermore, the communicating holes 1432*a*, 1432*b* open so as to oppose part of multiple tubes 1011*c* of the core portions 1011*a*, 1011*b* of the AU core unit 1011 located on one end side in the stacking direction.

The first passage 1033*a* of the intermediate tank unit 1033 provides a first communicating portion. The second passage 1033*b* of the intermediate tank unit 1033 provides a second communicating portion. The first collecting portion communicating hole 1431*a* of the intermediate tank unit 1033 provides an inlet for the refrigerant in the first communicating portion. The second distributing portion communicating hole 1432*b* of the intermediate tank unit 1033 provides an outlet for the refrigerant in the first communicating portion. The second collecting portion communicating hole 1431*b* of the intermediate tank unit 1033 provides an inlet for the refrigerant in the second communicating portion. The first distributing portion communicating hole 1432*a* provides an outlet of the refrigerant in the second communicating portion.

According to the present embodiment, multiple communicating portions for providing the exchanging unit 1030 may be provided by the opening portions formed in the intermediate tank unit 1033 and the tank units 1013, 1023.

Ninth Embodiment

In a ninth embodiment, an alternative configuration of the exchanging unit 1030 is provided. In the present embodiment, coupling members 1531*a*, 1531*b*, 1532*a*, 1532*b* have same opening width to each other. The present embodiment deforms the fifth embodiment only partly.

Figure 35:
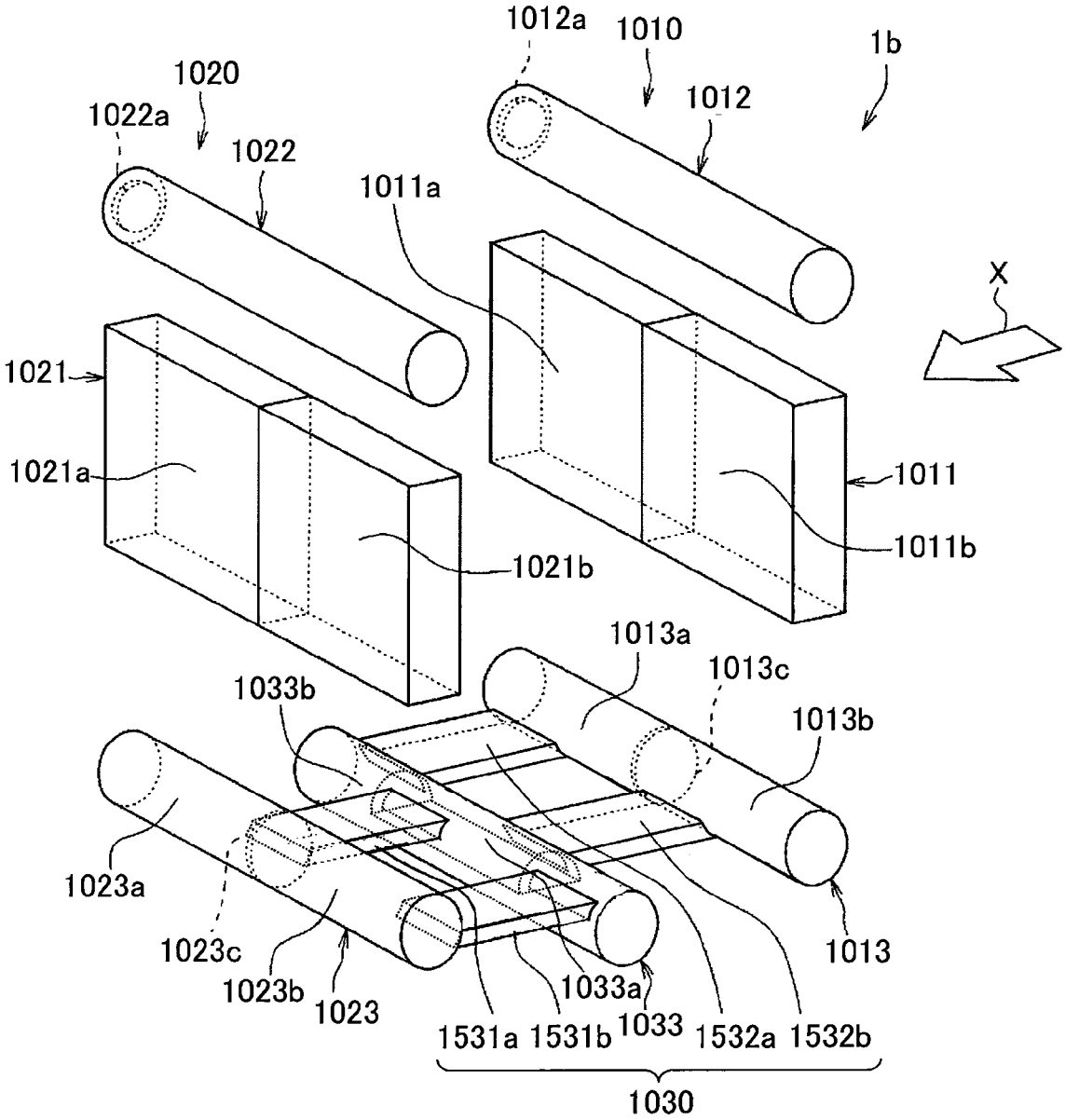
FIG. 35 is an exploded view of a refrigerant evaporator of a ninth embodiment of the present disclosure.
Figure 36:
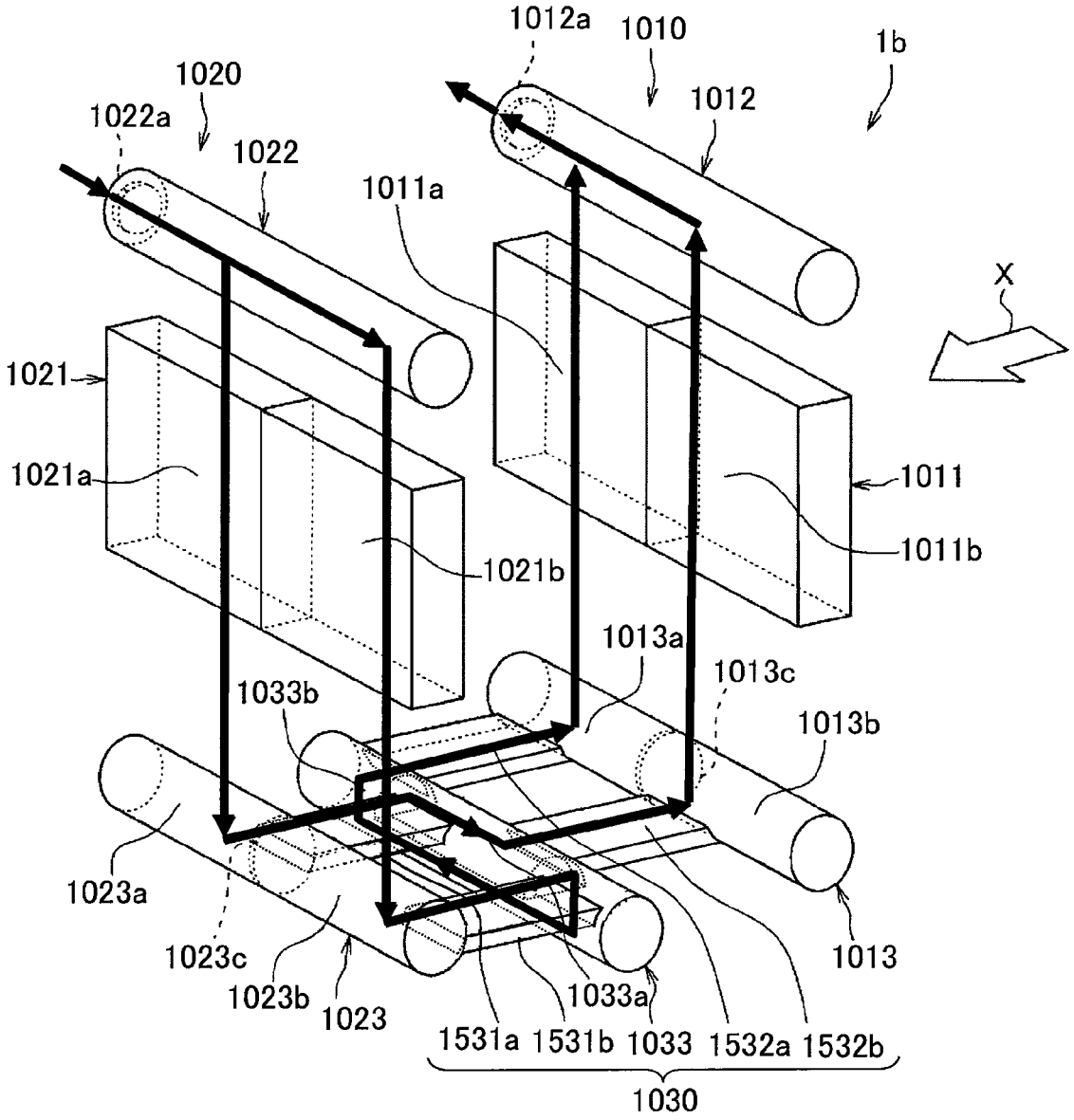
FIG. 36 is a schematic diagram illustrating a refrigerant flow in the refrigerant evaporator of the ninth embodiment.
Figure 37:
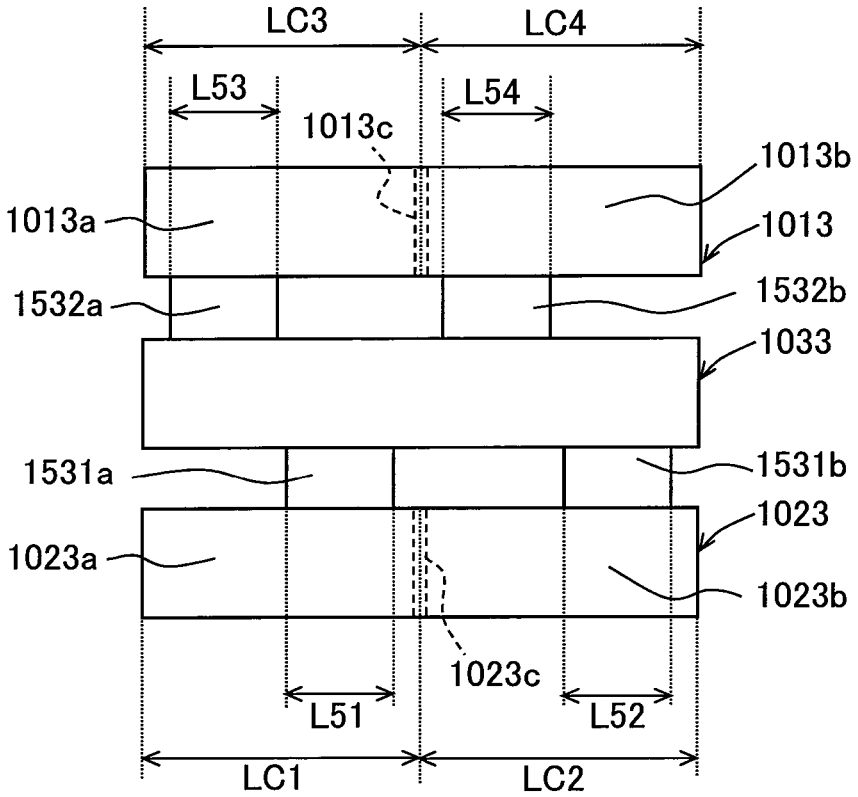
FIG. 37 is a schematic diagram illustrating an arrangement of multiple tanks in the refrigerant evaporator of the ninth embodiment.

FIG. 35 is an exploded perspective view corresponding to FIG. 16, and illustrates the refrigerant evaporator 1*b* of the present embodiment. FIG. 36 is an exploded perspective view corresponding to FIG. 24, and illustrates a flow of the refrigerant in the refrigerant evaporator 1*b*. FIG. 37 is a plan view corresponding to FIG. 17 and illustrates the exchanging unit 1030.

In the present embodiment, the coupling members 1531*a*, 1531*b*, 1532*a*, 1532*b* have the same opening width (L51=L52=L53=L54). The coupling members 1531*a*, 1531*b*, 1532*a*, 1532*b* provides the same opening area. The opening widths L51, L52 of the first and second coupling members 1531*a*, 1531*b* of the present embodiment are larger than the opening widths L11, L12 of the first and second coupling members 1031*a*, 1031*b* of the fifth embodiment, respectively. The opening widths L53, L54 of the third and fourth coupling members 1532*a*, 1532*b* are smaller than the opening widths L13, L14 of the third and fourth coupling members 1032*a*, 1032*b* of the fifth embodiment, respectively. The opening widths L53, L54 are smaller than half the core widths LC3, LC4 of the corresponding core portions 1011*a*, 1011*b* (L53≤LC3/2, L54≤LC4/2).

Figure 38:
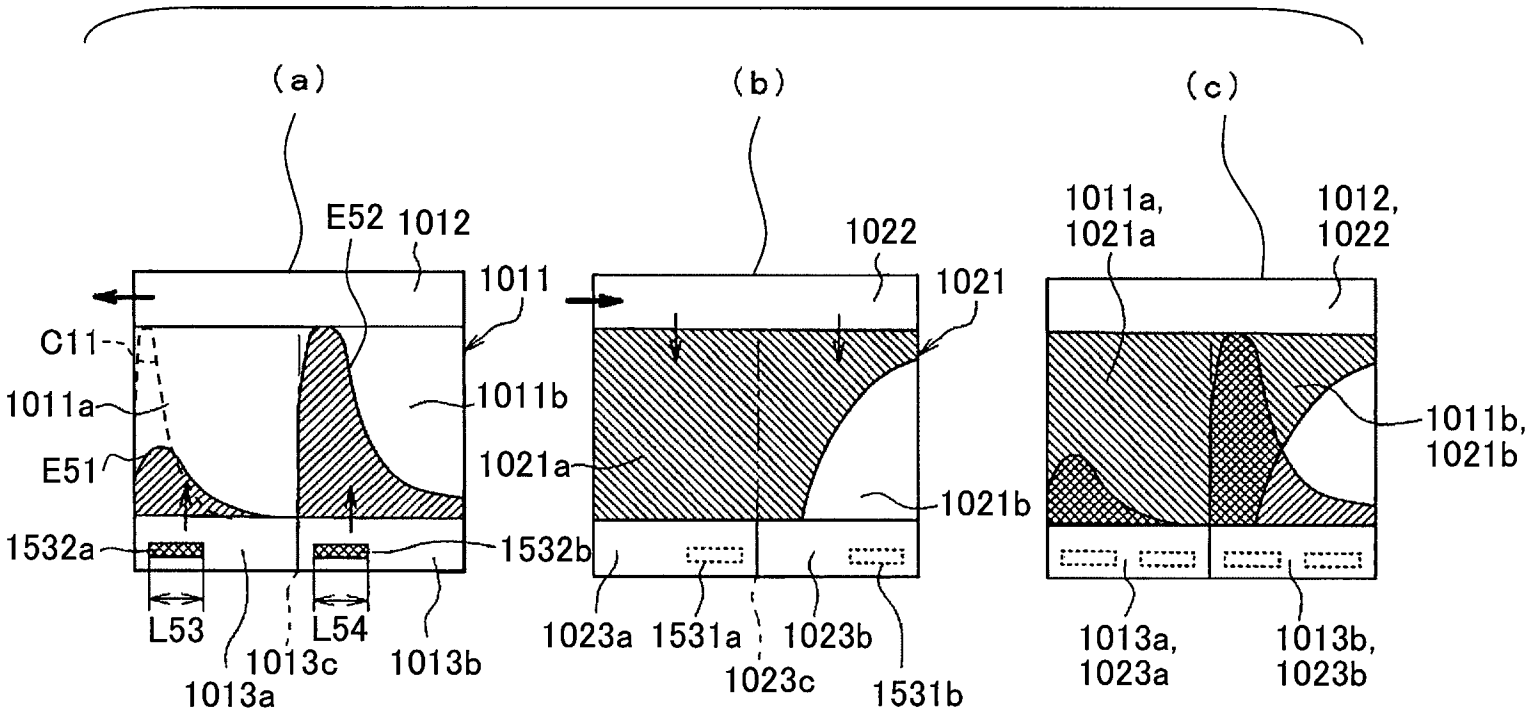
FIG. 38 is a schematic diagram illustrating distributions of a liquid-phase refrigerant in the refrigerant evaporator of the ninth embodiment.

FIG. 38 is a plan view corresponding to FIG. 26, and illustrates an example of a distribution of a liquid-phase refrigerant of the present embodiment. As illustrated in the drawing, in the AU core portions 1011*a*, 1011*b*, the liquid-phase refrigerant flows rather easily to portions where the third and fourth coupling members 1532*a*, 1532*b* are provided, and the liquid-phase refrigerant flows rather hardly in the portions where the third and fourth coupling members 1532*a*, 1532*b* are not provided. Therefore, as illustrated in the distribution (c), in the present embodiment, a portion where the liquid-phase refrigerant can hardly flow is generated in part of the refrigerant evaporator 1*b*.

However, in the first AU core portion 1011*a*, the concentration of the liquid-phase refrigerant is alleviated, and distribution characteristics E51 in which the liquid-phase refrigerant is widely distributed are obtained. The liquid-phase refrigerant does not reach the first AU tank unit 1012 in the first AU core portion 1011*a*. Consequently, the liquid-phase refrigerant is suppressed from flowing out to the vicinity of the refrigerant outlet port 1012*a*.

In the second AU core portion 1011*b*, the liquid-phase refrigerant concentrates on the vicinity of the partitioning member 1013*c*. However, since the second AU core portion 1011*b* is apart from the refrigerant outlet port 1012*a*, a probability of the liquid backflow is low.

Figure 39:
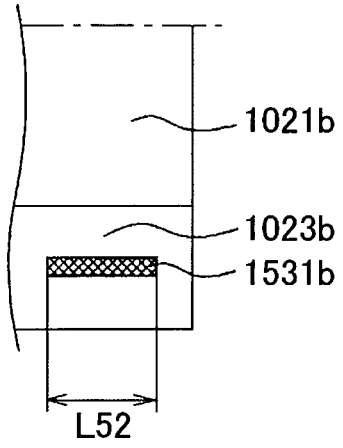
FIG. 39 is a partially enlarged plan view illustrating part of an intermediate tank unit of the refrigerant evaporator of the ninth embodiment in an enlarged scale.
Figure 40:
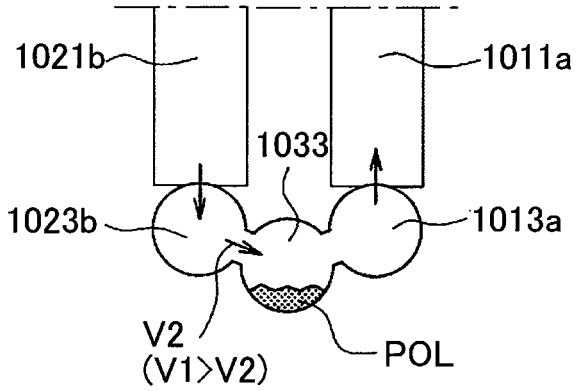
FIG. 40 is a schematic cross-sectional view illustrating a refrigerant flow model in the exchanging unit of the refrigerant evaporator of the ninth embodiment.

FIG. 39 is a plan view corresponding to FIG. 27. FIG. 40 is a cross-sectional view corresponding to FIG. 28. In the present embodiment, the opening portion provided by the second coupling member 1531*b* is relatively large. Therefore, a flow velocity V6 of the refrigerant flowing from the second coupling member 1531*b* to the intermediate tank unit 1033 is relatively low. For example, the flow velocity V6 of the present embodiment is lower than the flow velocity V1 of the fifth embodiment (V1>V6). Therefore, the liquid-phase refrigerant, oil, and the like tend to stay in the intermediate tank unit 1033. For example, a liquid trap POL of the liquid-phase refrigerant is generated easily.

In the present embodiment as well, the flow of the refrigerant in the same manner as described in conjunction with FIG. 25 is obtained in the intermediate tank unit 1033. Therefore, the liquid-phase refrigerant may be flowed toward the partitioning member 1013*c*. Consequently, a concentration of the liquid-phase refrigerant in the vicinity of the refrigerant outlet port 1012*a* may be suppressed.

Figure 41:
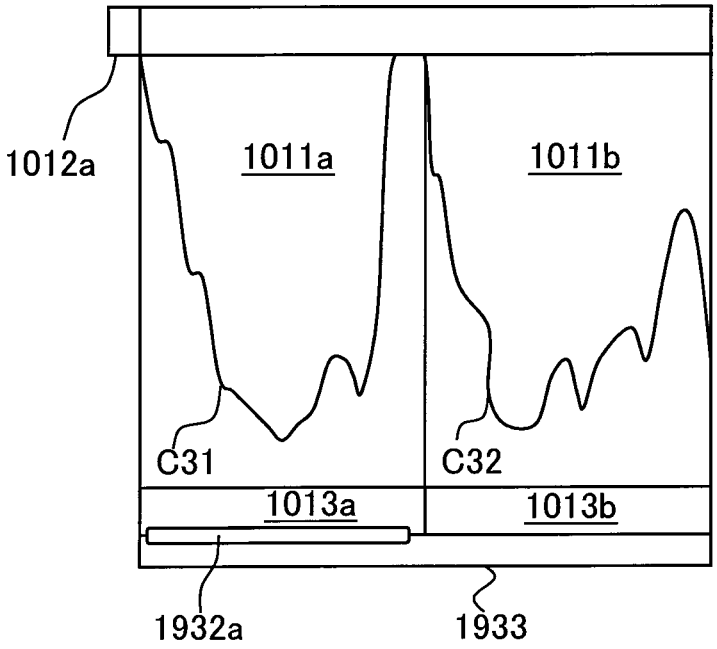
FIG. 41 is a schematic diagram illustrating an example of a distribution of liquid-phase refrigerant in the refrigerant evaporator of a comparative example.

FIG. 41 is an example of a distribution of a liquid-phase refrigerant according to a third comparative example. In the third comparative example, the second collecting portion 1023*b* and the first distributing portion 1013*a* communicate with each other by a tube 1933 having a constant thickness, without employing the exchanging unit 1030. A slit-like communicating hole 1932*a* is provide between the tube 1933 and the first distributing portion 1013*a*. A communicating hole 1932*a* has a wide opening width substantially corresponds to the core width of the first AU core portion 1011*a*. Therefore almost all the tubes 1011*c* of the first AU core portion 1011*a* are positioned within the range of the opening width of the communicating hole 1932*a*.

In the third comparative example, as illustrated by a solid line C31, the liquid-phase refrigerant concentrates on an end portion of the first AU core portion 1011*a*. In particular, in the vicinity of the refrigerant outlet port 1012*a*, the liquid-phase refrigerant easily concentrates. Therefore, the liquid-phase refrigerant reaches the first AU tank unit 1012, and hence may be flowed out from the refrigerant outlet port 1012*a*. As indicated by a solid line C32, the liquid-phase refrigerant can easily concentrate on the end portion even in the second AU core portion 1011*b*.

Figure 42:
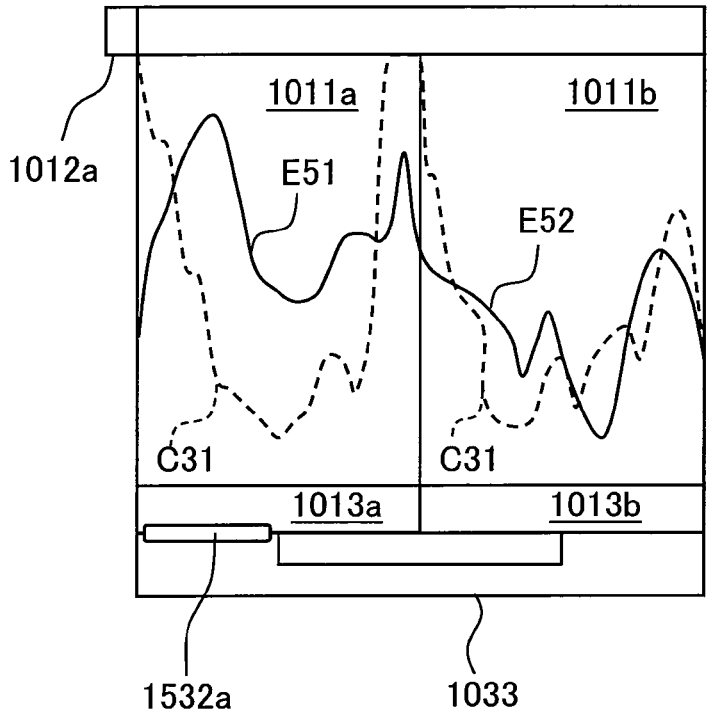
FIG. 42 is a schematic diagram illustrating the distribution of the liquid-phase refrigerant in the refrigerant evaporator of the ninth embodiment.

FIG. 42 illustrates an example of the distribution of the liquid-phase refrigerant according to the present embodiment. According to the present embodiment, a concentration of the liquid-phase refrigerant in the first AU core portion 1011*a* is alleviated as indicated by a solid line E51. The liquid-phase refrigerant is widely distributed entirely over the core width of the first AU core portion 1011*a* without concentrating in the end portion of the first AU core portion 1011*a*. As indicated by a solid line E52, in the second AU core portion 1011*b*, no significant difference is observed from the third comparative example.

As described thus far, according to the present embodiment, since the throttle passage 1033*k* is provided in the second passage 1033*b*, the flow of the refrigerant is accelerated. The flow of the refrigerant is reversed at the end portion of the intermediate tank unit 1033, and is provided with a flowing component directed toward the partitioning member 1013*c*. Consequently, the refrigerant can be flowed toward the portion in the vicinity of the partitioning member 1013*c* at which the third coupling member 1532*a* is not opened. In addition, an arrangement in which the liquid-phase refrigerant can easily flow from the outlet of the throttle passage 1033*k* toward the vicinity of the partitioning member 1013*c* is provided. Consequently, the distribution of the liquid-phase refrigerant in the first AU core portion 1011*a* may be improved.

Tenth Embodiment

In a tenth embodiment, an alternative configuration of the partitioning member 1033*c* is provided. In the present embodiment, a bobbin-shaped partitioning member 1633*c* is employed. The present embodiment deforms the fifth embodiment only partly.

Figure 43:
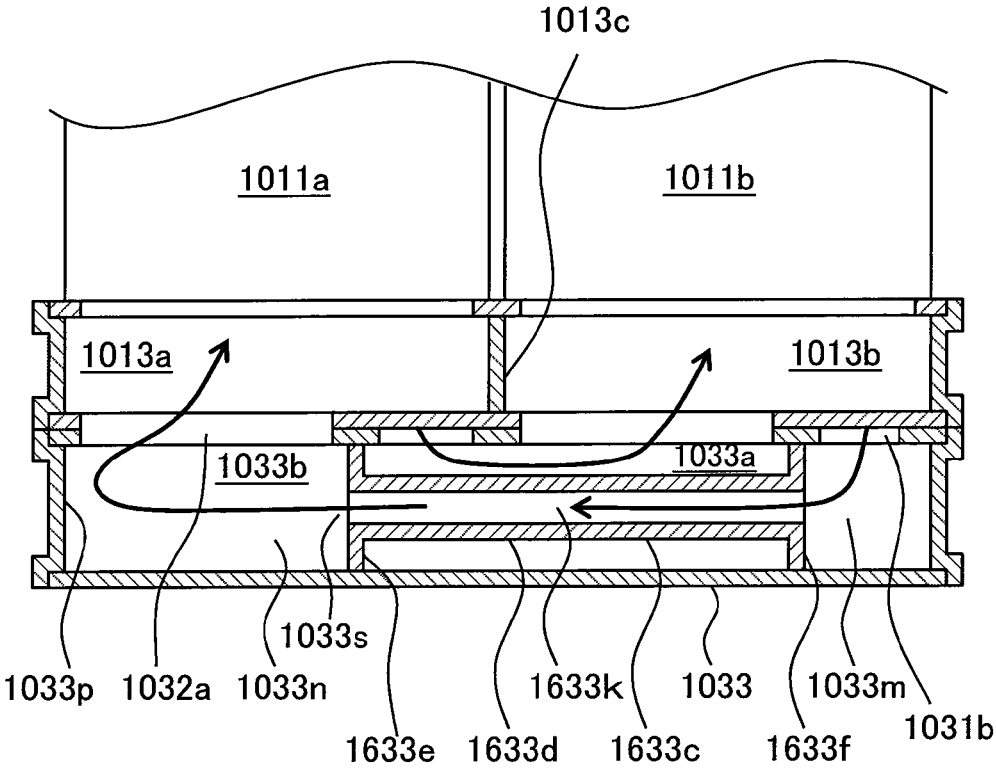
FIG. 43 is a cross-sectional schematic diagram illustrating part of the refrigerant evaporator according to a tenth embodiment of the present disclosure.

FIG. 43 is a cross-sectional view corresponding to FIG. 25, and illustrates the refrigerant evaporator 1*b* of the present embodiment. The intermediate tank unit 1033 includes the bobbin-shaped partitioning member 1633*c* stored therein. The partitioning member 1633*c* includes a tubular portion 1633*d*, and flange portions 1633*e*, 1633*f* provided at both ends thereof. A throttle passage 1633*k* is provided in the tubular portion 1633*d*. A ring-shaped first passage 1033*a* is defined outside the tubular portion 1633*d*. In the present embodiment, the same effects and advantages as the fifth embodiment are achieved.

Although the preferred embodiments of a disclosure disclosed herein have been described, the disclosed disclosure is not limited to the embodiments described above, and may be implemented in variously deformed forms as described below. The structures of the above-described embodiments are examples only, and the technical scope of the present disclosure is not limited to the described range.

Although the opening widths of the third and fourth coupling members 1032*a*, 1032*b* are set to be larger than the opening widths of the first and second coupling members 1031*a*, 1031*b* in the above-described embodiments, the disclosure is not limited thereto. For example, only the opening width of one of the third and fourth coupling members 1032*a*, 1032*b* may be set to be larger than the opening width of corresponding one of the first and second coupling members 1031*a*, 1031*b*. For example, L13>L11, or L14>L12 may be employed.

As described in the above-described embodiments, the opening widths of the third and fourth coupling members 1032*a*, 1032*b* are preferably not smaller than half the core width of the AU core portions 1011*a*, 1011*b* coupled correspondingly. However, if the opening widths of the third and fourth coupling members 1032*a*, 1032*b* are set to be larger than the opening widths of the first and second coupling members 1031*a*, 1031*b*, the relationship with respect to the core widths is not limited to the above-described conditions.

In the above-described embodiment, the intermediate tank unit 1033 is employed. Instead, a configuration in which the intermediate tank unit 1033 is eliminated, and the corresponding coupling members 1031*a*, 1031*b*, 1032*a*, 1032*b* may be connected directly.

In the above-described embodiments, the first AU core portion 1011*a* and the first AD core portion 1021*a* are completely overlapped and the second AU core portion 1011*b* and the second AD core portion 1021*b* are completely overlapped along the air flowing direction X. However, the relationship of the multiple core portions provided in the refrigerant evaporator 1*b* is not limited to those in the above-described embodiments. For example, the upstream core portion and the downstream core portion may be overlapped partly with each other in the air flowing direction X. For example, the first AU core portion 1011*a* and the first AD core portion 1021*a* may be overlapped at least partly. The second AU core portion 1011*b* and the second AD core portion 1021*b* may be overlapped at least partly.

As described in the above-described embodiments, the AU evaporator 1010 is preferably arranged upstream side of the AD evaporator 1020 in the air flowing direction X. Instead, however, the AU evaporator 1010 may be arranged downstream of the AD evaporator 1020 in the air flowing direction X.

In the above-described embodiments, an example in which the core units 1011, 1021 includes the multiple the tubes 1011*c*, 1021*c* and the fins 1011*d*, 1021*d* has been described. However, the configuration of the core portion for the heat exchange is not limited to the illustrated configuration. For example, a configuration in which the core units 1011, 1021 includes the multiple tubes 1011*c*, 1021*c*, but the fins 1011*d*, 1021*d* are eliminated is also applicable. In the case where the respective core units 1011, 1021 includes the multiple tubes 1011*c*, 1021*c* and the fins 1011*d*, 1021*d*, the fins 1011*d*, 1021*d* are not limited to the corrugate fins, but may be plate fins.

In the above-described embodiments, although the example in which the refrigerant evaporator 1*b* is applied to a refrigerating cycle of the vehicle air-conditioning apparatus has been described, the present disclosure is not limited thereto. For example, the refrigerant evaporator 1*b* may be applied to the refrigerating cycle used in a water heater or the like.

In the embodiments described above, the communicating portion provides an elongated slit-shaped or a rectangular shaped opening. Instead, the communicating portion may provide a circular-shaped, or an oval-shaped opening. For example, instead of the third and fourth coupling members 1232*a*, 1232*b*, a cylindrical tube may be used.

In the above-described embodiments, the case in which the air flowing direction X is horizontal is exemplified. Instead, the air flowing direction X may be set to be perpendicular or oblique. Correspondingly, the arrangement of the refrigerant evaporator 1*b* may be changed so that the two core portions 1011*a*, 1011*b* are arranged with respect to the air flow. For example, the refrigerant evaporator 1*b* may be arranged so that the two core portions 1011*a*, 1011*b* are arranged vertically, or obliquely with respect to the air flow. For example, the refrigerant evaporator 1*b* may be arranged so that the refrigerant flows obliquely or horizontally. For example, the refrigerant evaporator 1*b* may be arranged so that the exchanging unit 1030 is positioned above or on the side. Description about up, down, left, right, front, and back in the above-described embodiments is only an example, and the refrigerant evaporator 1*b* is not limited to the exemplified arrangement and may be applied to various arrangements.

In the above-described embodiment, the intermediate tank unit is arranged parallel to the first distributing portion. However, the intermediate tank unit may be arranged so that the longitudinal direction of the intermediate tank unit and the longitudinal direction of the first distributing portion intersects each other. For example, the intermediate tank unit 1033 may be arranged so that the longitudinal direction thereof is slightly inclined with respect to the longitudinal directions of the second AU tank unit 1013 and the second AD tank unit 1023.

Also, the fifth to tenth embodiments may be combined with the first to fourth embodiments as needs. In this configuration, the bias of the refrigerant distribution in the core portion is further suppressed.

What is claimed is:

1. A refrigerant evaporator in which heat exchange is performed between a subject-to-cooling fluid and a refrigerant, the refrigerant evaporator comprising:

a first core portion having a plurality of tubes in which the refrigerant flows, a heat exchange being performed between a part of the subject-to-cooling fluid and a part of the refrigerant in the first core portion;

a second core portion having a plurality of tubes in which the refrigerant flows, a heat exchange being performed between another part of the subject-to-cooling fluid and another part of the refrigerant in the second core portion;

a third core portion having a plurality of tubes in which the refrigerant flows, and being disposed to overlap at least partly with the first core portion in a flow direction of the subject-to-cooling fluid, a heat exchange being performed between another part of the subject-to-cooling fluid and another part of the refrigerant in the third core portion;

a fourth core portion having a plurality of tubes in which the refrigerant flows, and being disposed to overlap at least partly with the second core portion in the flow direction of the subject-to-cooling fluid, a heat exchange is performed between a part of the subject-to-cooling fluid and a part of the refrigerant in the fourth core portion;

a first collecting portion provided at refrigerant-downstream ends of the plurality of tubes of the first core portion, the refrigerant being collected in the first collecting portion after passing through the first core portion;

a second collecting portion provided at refrigerant-downstream ends of the plurality of tubes of the second core portion, the refrigerant being collected in the second collecting portion after passing through the second core portion;

a first distributing portion provided at a refrigerant-upstream end of the third core portion, the refrigerant being distributed from the first distributing portion to the plurality of tubes of the third core portion;

a second distributing portion provided at a refrigerant-upstream end of the fourth core portion, the refrigerant being distributed from the second distributing portion to the plurality of tubes of the fourth core portion; and an intermediate tank unit having a first passage through which the first collecting portion and the second distributing portion communicate with each other, and a second passage through which the second collecting portion and the first distributing portion communicate with each other, wherein the intermediate tank unit extends along the first distributing portion, the second passage includes:

a throttle passage through which the refrigerant flows toward an end portion of the intermediate tank unit in an extending direction of the intermediate tank unit; and an end passage provided downstream of the throttle passage, the end passage having a cross-sectional area larger than that of the throttle passage with respect to a refrigerant flow in the throttle passage, and communicating with the first distributing portion, the first distributing portion is longer than the end passage in a flow direction of the refrigerant flowing in the throttle passage and extends adjacently to both the end passage and the throttle passage, and the throttle passage is directed toward a wall surface of the end portion in the end passage in the extending direction.

2. The refrigerant evaporator according to claim 1, further comprising an enlarged portion provided between the throttle passage and the end passage, and abruptly enlarged in cross-sectional area with respect to the refrigerant flow in the throttle passage, wherein the end passage and the first distributing portion communicate with each other through at least one communicating portion provided in a vicinity of the enlarged portion.

3. The refrigerant evaporator according to claim 2, wherein the at least one communicating portion is disposed across a region between a vicinity of the wall surface of the end portion and the vicinity of the enlarged portion.

4. The refrigerant evaporator according to claim 3, wherein the number of the at least one communicating portion is one, and the one communicating portion includes an opening extending from the vicinity of the wall surface of the end portion to the vicinity of the enlarged portion.

5. The refrigerant evaporator according to claim 3, wherein the number of the at least one communicating portion is plural, and the plurality of the communicating portions are disposed across the region between the vicinity of the end wall surface and the vicinity of the enlarged portion.

6. The refrigerant evaporator according to claim 1, further comprising an outlet collecting portion provided at a downstream end of the plurality of tubes of the third core portion in the refrigerant flow direction, the refrigerant being collected in the outlet collecting portion after passing through the third core portion, the outlet collecting portion including an outlet for the refrigerant at an end portion in the flow direction of the refrigerant flowing in the throttle passage.

7. The refrigerant evaporator according to claim 1, wherein a cross-sectional area of the end passage with respect to the refrigerant flow in the throttle passage is larger than a cross sectional area of the first distributing portion with respect to the refrigerant flow in the throttle passage.

8. The refrigerant evaporator according to claim 1, wherein the intermediate tank unit includes:

a cylindrical member; and a partitioning member partitioning an internal space of the cylindrical member, the partitioning member extends in the cylindrical member in a longitudinal direction of the cylindrical member, the end passage is provided in the cylindrical member and located between the partitioning member and the end portion of the intermediate tank unit in the longitudinal direction, and the partitioning member extends in a radial direction of the cylindrical member to partition the inside of the cylindrical member into the first passage and the throttle passage of the second passage.

9. The refrigerant evaporator according to claim 8, wherein the partitioning member is provided inside the cylindrical member, the partitioning member includes a partitioning wall partitioning between the first passage and the second passage, and the partitioning wall is arranged substantially parallel to a wall of the cylindrical member in the longitudinal direction of the cylindrical member.

10. The refrigerant evaporator according to claim 1, further comprising:

a series of collecting tank units including the first collecting portion and the second collecting portion; and a series of distributing tank units including the first distributing portion and the second distributing portion, wherein the intermediate tank unit is arranged between the series of collecting tank units and the series of distributing tank units, and the intermediate tank unit is located to be overlapped with the series of collecting tank units and with the series of distributing tank units in the flow direction of the subject-to-cooling fluid.

11. The refrigerant evaporator according to claim 1, further comprising:

a first evaporator and a second evaporator disposed upstream of the first evaporator in the flow direction of the subject-to-cooling fluid, wherein the first evaporator includes a downstream core unit having the first core portion and the second core portion, and a pair of downstream tank units connected to both end portions of the downstream core unit to collect or distribute the refrigerant flowing in the downstream core portion, the second evaporator includes an upstream core unit having the third core portion and the fourth core portion, and a pair of upstream side tank units connected to both end portions of the upstream core unit to collect or distribute the refrigerant flowing in the upstream core unit, one of the pair of downstream tank units includes the first collecting portion and the second collecting portion, and one of the pair of upstream side tank units includes the first distributing portion and the second distributing portion.

12. A refrigerant evaporator in which heat exchange is performed between a subject-to-cooling fluid flowing outside and a refrigerant, the refrigerant evaporator comprising:

a first evaporator and a second evaporator that are arranged in a flow direction of the subject-to-cooling fluid; and a refrigerant exchanging portion coupling the first evaporator and the second evaporator {4), wherein the first evaporator (20) includes:

a heat exchanging core unit including a plurality of first tubes stacked and configured to allow the refrigerant to flow therein; and a pair of tank units connected to both end portions of the plurality of first tubes in a longitudinal direction of the plurality of first tubes to collect or distribute the refrigerant flowing in the plurality of first tubes, the heat exchanging core unit of the first evaporator includes a first core portion having a tube group of the plurality of first tubes, and a second core portion having the other tube group of the plurality of first tubes, the second evaporator includes:

a heat exchanging core unit including a plurality of second tubes stacked and configured to allow the refrigerant to flow therein; and a pair of tank units extending in a stacking direction of the plurality of second tubes, and connected to both end portions of the plurality of second tubes in a longitudinal direction to collect or distribute the refrigerant flowing in the plurality of second tubes; and the heat exchanging core unit of the second evaporator includes a third core portion having a tube group of the plurality of the second tubes, and a fourth core portion having a tube group of the plurality of the second tubes, the tube group of the third core portion is opposed to at least a part of the first core portion in the flow direction of the subject-to-cooling fluid, and the tube group of the fourth core portion is opposed to at least a part of the second core portion in the flow direction of the subject-to-cooling fluid, one of the pair of the tank units of the first evaporator includes a first collecting portion in which the refrigerant is collected from the first core portion (24*a*), and a second collecting portion in which the refrigerant is collected from the second core portion, one of the pair of tank units of the second evaporator includes a first distributing portion from which the refrigerant is distributed to the third core portion, a second distributing portion from which the refrigerant is distributed to the fourth core portion, and a partitioning member partitioning an inner space into the first distributing portion and the second distributing portion in the stacking direction of the second tubes, the other of the pair of the tank units of the second evaporator includes a refrigerant outflow port, through which the refrigerant flows out, at one end portion in the stacking direction of the second tubes, the refrigerant exchanging portion includes a first communicating portion that leads the refrigerant from the first collecting portion to the second distributing portion, and a second communicating portion that leads the refrigerant from the second collecting portion to the first distributing portion, the first communicating portion includes a first outlet port through which the refrigerant flows out to the second distributing portion, the second communicating portion includes a second outlet port through which the refrigerant flows out to the first distributing portion, the first outlet port is located at a position farther than the second outlet port from the refrigerant outflow port in the stacking direction of the second tubes, the first outlet port extends in the stacking direction of the second tubes from a position in the vicinity of the partitioning member the first communicating portion further includes a first inlet port into which the refrigerant flows from the first collecting portion, the second communicating portion further includes a second inlet port into which the refrigerant flows from the second collecting portion, and the outlet port is larger than the inlet port in an opening width in the stacking direction of the plurality of tubes in at least one of the first communicating portion and the second communicating portion.

13. The refrigerant evaporator according to claim 12, wherein the opening width of the outlet port of at least one of the first communicating portion and the second communicating portion is not smaller in the stacking direction than half the width of a core portion, which is the third core portion (lip) or the fourth core portion, communicating with the outlet port.

14. The refrigerant evaporator according to claim 12, wherein an opening area of the inlet port of at least one of the first communicating portion and the second communicating portion is smaller than the opening area of the outlet port.

15. The refrigerant evaporator according to claim 12 wherein the first outlet port of the first communicating portion is provided at least at a position opposed to tubes, located on one end side in the stacking direction, of the tube group of the fourth core portion, and the second outlet port of the second communicating portion is provided at least at a position opposed to tubes, located on one end side in the stacking direction, of the tube group of the third core portion.

16. The refrigerant evaporator according to claim 12, wherein the refrigerant exchanging portion includes an intermediate tank unit that communicates with the first and second collecting portions via an inlet communicating hole, and communicates with the first and second distributing portions via an outlet side communicating hole;

the intermediate tank unit includes therein a first refrigerant passage leading the refrigerant from the first collecting portion to the second distributing portion, and a second refrigerant passage leading the refrigerant from the second collecting portion to the first distributing portion, the first communicating portion includes the first refrigerant passage, and the second communicating portion includes the second refrigerant passage.

17. The refrigerant evaporator according to claim 12, wherein the refrigerant exchanging portion includes:

a first coupling member communicating with the first collecting portion;

a second coupling member communicating with the second collecting portion;

a third coupling member communicating with the first distributing portion;

a fourth coupling member communicating with the second distributing portion; and an intermediate tank unit coupled to the first and second coupling members and to the third and fourth coupling members, the intermediate tank unit includes:

a first refrigerant passage leading the refrigerant from the first coupling member to the fourth coupling member; and a second refrigerant passage leading the refrigerant from the second coupling member to the third coupling member, the first communicating portion includes the first coupling member the fourth coupling member and the first refrigerant passage, and the second communicating portion includes the second coupling member, the third coupling member and the second refrigerant passage.

18. The refrigerant evaporator according to claim 12, wherein the second evaporator is disposed upstream of the first evaporator in the flow direction of the subject-to-cooling fluid.

19. The refrigerant evaporator according to claim 12, wherein an width of the first outlet port is not smaller in the stacking direction of the second tubes than half the width of the fourth core portion communicating with the first outlet port.

* * * * *